US010693242B2

(12) United States Patent
Hyjazie

(10) Patent No.: US 10,693,242 B2
(45) Date of Patent: Jun. 23, 2020

(54) MINIATURIZATION OF QUAD PORT HELICAL ANTENNA

(71) Applicant: Fayez Hyjazie, Ottawa (CA)

(72) Inventor: Fayez Hyjazie, Ottawa (CA)

(73) Assignee: Huawei Technologies Co., Ltd., Shenzhen (CN)

( * ) Notice: Subject to any disclaimer, the term of this patent is extended or adjusted under 35 U.S.C. 154(b) by 310 days.

(21) Appl. No.: 15/404,898

(22) Filed: Jan. 12, 2017

(65) Prior Publication Data

US 2018/0198194 A1 Jul. 12, 2018

(51) Int. Cl.
*H01Q 21/28* (2006.01)
*H01Q 11/08* (2006.01)

(52) U.S. Cl.
CPC ..... *H01Q 21/28* (2013.01); *H01Q 11/08* (2013.01)

(58) Field of Classification Search
CPC ..... H01Q 1/36; H01Q 1/362; H01Q 1/38; H01Q 1/48; H01Q 9/0407; H01Q 9/30; H01Q 11/08; H01Q 11/083; H01Q 21/0087
See application file for complete search history.

(56) References Cited

U.S. PATENT DOCUMENTS 5,635,945 A 6/1997 McConnell et al.
6,005,521 A 12/1999 Suguro et al.
6,034,650 A * 3/2000 Kuramoto ..... H01Q 11/08 343/702
6,243,051 B1 * 6/2001 Vanstrum ..... H01Q 1/288 343/895
6,407,720 B1 6/2002 Josypenko
7,515,113 B2 * 4/2009 Petros ..... H01Q 1/36 343/833
8,681,070 B2 * 3/2014 Dinallo ..... H01Q 11/08 343/853
9,472,842 B2 * 10/2016 Faraone ..... H01Q 1/362
2004/0257297 A1 12/2004 Petros
2005/0275601 A1 * 12/2005 Jostell ..... H01Q 11/08 343/895

(Continued)

FOREIGN PATENT DOCUMENTS

CN 1206508 A 1/1999
CN 1263641 A 8/2000

(Continued)

OTHER PUBLICATIONS

U.S. Appl. No. 14/839,192, entitled "Multi-Filar Helical Antenna", filed Aug. 28, 2015.

*Primary Examiner* — Daniel Munoz
*Assistant Examiner* — Patrick R Holecek

(57) ABSTRACT

Quadrifilar helical antennae with four separate ports and providing a reduction in height are described. The QHA includes four conductive helical traces wound about a common longitudinal antenna axis. The conductive helical traces are configured for transmitting or receiving at a selected frequency band. Each conductive helical trace is connected to a respective port of the antenna via a respective launch line. The QHA also includes at least one conductive component insulated from the conductive helical traces and superimposed over the conductive helical traces. The at least one conductive component is configured to provide impedance matching at the frequency band.

18 Claims, 51 Drawing Sheets

(56) References Cited

U.S. PATENT DOCUMENTS

| | | | | |
|---|---|---|---|---|
| 2008/0174501 | A1 | 7/2008 | Licul et al. | |
| 2010/0177014 | A1 | 7/2010 | Min et al. | |
| 2014/0139384 | A1* | 5/2014 | Elliot ..... | H01Q 21/30<br>343/727 |

FOREIGN PATENT DOCUMENTS

| | | | |
|---|---|---|---|
| EP | 0944930 | B1 | 6/2003 |
| EP | 1524722 | B1 | 6/2007 |
| GB | 2322236 | A | 8/1998 |
| TW | 200623518 | A | 7/2006 |
| WO | 2006011723 | A1 | 2/2006 |

* cited by examiner

Total Gain Radiation Pattern, F=2.3 GHz

Total Gain Radiation Pattern, F=2.5 GHz

Total Gain Radiation Pattern, F=2.7 GHz

Total Gain Radiation Pattern, F=2.3 GHz

Total Gain Radiation Pattern, F=2.5 GHz

Total Gain Radiation Pattern, F=2.7 GHz

Total Gain Radiation Pattern, F=2.3 GHz

Total Gain Radiation Pattern, F=2.5 GHz

Total Gain Radiation Pattern, F=2.7 GHz

Total Gain Radiation Pattern, Nominal
Port 1 Excited F=2.5 GHz

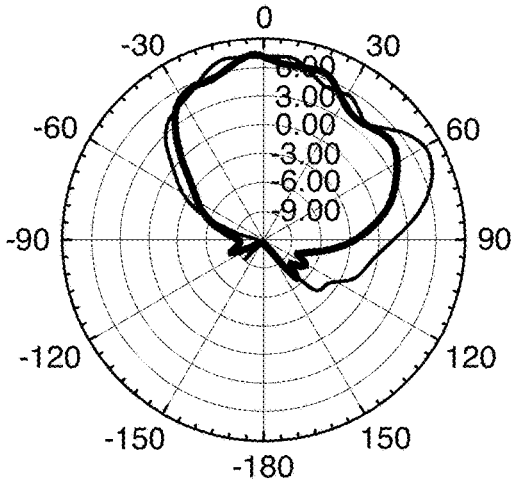

Curve Info
dB(GainTotal)
Setup1 : Sweep
Freq='2.3GHz' Phi='0deg'
dB(GainTotal)
Setup1 : Sweep
Freq='2.3GHz' Phi='90deg'

Total Gain Radiation Pattern, F=2.5 GHz

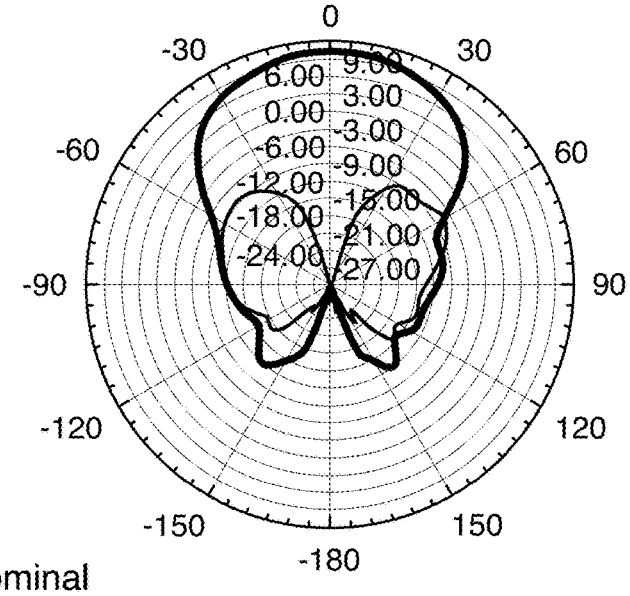

Curve Info
dB(GainTotal)
Setup1 : Sweep
Freq='2.5GHz' Phi='0deg'
dB(GainTotal)
Setup1 : Sweep
Freq='2.5GHz' Phi='90deg'

Total Gain Radiation Pattern, Nominal
Port 2 Excited F=2.5 GHz

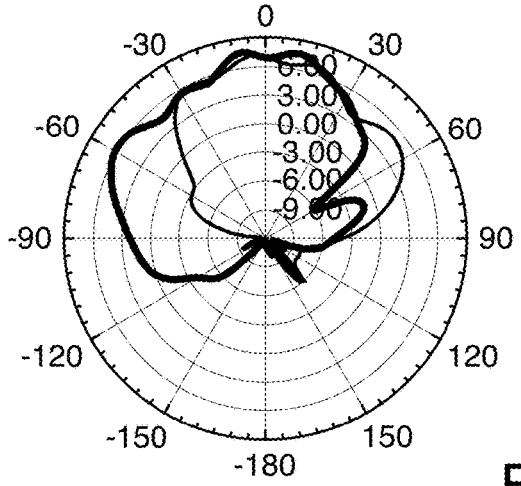

CP Excitations 0°, 90°, 180°, 270°
F=2.5 GHz

Curve Info
dB(GainTotal)
Setup1 : Sweep
Freq='2.7GHz' Phi='0deg'
dB(GainTotal)
Setup1 : Sweep
Freq='2.7GHz' Phi='90deg'

FIG.7C

Total Gain Radiation Pattern, F=3.4 GHz

Total Gain Radiation Pattern, F=3.5 GHz

Total Gain Radiation Pattern, F=3.6 GHz

Total Gain Radiation Pattern, F=2.3 GHz

Total Gain Radiation Pattern, F=2.5 GHz

Total Gain Radiation Pattern, F=2.7 GHz

Total Gain Radiation Pattern, F=2.1 GHz

Total Gain Radiation Pattern, F=2.3 GHz

Total Gain Radiation Pattern, F=2.5 GHz

Total Gain Radiation Pattern, F=2.7 GHz

MINIATURIZATION OF QUAD PORT HELICAL ANTENNA

FIELD

The present disclosure relates to miniaturization of a quadrifilar helical antenna (QHA) with four independent ports, including for use in multiple-input multiple-output (MIMO) communication systems and other wireless communication systems.

BACKGROUND

A quadrifilar helical antenna (QHA) is comprised of four separate helices with four independent ports. A QHA may be constructed from metal wires, conductive strips or printed on a dielectric sheet that is cylindrically wrapped to generate, with a suitable feeding network, circular polarization radiation. QHAs have been used for antenna diversity, land mobile satellite (LMS) communication, as well as other satellite communications and navigation systems.

QHAs have been used as circularly polarized (CP) single port antenna elements in two-element, three-element or two-by-two element arrays for application in multiple-input multiple-output (MIMO) systems. In MIMO applications, antenna elements with only two independent physical ports are typically implemented. A four-port QHA antenna element had been demonstrated in a single antenna MIMO system in comparison to four spatially-separated half-wave dipoles MIMO system. Using multi-port QHAs as antenna elements in an antenna array may help to reduce the total size of the antenna array, which would be useful for miniaturization purposes as well as providing reduction in cost.

An example multi-port QHA design is described in U.S. patent application Ser. No. 14/839,192, entitled "Multi-Filar Helical Antenna", filed Aug. 28, 2015, the entirety of which is hereby incorporated by reference. It would be useful to modify this design, for example to reduce the antenna height, improve the radiation patterns, reduce coupling between ports and/or maintain a relatively wide impedance bandwidth.

SUMMARY

Various examples described herein provide designs for QHAs that enable an increase in the number of antenna ports in MIMO and other suitable applications. With the addition of one or more capacitive (e.g., metallic) conductive components in examples described herein, a QHA may be achieved that has a more compact size, improved radiation patterns, sufficiently wide impedance bandwidth and that provides a reduction in cost, compared to prior art QHAs. An increased capacity (e.g., measured as bits/s) versus signal-to-noise ratio (SNR) may also be achieved. In some examples, close to 70% reduction in antenna height, improvements in radiation patterns, reduction in opposite port coupling and increase in antenna impedance and pattern bandwidth may be achieved, compared to prior art QHAs.

The disclosed example QHAs may enable four-port antenna elements to be used in an antenna array (e.g., for massive MIMO applications), which may enable the size of the array panel to be decreased (e.g., about 42% size reduction in some examples) compared to arrays using two-port antenna elements.

In some examples, the present disclosure describes a QHA. The QHA includes four conductive helical traces wound about a common longitudinal antenna axis. The conductive helical traces are configured for transmitting or receiving at a selected frequency band. Each conductive helical trace is connected to a respective port of the antenna via a respective launch line. The QHA also includes at least one conductive component insulated from the conductive helical traces and superimposed over (or under) the conductive helical traces. The at least one conductive component is configured to provide impedance matching at the frequency band.

In some examples, the present disclosure describes an antenna array. The antenna array includes a plurality of four-port QHAs. Each QHA includes four conductive helical traces wound about a common longitudinal antenna axis. The conductive helical traces are configured for transmitting or receiving at a selected frequency band. Each conductive helical trace is connected to a respective port of the antenna via a respective launch line. Each QHA also includes at least one conductive component insulated from the conductive helical traces and superimposed over (or under) the conductive helical traces. The at least one conductive component is configured to provide impedance matching at the frequency band.

In some examples, the present disclosure describes a method for manufacturing a QHA. The method includes providing four conductive helical traces as traces on a first surface of a flexible dielectric material. Each conductive helical trace is provided with a tail and a respective launch line for connecting to a respective port of the antenna. The conductive helical traces are configured for transmitting or receiving at a selected frequency band. The method also includes providing at least one conductive component on a different second surface of the flexible dielectric material. The at least one conductive component is positioned to be insulated from the conductive helical traces and superimposed over the conductive helical traces. The at least one conductive component is configured to provide impedance matching at the frequency band. The method also includes wrapping the flexible dielectric material such that the conductive helical traces form helical windings about a common longitudinal antenna axis.

The at least one conductive component may include at least one conductive ring and/or conductive patches. There may be one set of conductive patches, or more than one set of conductive patches.

BRIEF DESCRIPTION OF THE DRAWINGS

Reference will now be made, by way of example, to the accompanying drawings which show example embodiments of the present application, and in which:

FIGS. 7B-7C are plots showing the radiation pattern and S-parameters of the QHA of FIG. 7A;

Similar reference numerals may have been used in different figures to denote similar components.

DESCRIPTION OF EXAMPLE EMBODIMENTS

Figure 1A:
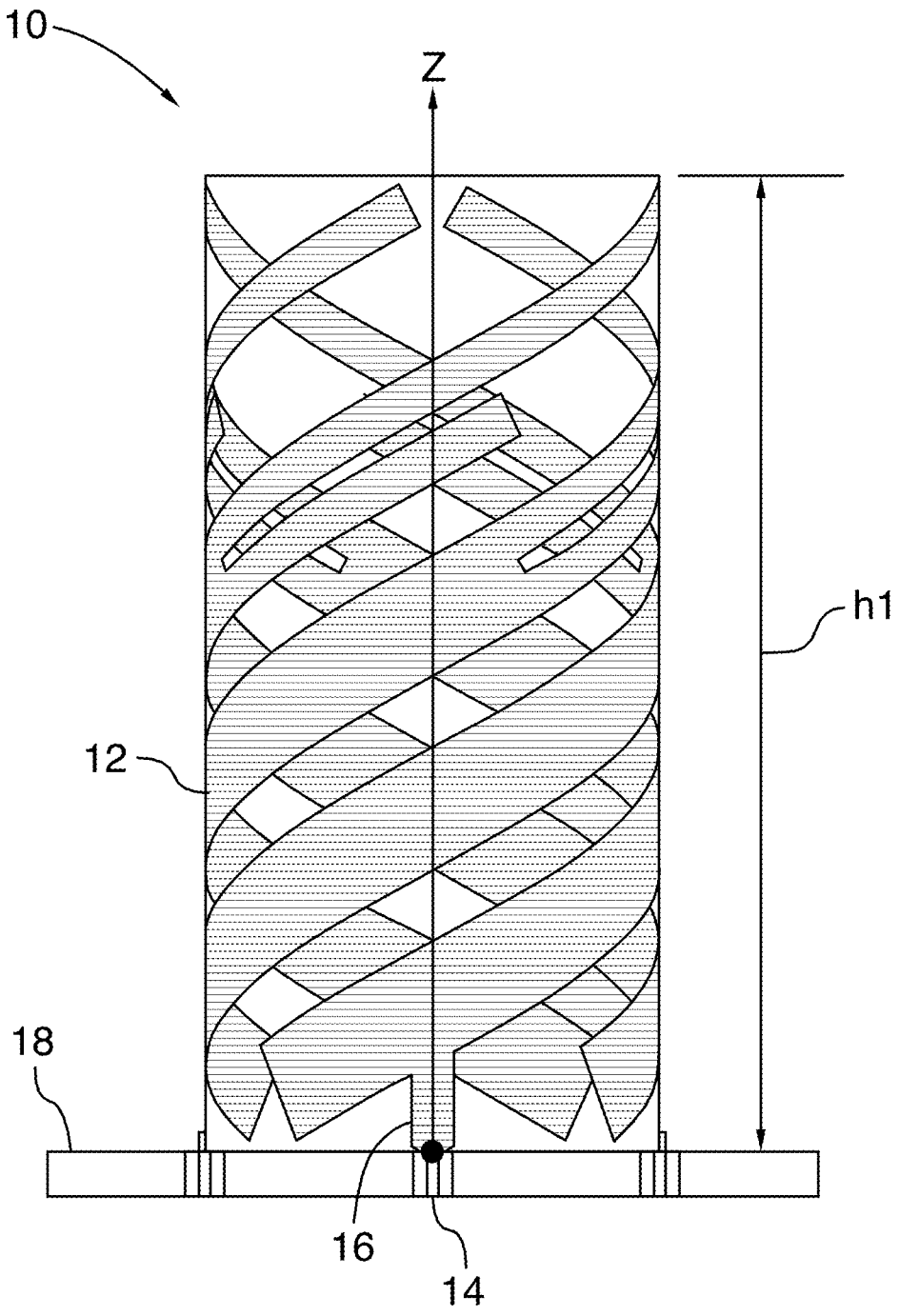
FIG.1A PRIOR ART
FIG. 1A is a schematic diagram of an example prior art QHA.

FIG. 1A illustrates an example prior art quadrifilar helical antenna (QHA) 10, for example as described in U.S. patent application Ser. No. 14/839,192, previously incorporated by reference. The QHA 10 includes four helically wound conductive helical traces 12 (also referred to as windings or filars), each conductive helical trace 12 being connected to a respective port 14 via a respective launch line 16. Each conductive helical trace 12 may have an extended base and raised height, such as described in the above-noted patent application. Each conductive helical trace 12 is independently fed, resulting in a four-port QHA 10. A four-port QHA may also be referred to as a quad-port antenna, or a quad antenna. The conductive helical traces 12 are spaced apart by an angular distance of 90° between adjacent conductive helical traces 12, are equal in length, and are wound at the same pitch in the same direction. In the example shown, the QHA 10 is mounted on a ground plane 18, in this example a metal ground plane 18 that may serve as a conductive reflector. The ground plane 18 may help to direct side lobes of the radiation pattern towards the forward direction (away from the ground plane 18), however in some examples the ground plane 18 may be omitted. The conductive helical traces 12 may be provided as traces on a dielectric material that is formed as a hollow cylinder, or by winding the conductive helical traces 12 about a support surface, for example. Generally, the conductive helical traces 12 may be formed of any suitable conductive material, such as copper.

Figure 1B:
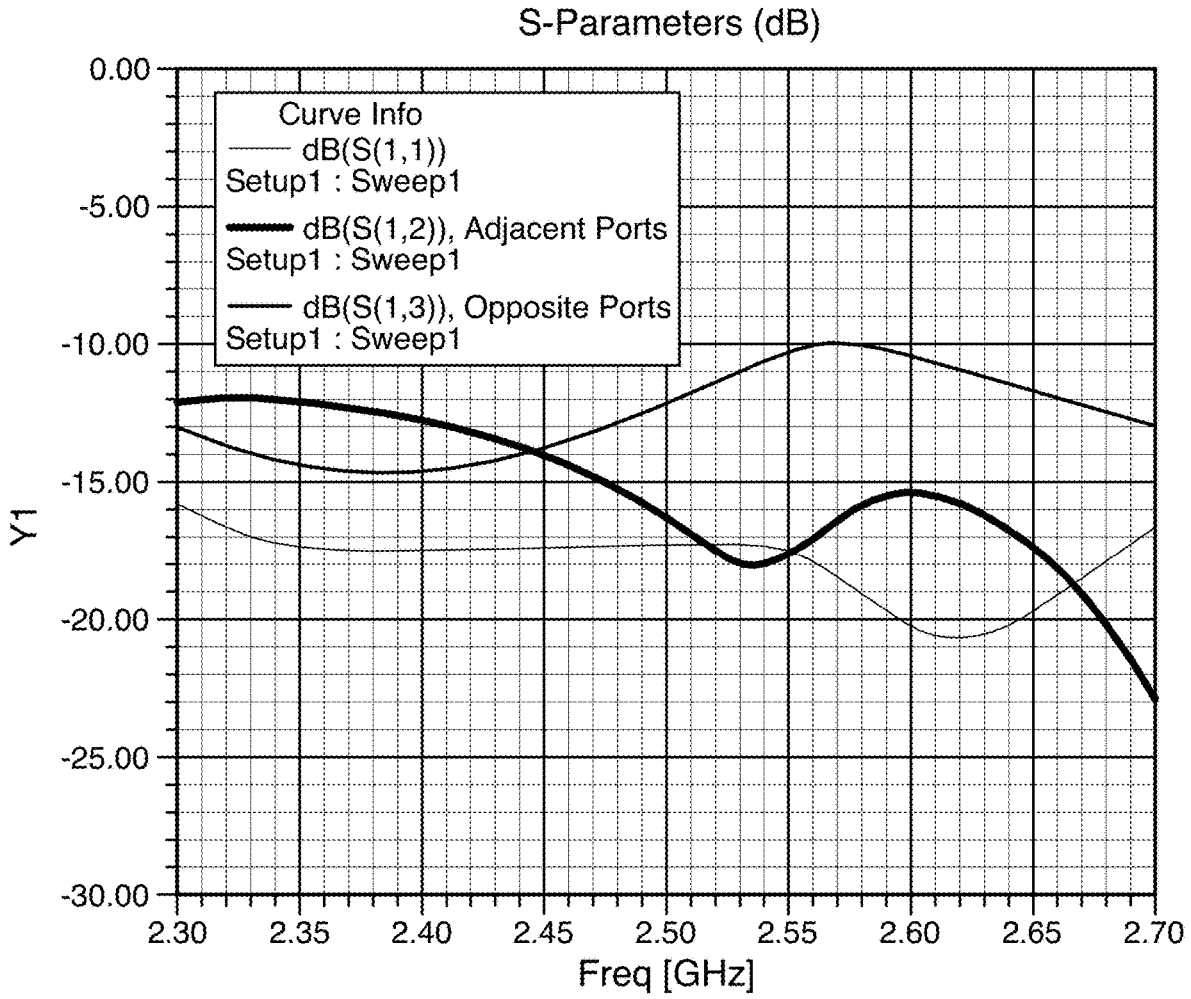
FIG. 1B is a plot showing scattering parameters (S-parameters) of the QHA of FIG. 1A.
Figure 1C:
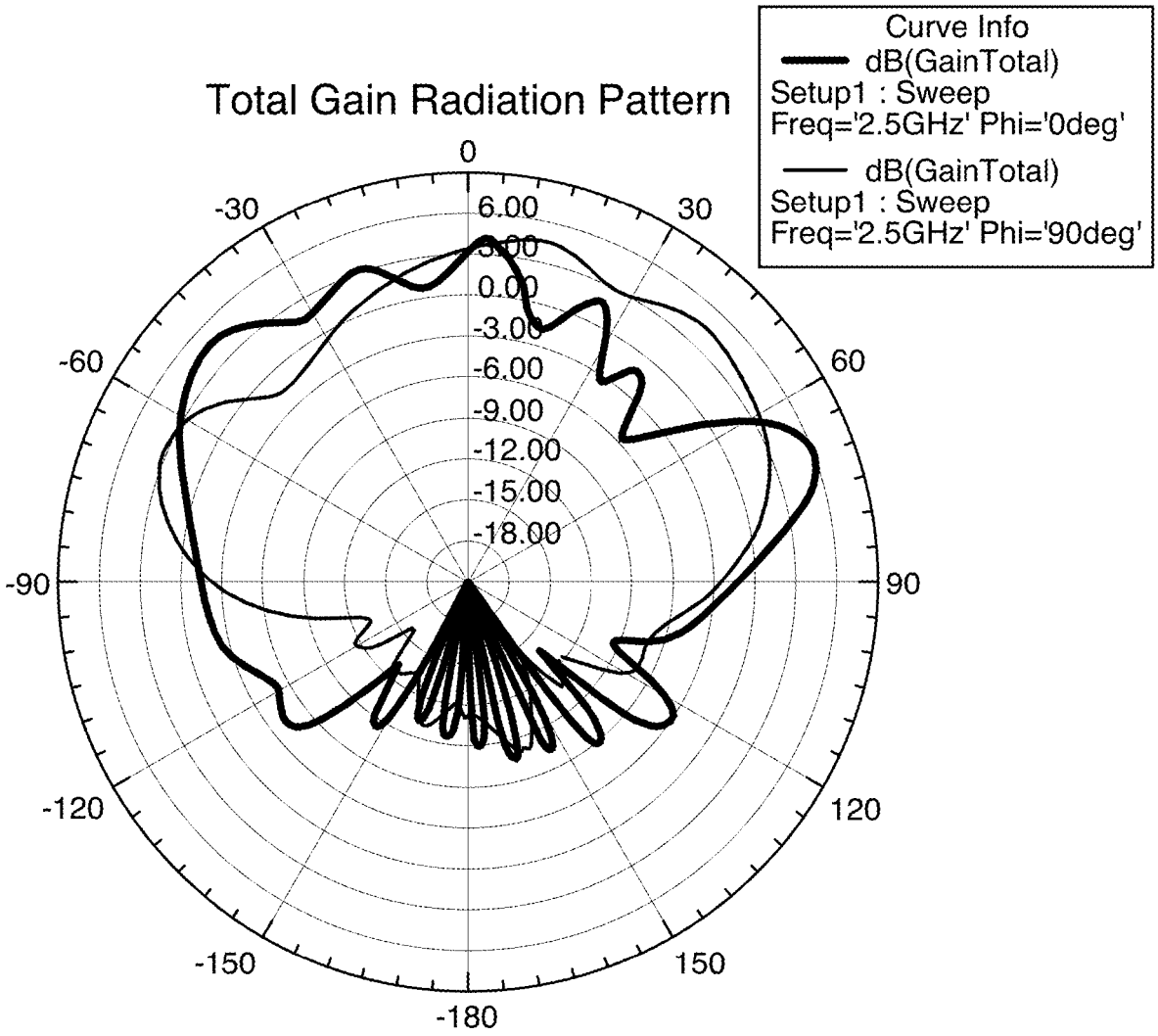
FIG. 1C is a plot showing radiation pattern of the QHA of FIG. 1A.

The height h1 of the QHA 10 may be less than one wavelength λ of the operating frequency. For example, the QHA 10 may have a height h1 of 0.75λ. For an operating frequency of 2.5 GHz, the height h of the QHA 10 is approximately 90 mm. FIG. 1B shows the scattering parameters (S-parameters) of the example QHA 10 over operating frequencies in the range of 2.3 GHz to 2.7 GHz, and FIG. 1C shows the radiation pattern of the example QHA 10 at an operating frequency of 2.5 GHz. The example QHA 10 was found to have a wide impedance bandwidth of about 16% in the operating range of 2.3 GHz to 2.7 GHz, and maximum couplings of about −10 dB. However, improvements in the radiation pattern may be desired, as well as a reduction in antenna height.

In examples provided below, various QHA designs are described that incorporate a capacitive component, for example in the form of conductive patches or a conductive ring. Such designs have been found to enable a reduction in height of the QHA, and may also provide improved radiation patterns. Different designs may be tuned for different frequency bands of interest, which may be particularly relevant for 5G wireless applications. The following table describes some examples discussed in greater detail below:

| Frequency band | Antenna height | Antenna diameter | Height reduction compared to QHA of above-referenced patent application |
|---|---|---|---|
| 2.3 GHz-2.7 GHz | 39 mm = 0.325λ | 42 mm = 0.350λ | 57% |
| 2.3 GHz-2.7 GHz | 28 mm = 0.233λ | 50 mm = 0.417λ | 69% |
| 1.9 GHz-2.3 GHz | 36 mm = 0.252λ | 50 mm = 0.350λ | 66% |
| 3.4 GHz-3.6 GHz | 38 mm = 0.443λ | 50 mm = 0.583λ | 40% |

Figure 2:
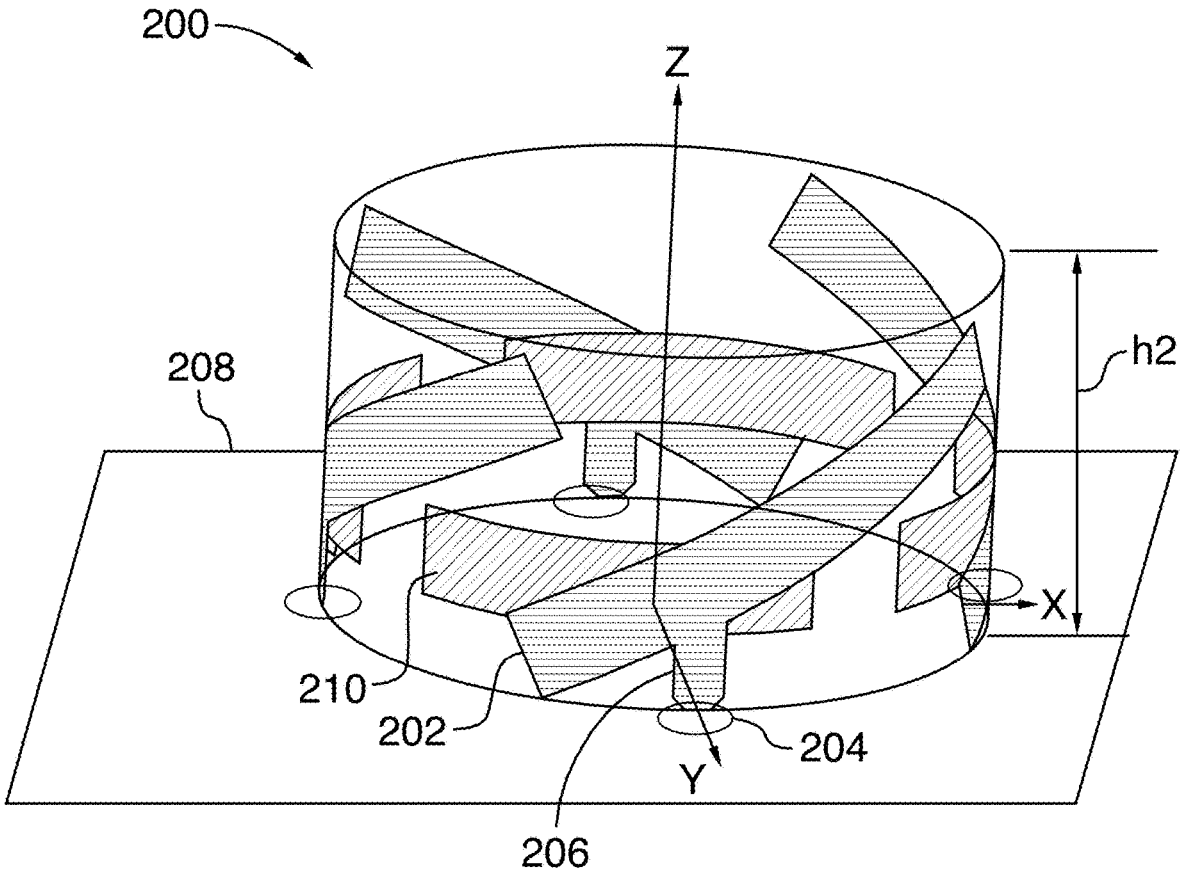
FIG. 2 is a schematic diagram of an example QHA with conductive patches.

FIG. 2 is a schematic diagram illustrating an example QHA 200 incorporating conductive patches 210. The example QHA 200 includes a plurality of conductive helical traces 202, in this case four conductive helical traces 202, which may be provided by printing or etching on a dielectric material. For example, the conductive helical traces 202 may be provided by etching a flexible dielectric material (e.g., DuPont™ Pyralux® AP flexible circuit material, having a dielectric constant (DK) of 3.4 and a thickness of 0.127 mm) that may then be wrapped into a cylinder shape. The conductive helical traces 202 may be provided in other ways, for example by winding conductive wires or strips about a supporting surface, or by etching a coaxial dielectric cable.

The conductive helical traces 202 in the example of FIG. 2 are evenly spaced apart, with an angular separation of 90° between adjacent conductive helical traces 202. The conductive helical traces 202 may be similar to each other in the number of windings, pitch, length, width and direction of winding. In the example of FIG. 2, the conductive helical traces 202 each have a length less than one wavelength λ of the operating frequency (e.g., λ/4), complete less than one turn and have substantially constant width throughout its length. It should be noted that though each conductive helical trace 202 is wound less than one complete turn, the conductive helical traces 202 are still considered to be helically wound about a common central longitudinal z-axis of the QHA 200. In other examples (including some examples discussed further below), the conductive helical traces 202 may complete less than one or more turns, may have variable width and/or may divide into two or more branches of equal or unequal width. Generally, the dimensions and configuration of the conductive helical traces 202 may be selected to achieve desired antenna characteristics, using appropriate tuning techniques, as part of antenna design. Example dimensions and configurations of the conductive helical traces 202 that may be suitable are described in U.S. patent application Ser. No. 14/839,192, previously incorporated by reference. Tuning of the QHA 200 may be carried out with the assistance of simulations, for example.

Each conductive helical trace 202 is connected to a respective port 204 via a respective launch line 206. In this example, the four conductive helical traces 202 are each independently fed to a respective port 204, resulting in a four-port QHA 200. The QHA 200 may be mounted on a ground plane 208. The ground plane 208 may be made of any suitable conductive material, and may serve as a conductive reflector. Each conductive helical trace 202 may be connected to an antenna feed network (not shown) via the respective port 204, for transmitting or receiving signals.

The QHA 200 includes one or more conductive components, in this example conductive patches 210, electrically insulated from the conductive helical traces 202. For example, the QHA 200 in FIG. 2 includes four conductive patches 210. The conductive patches 210 are positioned such that each conductive helical trace 202 is at least partially superimposed by a conductive patch 210. For example, each conductive helical trace 202 may be partially superimposed by a different respective conductive patch 210, as shown in FIG. 2. In some examples, a single conductive patch 210 may superimpose two or more conductive helical traces 202. In some examples, a single conductive helical trace 202 may be superimposed by two or more conductive patches 210. The number of conductive patches 210 may be greater or fewer than the number of conductive helical traces 202. In the present disclosure, the term "superimposed" is used to indicate that a conductive helical trace 202, when projected through the dielectric or supporting surface, would overlap with a conductive patch 210; "superimposed" does not necessarily mean that the conductive helical trace 202 and the conductive patch 210 are physically in contact; "superimposed" does not require any order in which the conductive helical trace 202 and the conductive patch 210 are provided, and the conductive patch 210 may be described as being superimposed over the conductive helical trace 202 or superimposed under the conductive helical trace 202. The conductive helical trace 202 and the conductive patch 210 may be insulated from each other.

The conductive patches 210 may be provided by printing on a surface of the dielectric substrate that is opposite to the surface on which the conductive helical traces 202 are provided. Alternatively, the conductive patches 210 may be provided by sandwiching the patches 210 between two dielectric layers (e.g., the conductive patches 210 are provided on an inside or inner layer of a dual-layer dielectric) and the conductive helical traces 202 may be provided on an outer surface of the two dielectric layers. In some examples, the conductive patches 210 may be printed on one dielectric layer, the conductive helical traces 202 may be printed on another dielectric layer, and then the dielectric layers may be laminated together. Any suitable method for providing the conductive patches 210 may be used, as long as the conductive patches 210 are electrically insulated from the conductive helical traces 202 and are superimposed over the conductive helical traces 202.

The conductive patches 210 may be similar to each other in length, width and/or pitch. In the example of FIG. 2, the conductive patches 210 have substantially constant width throughout their length, however in other examples the conductive patches 210 may have variable width or may have different geometries (including irregular geometries). As shown, the conductive patches 210 have a pitch of 0°—that is, the longitudinal axes of the conductive patches 210 are generally parallel to the bottom of the QHA 200.

Although FIG. 2 shows four conductive patches 210, in some examples, longer conductive patches may be used, such that one longer conductive patch serves the function of two or more shorter conductive patches 210.

The positions, dimensions and configuration of the conductive patches 210 may be selected to achieve desired antenna characteristics, as part of the tuning of the antenna design. Such tuning may be carried out in conjunction with tuning of the conductive helical trace 202 design.

The height h2 of the QHA 200 may be reduced, compared with a prior art QHA, and the characteristics of the antenna may be maintained or improved compared to the prior art QHA. For example, the inclusion of conductive patches 210 may enable the QHA 200 to achieve an improved radiation pattern and reduced antenna height h2, compared to a prior art QHA tuned to the same frequency band, and still maintain desirable coupling between ports and wide impedance bandwidth. Example simulations are discussed further below, to demonstrate such performance characteristics.

Figure 3:
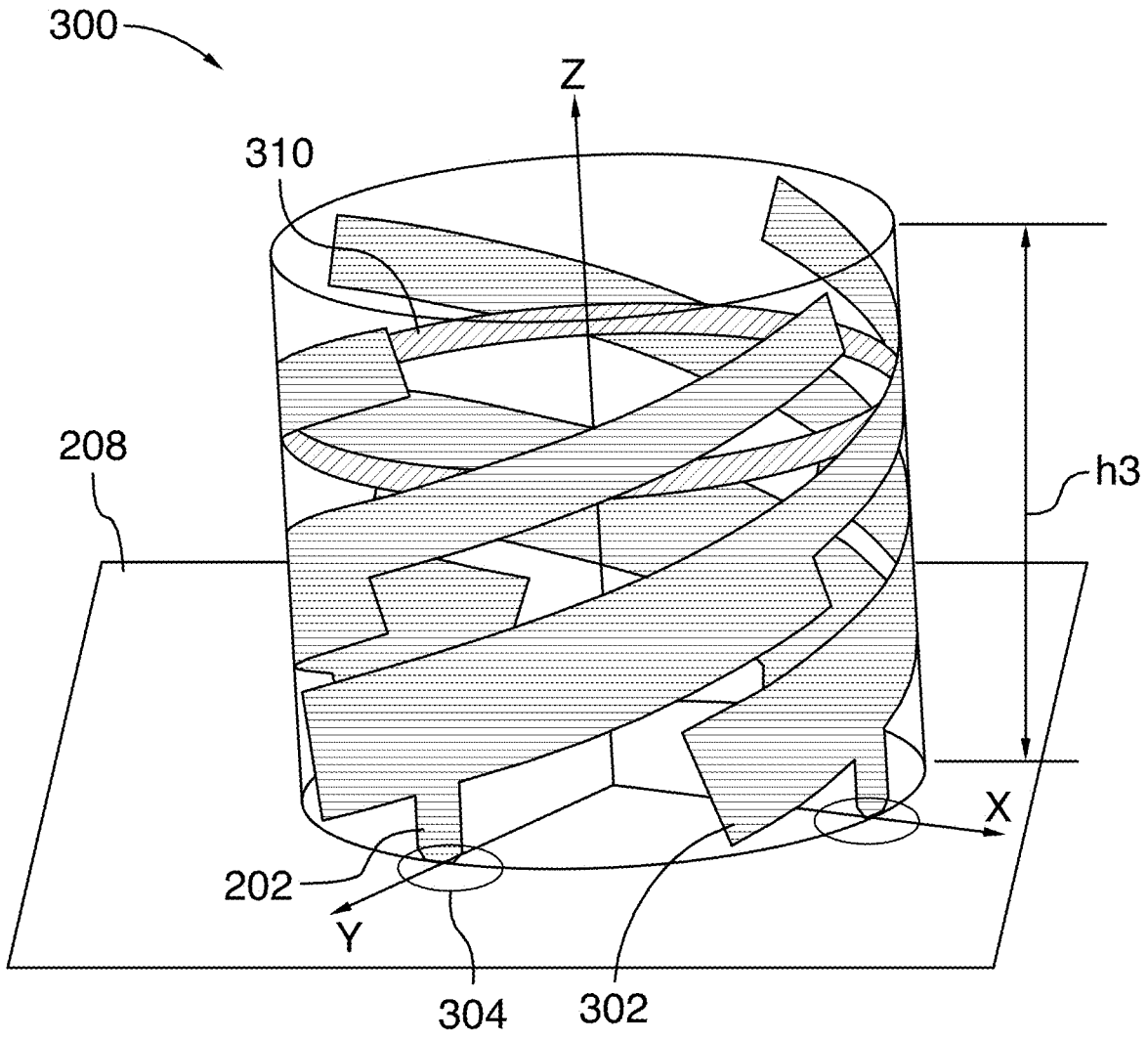
FIG. 3 is a schematic diagram of an example QHA with a conductive ring.

FIG. 3 is a schematic diagram illustrating another example QHA 300 in which the conductive patches are replaced with a conductive ring. The QHA 300 of FIG. 3 includes four conductive helical traces 302, connected to respective ports 304 via respective launch lines 306 and mounted on a ground plane 308, similar to the QHA 200 of FIG. 2 (with selectable variations in dimensions and configuration as discussed above). Instead of one or more conductive patches, the conductive component of the QHA 300 is a conductive ring 310 that is positioned to be superimposed over all the conductive helical traces 302. Conceptually, the conductive ring 310 may be thought of as a conductive patch that extends fully around the perimeter of the QHA 300. The conductive ring 310 may be provided in a manner similar to the conductive patches 210 described above.

The conductive ring 310 may have a substantially constant width throughout, as shown in FIG. 3. In other examples, the conductive ring 310 may have variable width. Although described as a ring, the conductive ring 310 may have a non-circular geometry. For example, the conductive ring 310 may follow the perimeter of a square or other regular or irregular geometry. The conductive ring 310 may have a non-zero pitch angle, or may have pitch of 0°—that is, substantially parallel to the ground plate 308 (as in the example of FIG. 3). Regardless of the pitch of the conductive ring 310, the conductive ring 310 is centered on the longitudinal z-axis of the QHA 300. The position, dimensions and configuration of the conductive ring 310 may be selected to achieve desired antenna characteristics, as part of the tuning of the antenna design. Such tuning may be carried out in conjunction with tuning of the conductive helical trace 302 design.

Similarly to the example of FIG. 2, the inclusion of a conductive ring 310 in the example of FIG. 3 may enable a reduction in the height h3 of the QHA 300 and improved radiation pattern, and at the same time maintaining desirable coupling between ports and wide impedance bandwidth, compared to a prior art QHA tuned to the same frequency band. Example simulations are discussed further below, to demonstrate such performance characteristics.

Generally, the inclusion of a conductive component (e.g., one or more conductive patches 210 or a conductive ring 310) may give rise to improvements in antenna characteristics. A conductive component may be metallic, or made of any other suitable conductive material. The use of a conductive ring 310 instead of conductive patches 210 may result in different antenna performance. For example, use of a conductive ring 310, instead of conductive patches 210, may provide a more desirable radiation pattern when wrapping around a square-based QHA design in the 1.9 GHz to 2.3 GHz frequency band. The selection of which configuration of conductive component to use, or whether a combination of conductive ring 310 and conductive patches 210 should be used, may be part of the tuning of the antenna design and/or dependent on the geometry of the supporting structure (e.g., square-based or circle-based), and may be carried out with the assistance of simulations.

Some example simulation results are now discussed to illustrate the performance of example QHAs disclosed herein. These simulations are provided for illustration only and are not intended to be limiting or promissory.

Figure 4A:
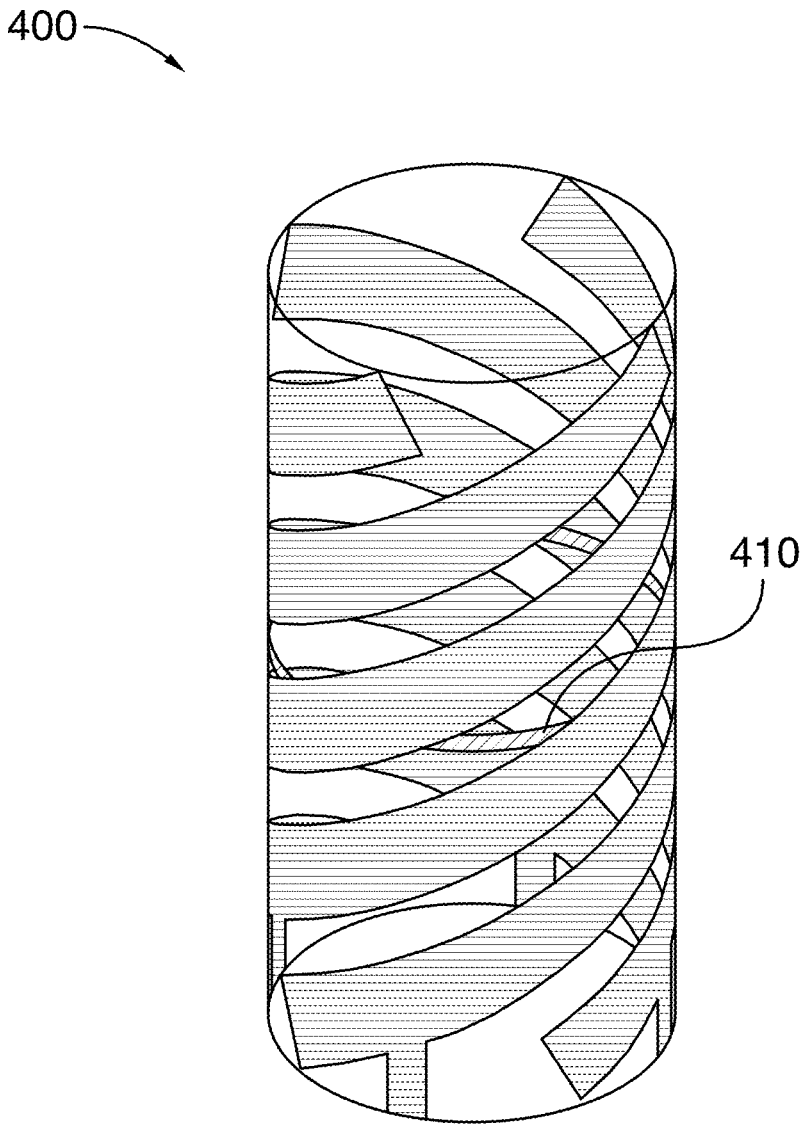
FIG. 4A is a schematic diagram of another example QHA with a conductive ring, tuned for a frequency band of 2.3 GHz to 2.7 GHz.

FIG. 4A illustrates an example QHA 400 having a conductive ring 410. Performance of this QHA 400 was simulated for a frequency band of 2.3 GHz to 2.7 GHz, and results are discussed below for an operating frequency of 2.5 GHz. Through appropriate tuning, the antenna height was selected to be 0.75λ. The conductive ring 410 in this example has a width of 2 mm=0.017λ, and is positioned at a height of 45 mm=0.375λ (as measured from the bottom of the QHA 400 to the lower edge of the ring 410). The simulations for the example QHA 400 may be compared to simulations performed for a prior art QHA (not shown) having identical dimensions and configurations, but without a conductive ring.

Figure 4B:
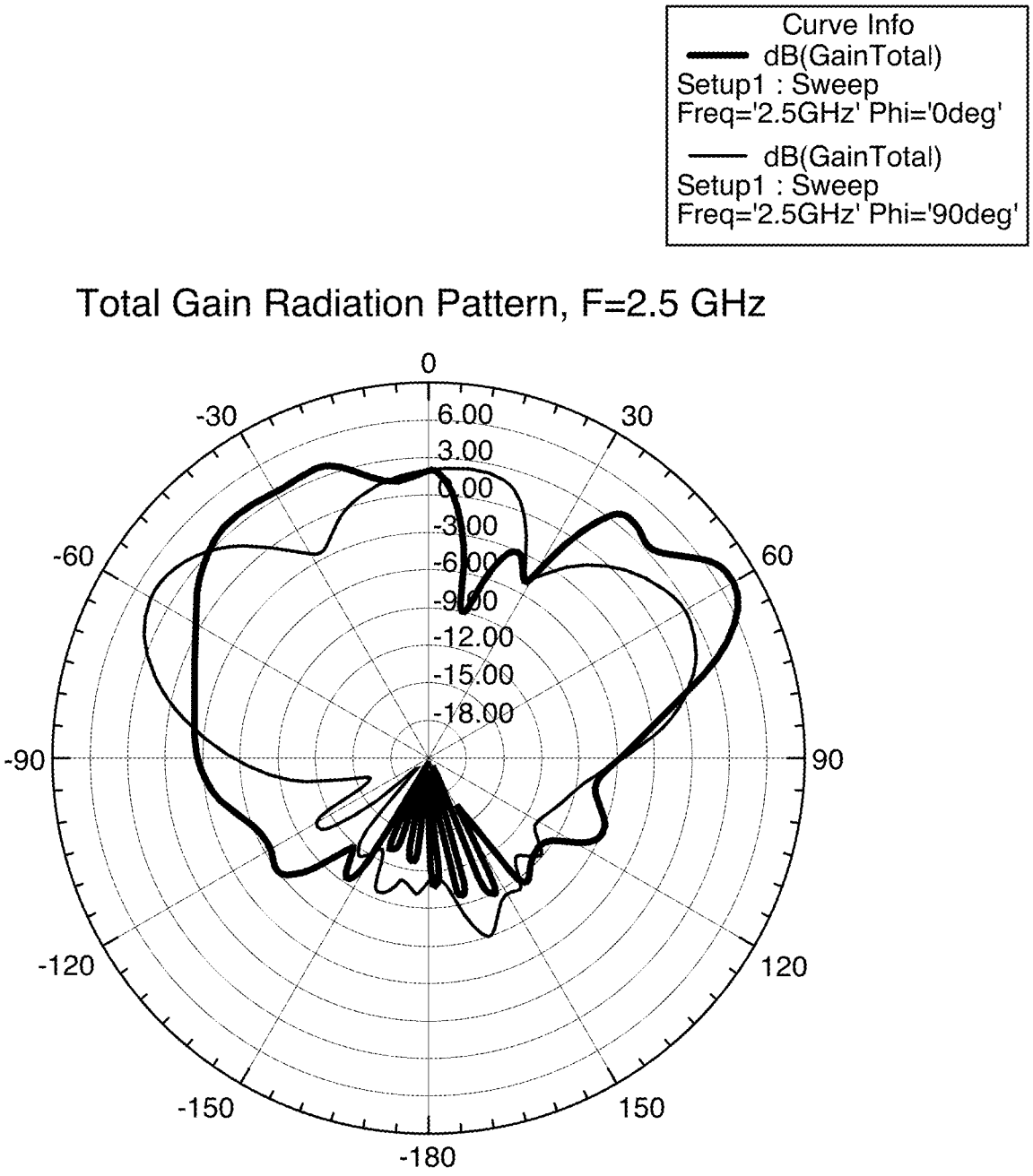
FIGS. 4B-4E are plots showing the radiation pattern and S-parameters of the QHA of FIG. 4A, and a comparative prior art QHA.
Figure 4C:
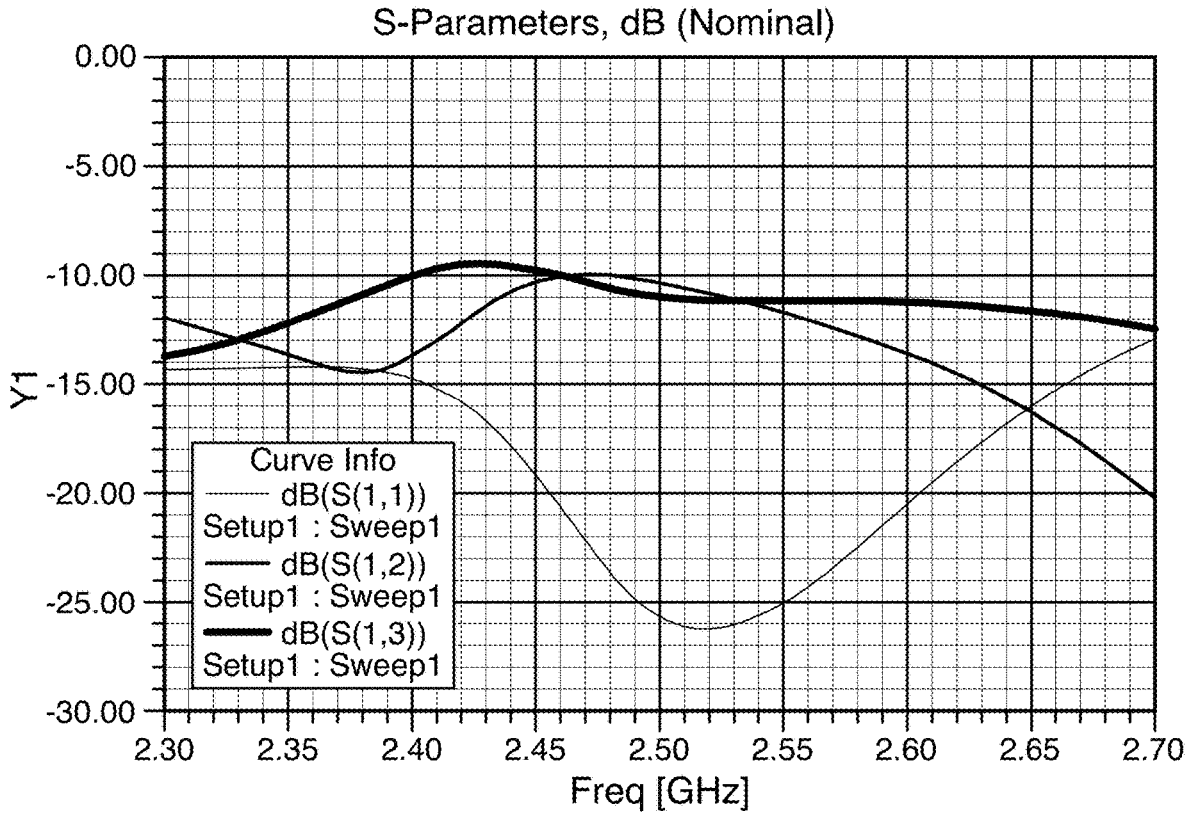
Figure 4D:
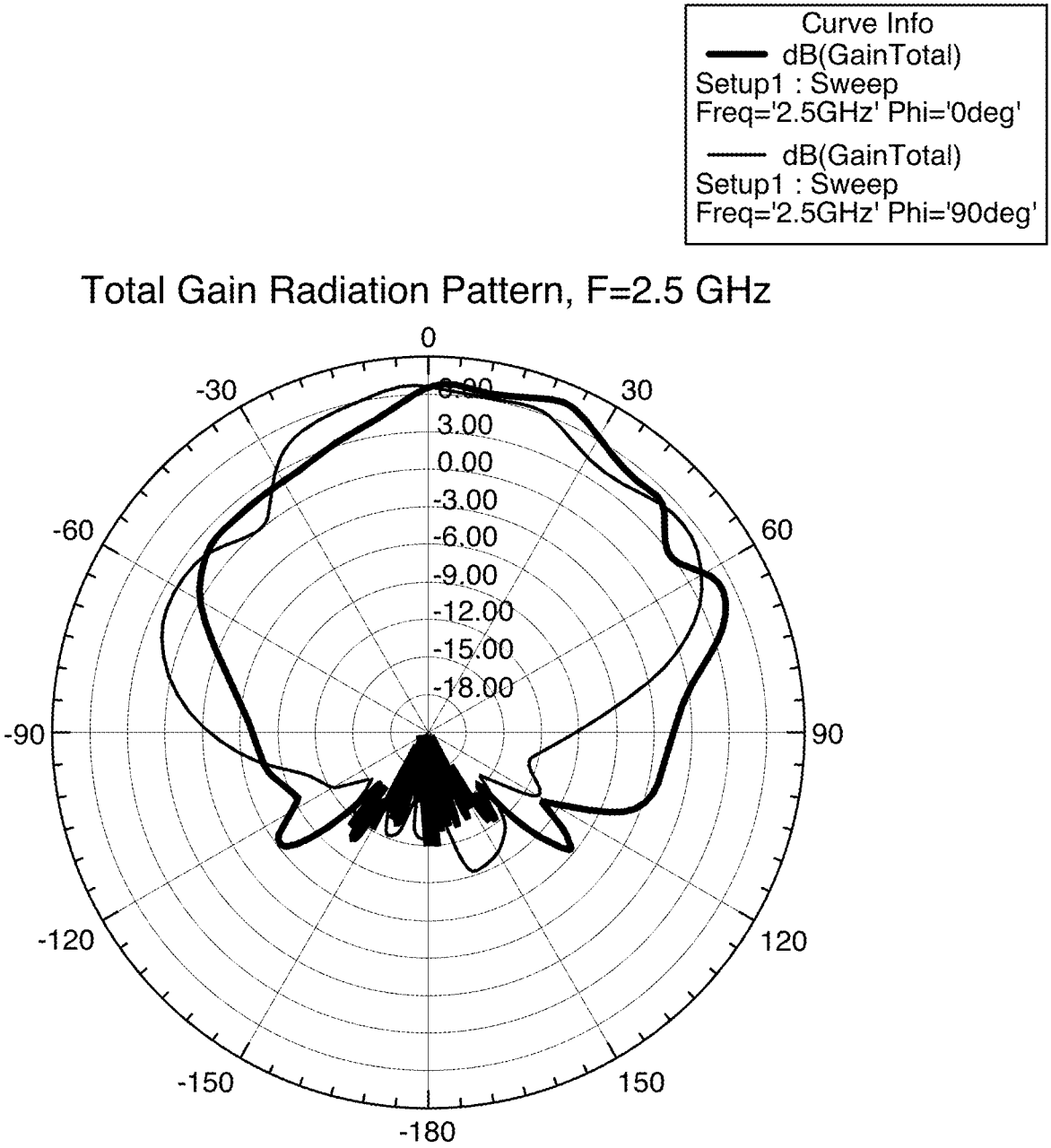
Figure 4E:
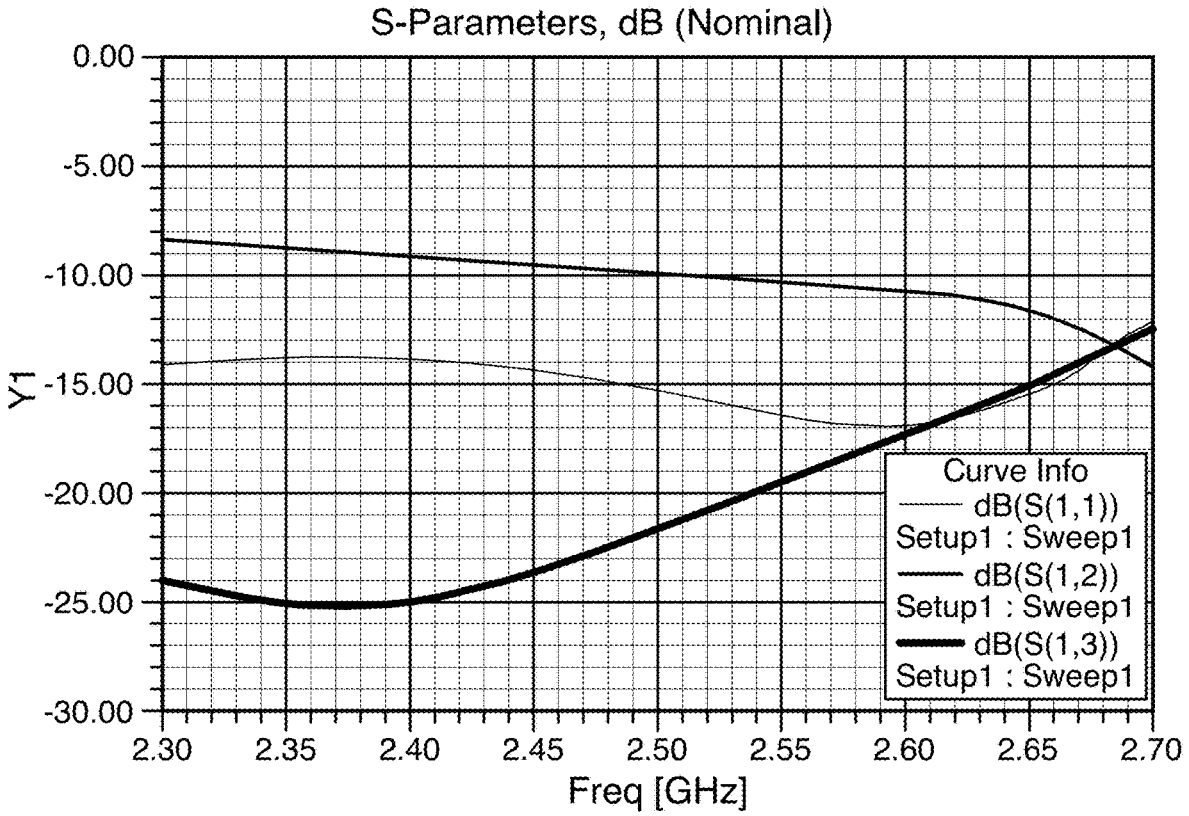

FIGS. 4B and 4C show the radiation pattern and scattering parameters (S-parameters), respectively, of the comparative prior art QHA. For comparison, the radiation pattern and S-parameters of the QHA 400 of FIG. 4A are shown in FIGS. 4D and 4E, respectively. As can be seen in these plots, the inclusion of the conductive ring 410 results in an improved radiation pattern, with impedance match at less than −12 dB in the frequency band of 2.3 GHz to 2.7 GHz.

Figure 5A:
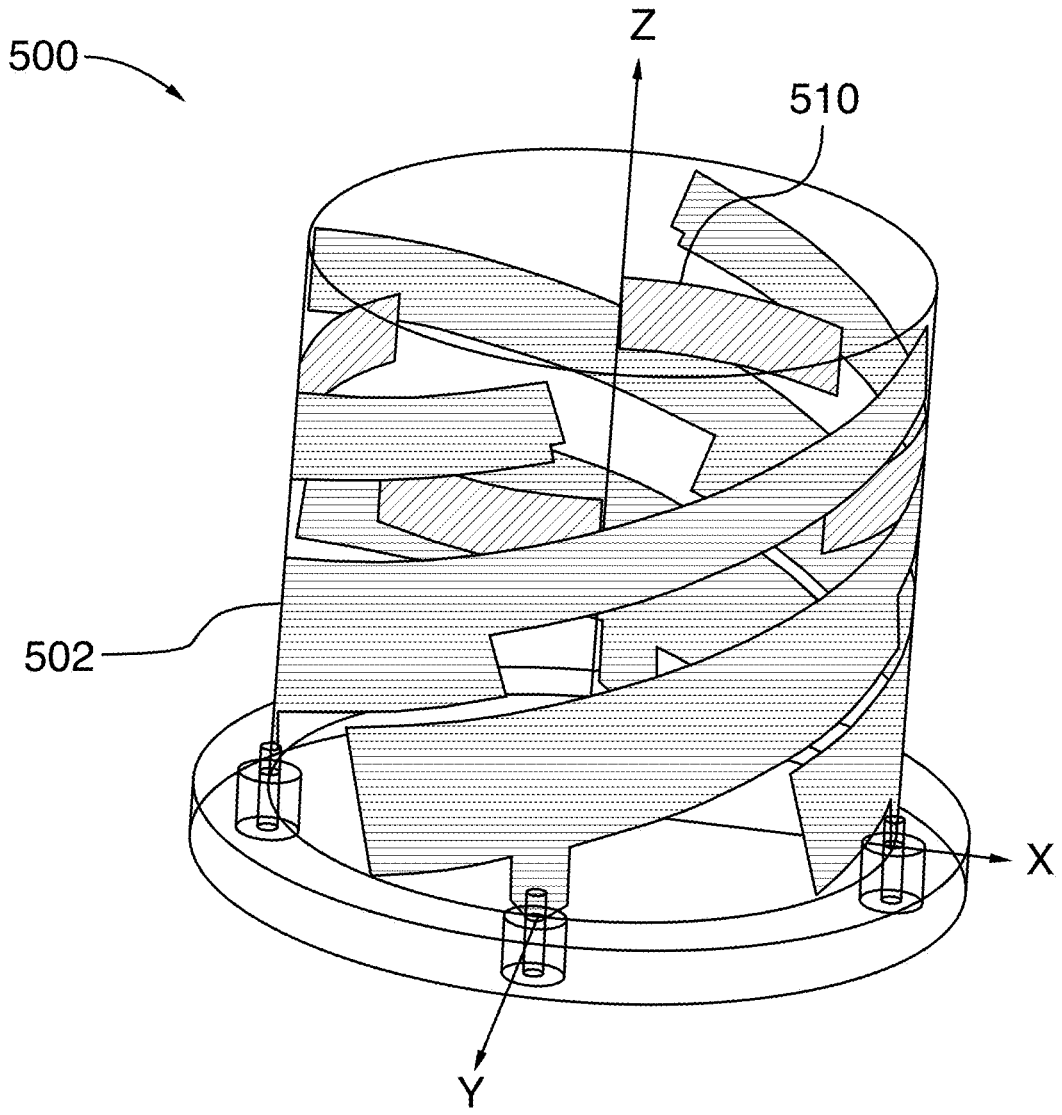
FIG. 5A is a schematic diagram of another example QHA with conductive patches, tuned for a frequency band of 2.3 GHz to 2.7 GHz.

FIG. 5A illustrates an example QHA 500 having four conductive patches 510. This example QHA 500 was tuned for a frequency band of 2.3 GHz to 2.7 GHz. Generally, the dimensions of a QHA may be calculated using the following equations:

$$H=Lax+Lfd+0.5*(Wb+2)*\cos(a)$$

$$Lax=\sqrt{[Le^2-(2\pi NR)^2}$$

$$\alpha=\alpha\ \sin(Lax/Le)$$

$$\text{Trace length}=Lt+Lfd+Le$$

where H is the overall height of a QHA, Le is the length that undergoes N turns around the cylinder, Lfd is the launch height of each conductive helical trace, Lt is the tail length, Wb is the width of each conductive helical trace, and R is the radius of the cylinder. It should be noted that the total length of each helical trace 502 is the sum of Le+Lfd+Lt, but N counts the number of turns of the length Le (i.e., Lfd and Lt are not included in the calculation of N).

At an operating frequency of 2.5 GHz, the example QHA 500 has a height of 39 mm=0.325λ and a diameter of 42 mm=0.350λ. In this example, each conductive patch 510 has a length of 16.5 mm=0.138λ, width of 7 mm=0.058λ, and are each positioned at a height of 26 mm=0.217λ (as measured from the bottom of the QHA 500 to the lower edge of the patch 510). Each conductive helical trace 502 has a total length of 85 mm, which is the sum of Le=70 mm=0.583λ, the launch height of 10 mm and tail length of 5 mm. Each conductive helical trace 502 has a width of 9 mm. Each conductive helical trace 502 has 0.5 turns, starting after the tail and launch height of the QHA 500, and at a pitch angle of 19.5°.

For the QHA 500 of FIG. 5A, the S-parameters in the frequency band 2.3 GHz-2.7 GHz were found to be as follows:

| S11 (Return loss) | S12 (Adjacent ports coupling) | S13 (Opposite ports coupling) |
|---|---|---|
| <−20 dB | <−7 dB | <−13 dB |

Figure 5B:
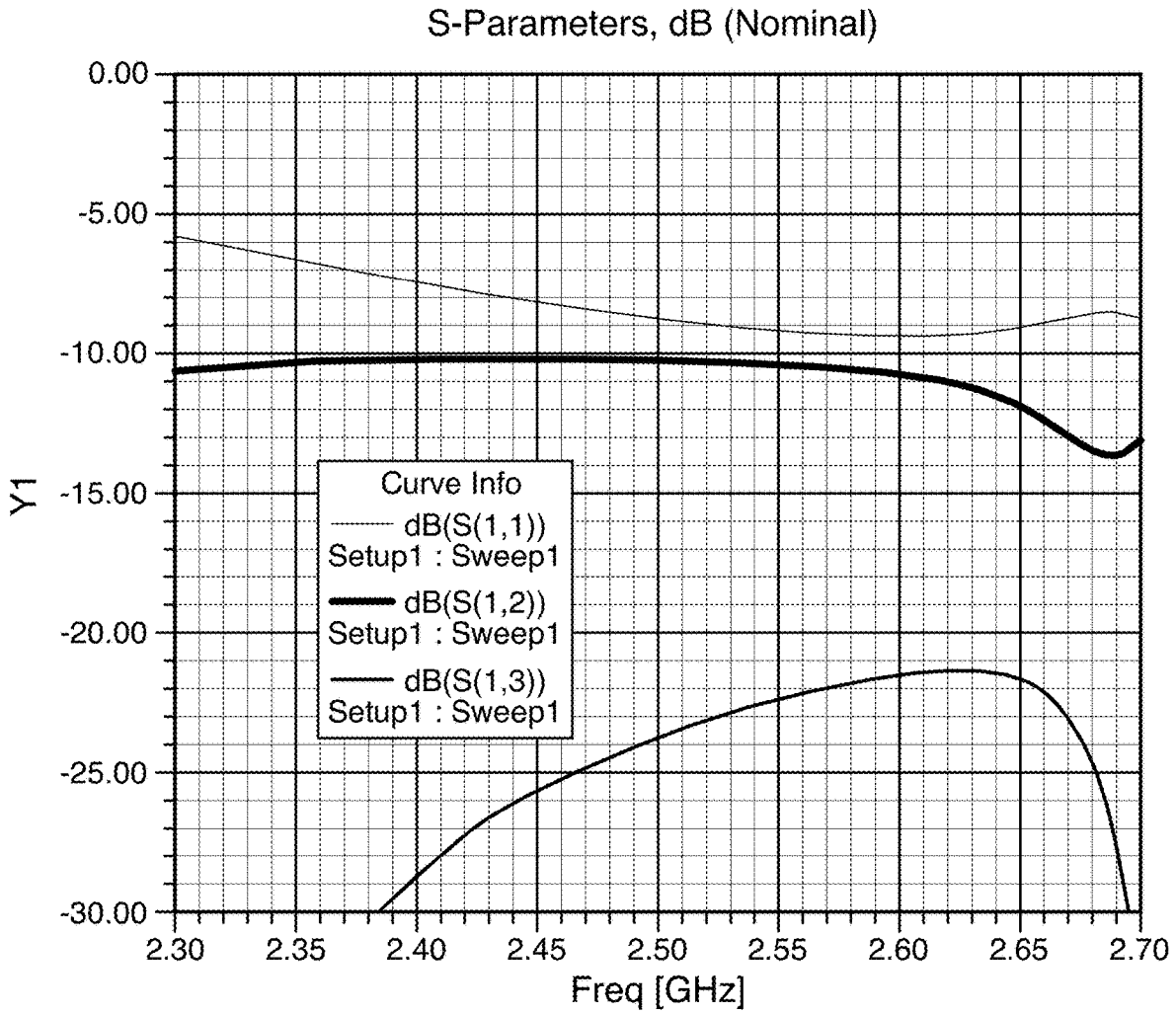
FIGS. 5B-5E are plots showing the radiation pattern and S-parameters of the QHA of FIG. 5A, and a comparative prior art QHA.
Figure 5C:
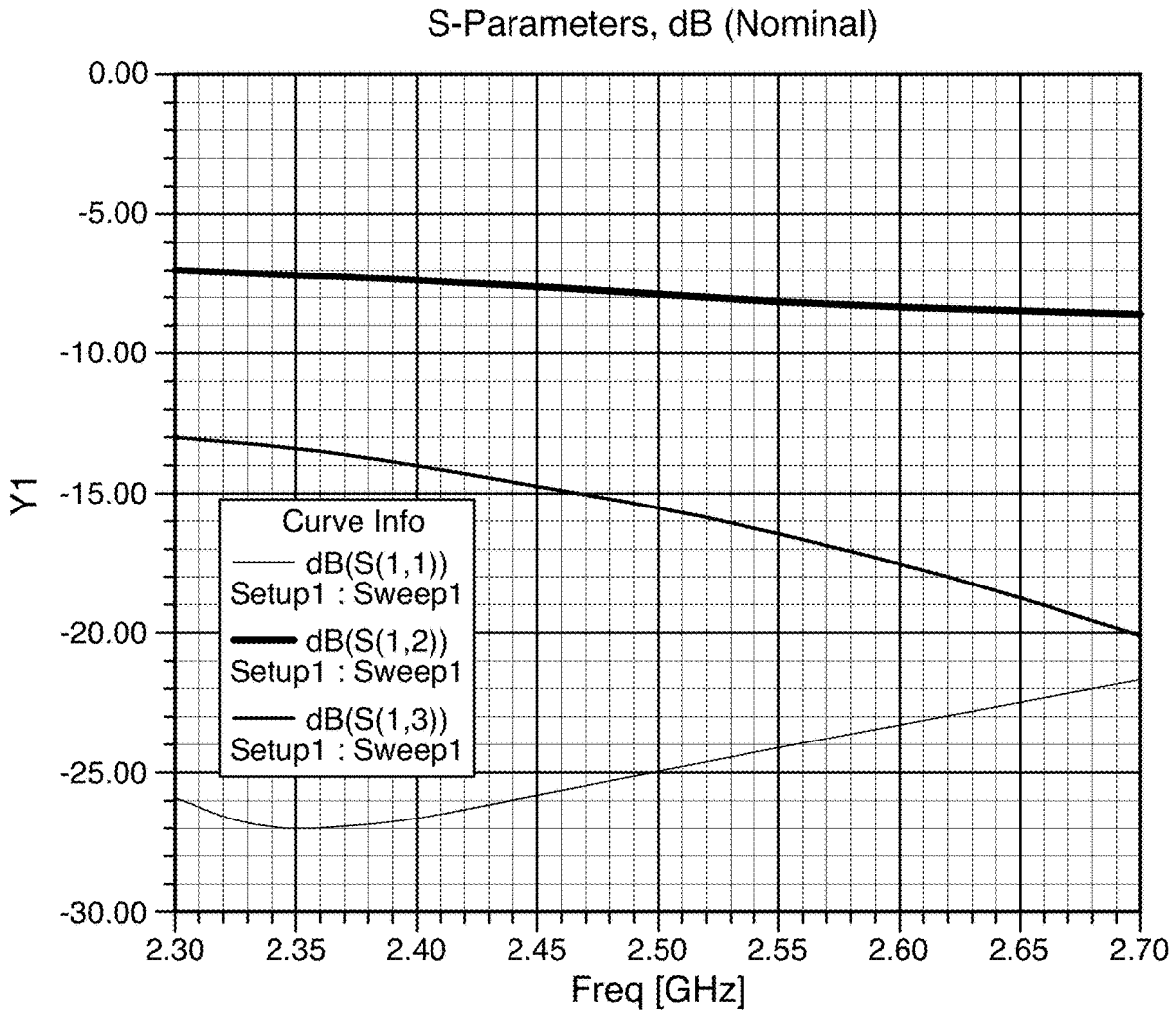

The simulations for the example QHA 500 may be compared to simulations performed for a prior art QHA (not shown) having identical dimensions and configurations, but without conductive patches. FIGS. 5B and 5C show the S-parameters of the prior art QHA and the example QHA 500, respectively. It can be seen that the inclusion of conductive patches 510 results in improved impedance match for the QHA 500.

Figure 5D:
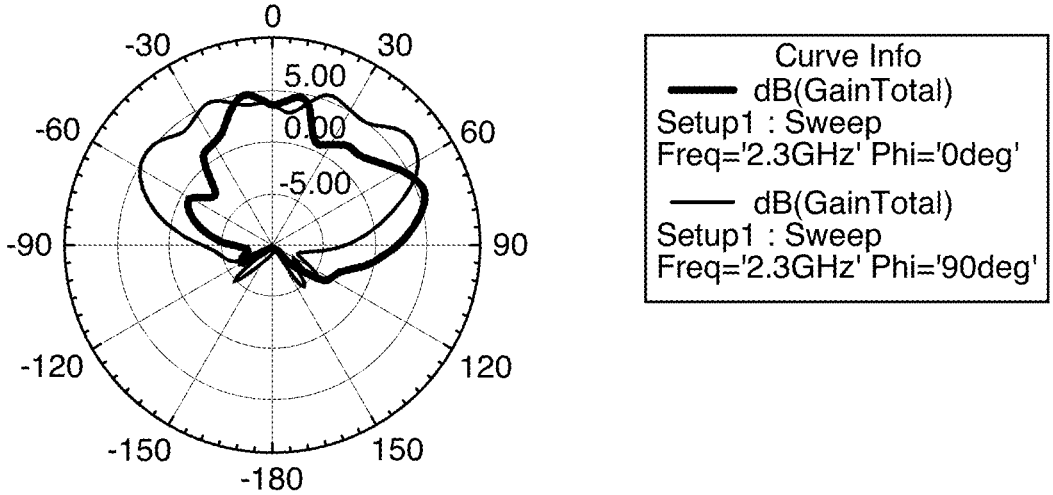
Figure 5D:
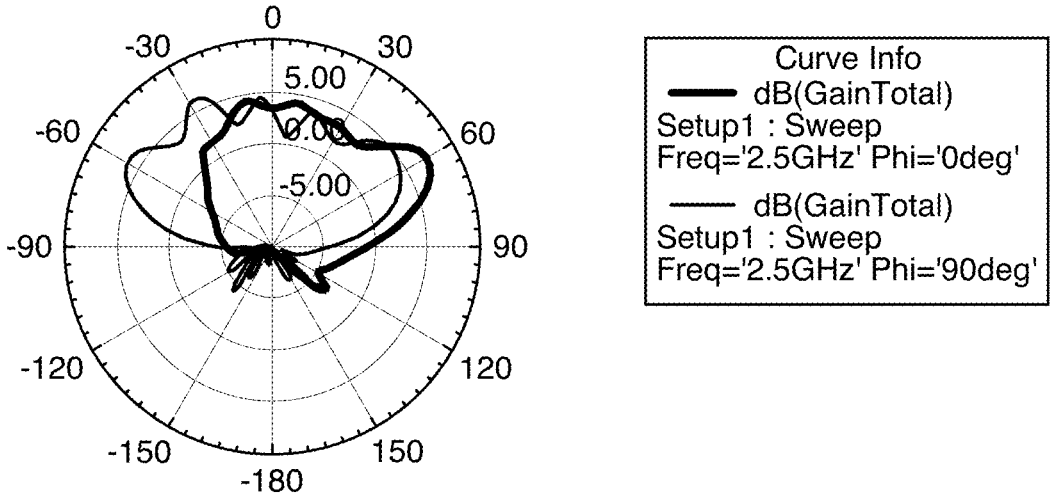
Figure 5D:
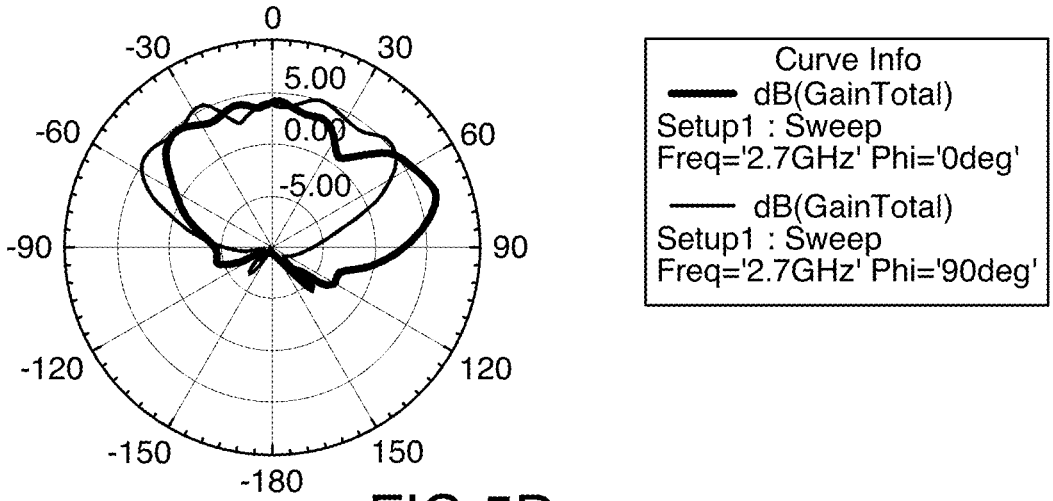
Figure 5E:
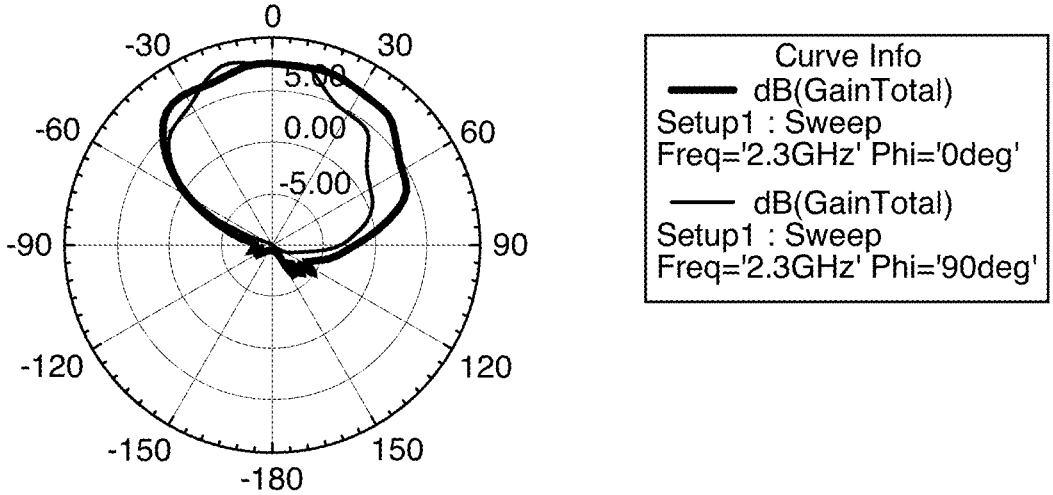
Figure 5E:
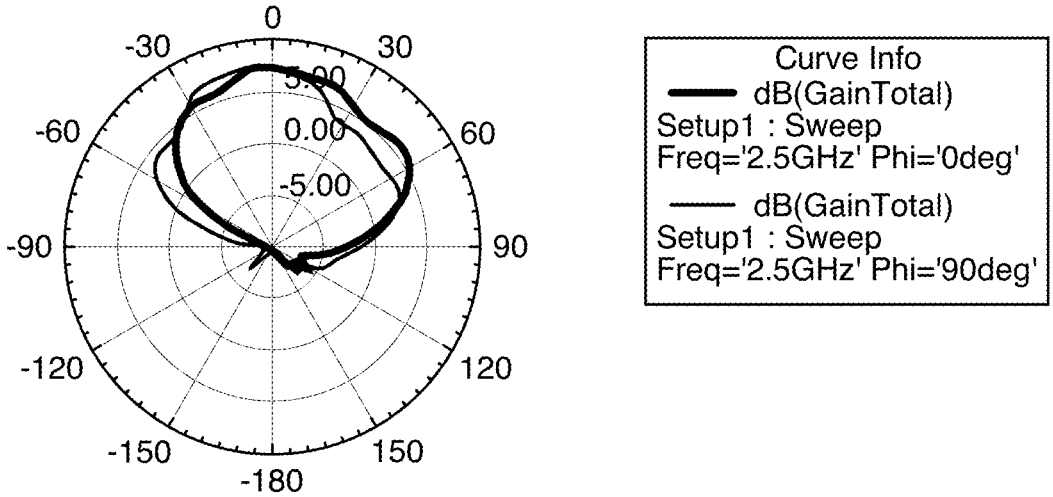
Figure 5E:
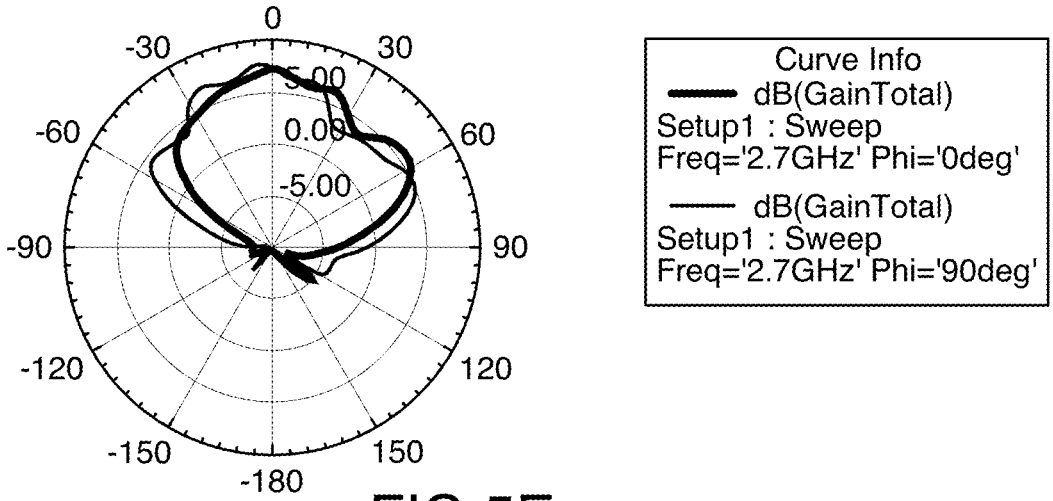

The radiation patterns of the antenna element (with port 1 on) of the comparative prior art QHA at operating frequencies of 2.3 GHz, 2.5 GHz and 2.7 GHz are shown in FIG. 5D. For comparison, the corresponding radiation patterns (with port 1 on) of the example QHA 500 at the same operating frequencies are shown in FIG. 5E. It can be seen that the inclusion of conductive patches 510 results in improved radiation patterns for the QHA 500.

Figure 6A:
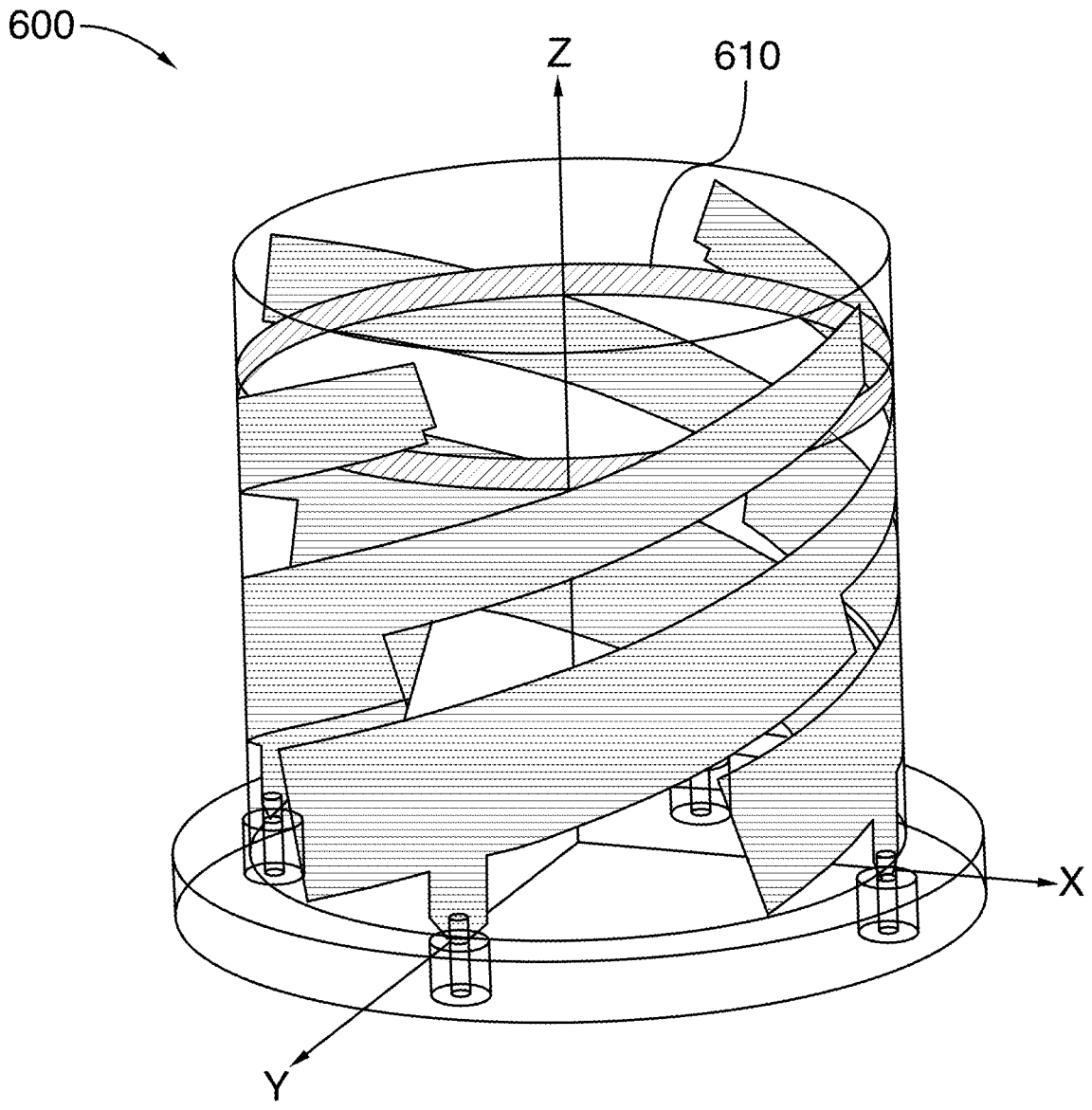
FIG. 6A is a schematic diagram of another example QHA with a conductive ring, tuned for a frequency band of 2.3 GHz to 2.7 GHz.

FIG. 6A illustrates an example QHA 600 having a conductive ring 610. This example QHA 600 was tuned for a frequency band of 2.3 GHz to 2.7 GHz. At an operating frequency of 2.5 GHz, the example QHA 500 has a height of 39 mm=0.325λ and a diameter of 42 mm=0.350λ. The conductive ring 610 in this example has a width of 2 mm=0.017λ, and is positioned at a height of 30 mm=0.25λ (as measured from the bottom of the QHA 600 to the lower edge of the ring 610). The dimensions of the example QHA 600 are identical to those of the example QHA 500 of FIG. 5A, with the difference that a conductive ring 610 is used in place of conductive patches 510.

The simulations for the example QHA 600 may be compared to simulations performed for a prior art QHA (same as the comparative prior art QHA discussed above with respect to example QHA 500) having identical dimensions and configurations, but without a conductive ring. The S-parameters in the frequency band 2.3 GHz-2.7 GHz were found to be as follows:

| QHA | S11 (Return loss) | S12 (Adjacent ports coupling) | S13 (Opposite ports coupling) |
|---|---|---|---|
| With conductive ring | <−20 dB | <−7 dB | <−15 dB |
| Without conductive ring | <−6 dB | <−10 dB | <−20 dB |

Figure 6B:
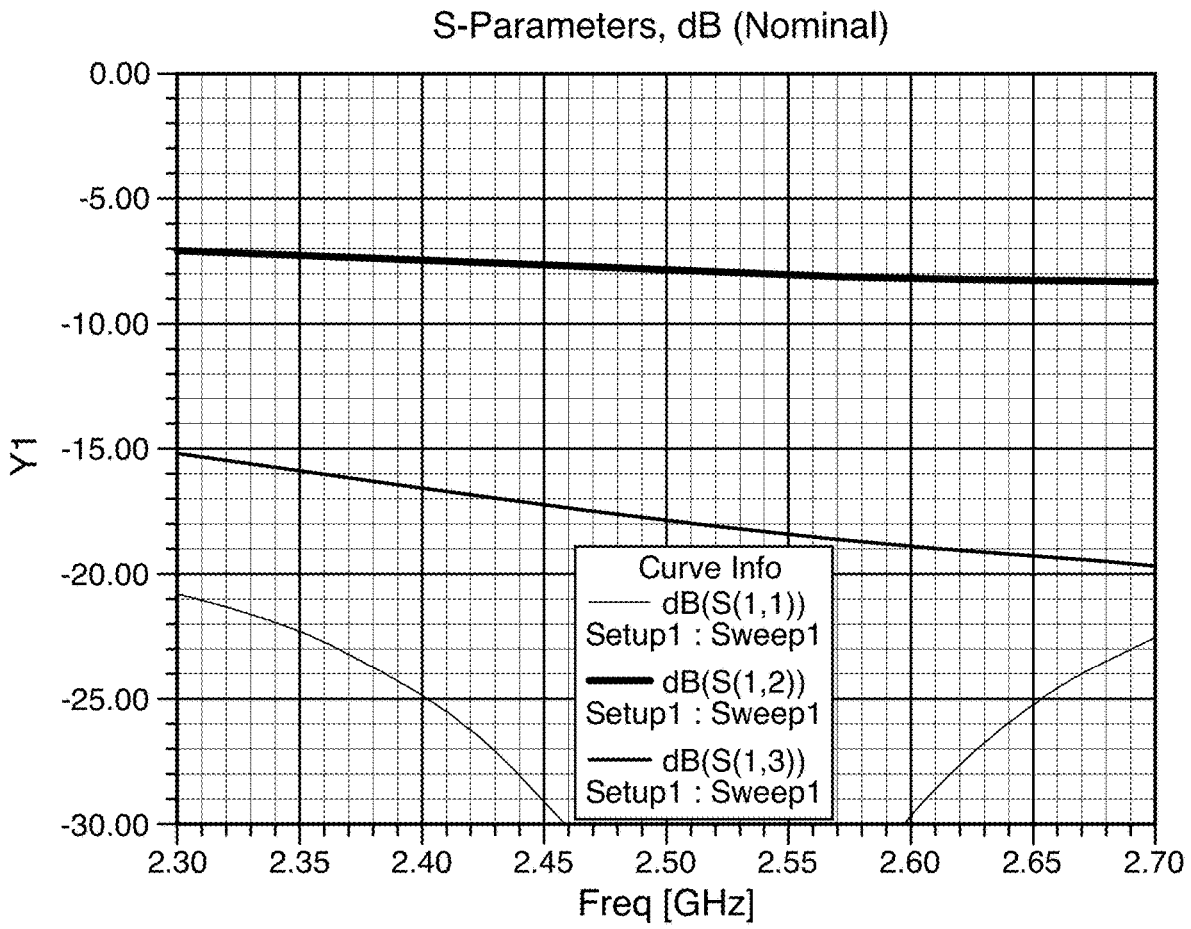
FIGS. 6B-6C are plots showing the radiation pattern and S-parameters of the QHA of FIG. 6A.
Figure 6C:
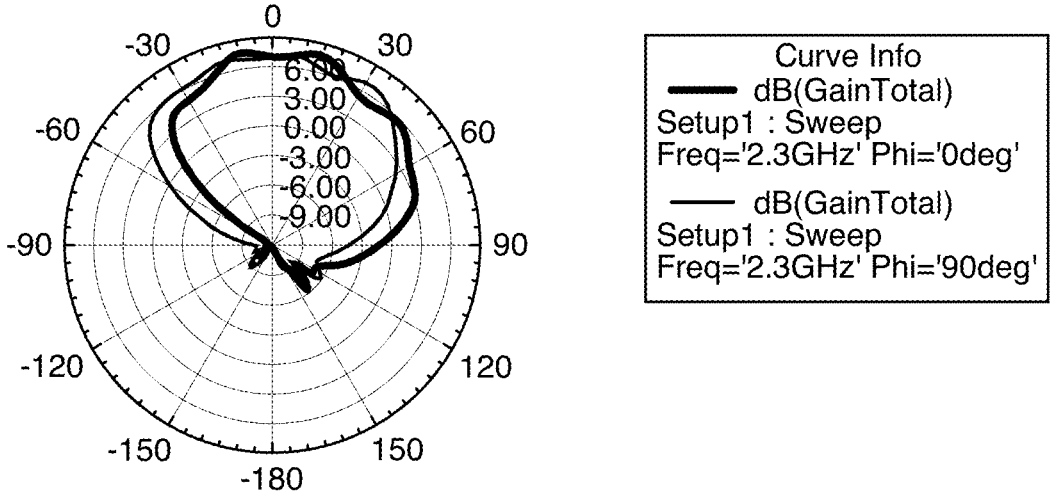
Figure 6C:
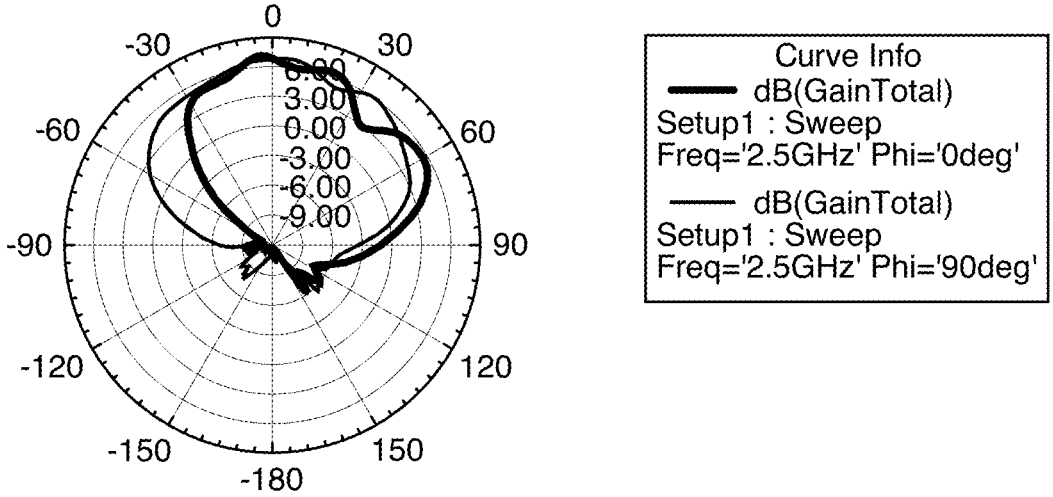
Figure 6C:
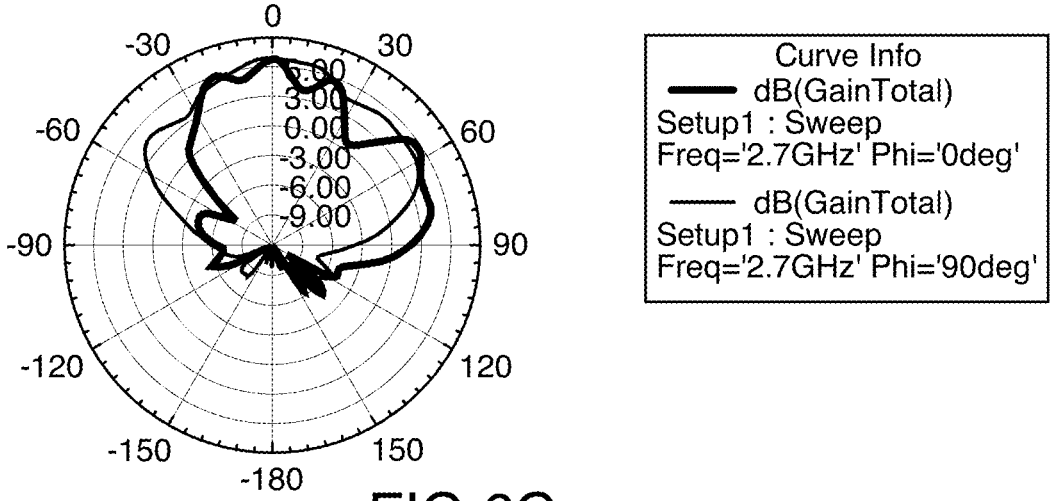

FIG. 6B is a plot showing simulated S-parameters for the example QHA 600. This may be compared to FIG. 5D showing the plot of S-parameters for the prior art QHA. FIG. 6C shows radiation patterns of the example QHA 600 at operating frequencies of 2.3 GHz, 2.5 GHz and 2.7 GHz. For comparison, the radiation patterns of the comparative prior art QHA are shown in FIG. 5D. As illustrated by these simulation results, the example QHA 600 shows improved return loss and radiation pattern characteristics, compared to the prior art QHA.

Figure 7A:
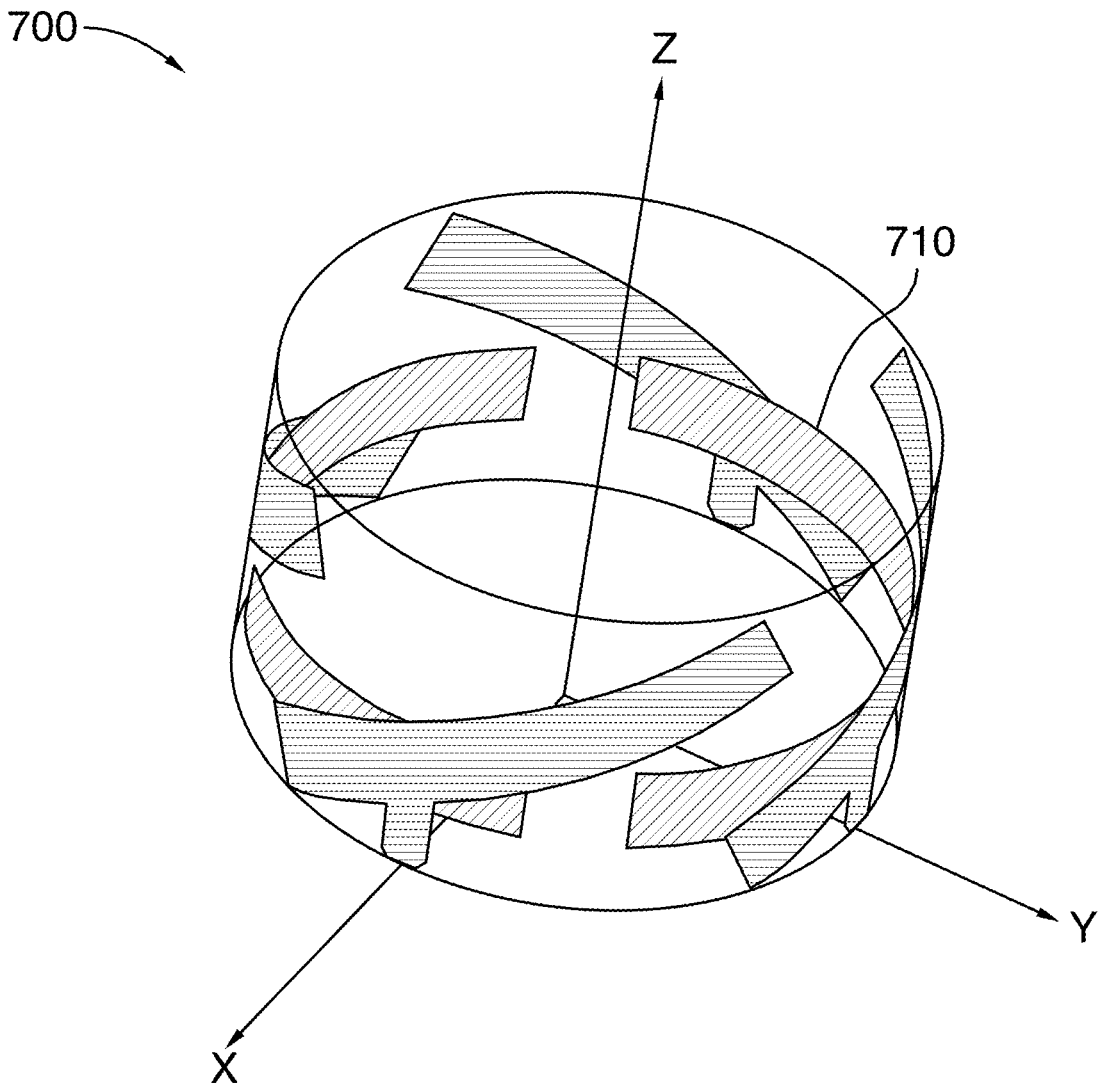
FIG. 7A is a schematic diagram of another example QHA with conductive patches, tuned for a frequency band of 2.3 GHz to 2.7 GHz.

FIG. 7A illustrates an example QHA 700 having four conductive patches 710. This example QHA 700 was tuned for a frequency band of 2.3 GHz to 2.7 GHz. At an operating frequency of 2.5 GHz, the example QHA 700 has a height of 28 mm=0.233λ and a diameter of 50 mm=0.417λ. The conductive patches 710 in this example each has a length of 31.4 mm=0.262λ and width of 7 mm=0.058λ. Each conductive patch 710 is positioned at a height of 6 mm=0.05λ (as measured from the bottom of the QHA 700 to the lower edge of each patch 710). Each conductive helical trace 702 has a total length of 45 mm, which is the sum of Le=30 mm=0.250λ, a launch height of 10 mm and tail length of 5 mm. Each conductive helical trace 702 has a width of 7 mm. Each conductive helical trace 702 has 0.17 turns not including the launch height and tail length. Each conductive helical trace 702 starts from the bottom of the QHA 700 without contacting the reflector, and at a pitch angle of 27°.

Figure 7B:
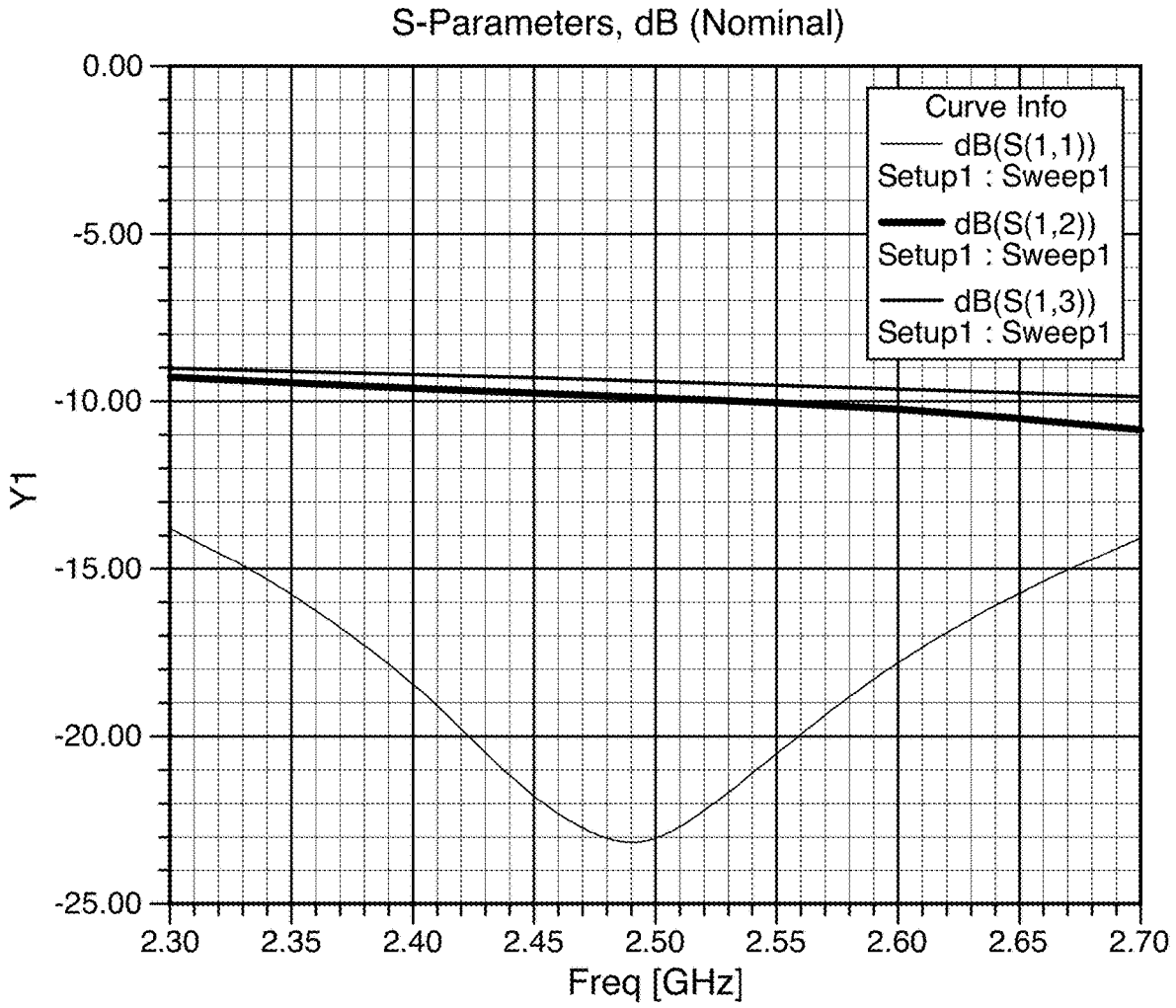

The simulation for this QHA 700 was based on the use of double Pyralux AP layers, where the conductive patches 710 are sandwiched between the dielectric layers. The coupling between adjacent ports was found to be less than −9 dB in the frequency band 2.3 GHz-2.7 GHz. FIG. 7B is a plot showing simulated S-parameters for the example QHA 700. FIG. 7C shows radiation patterns of the example QHA 700 at operating frequency of 2.5 GHz, with different excitations.

Figure 8A:
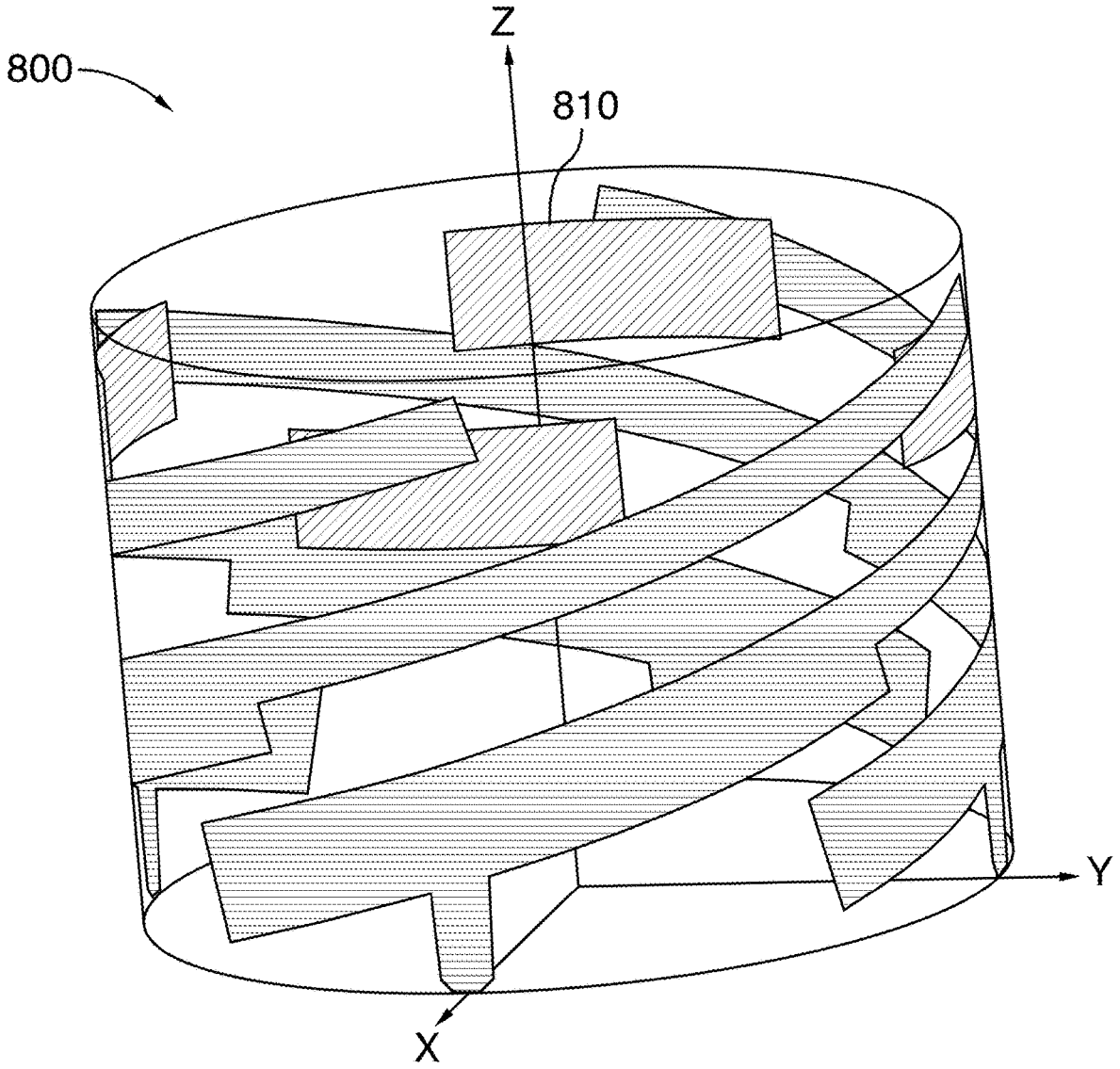
FIG. 8A is a schematic diagram of another example QHA with conductive patches, tuned for a frequency band of 1.9 GHz to 2.3 GHz.

FIG. 8A illustrates an example QHA 800 having conductive patches 810. This example QHA 800 was tuned for a frequency band of 1.9 GHz to 2.3 GHz. At an operating frequency of 2.1 GHz, the example QHA 800 has a height of 36 mm=0.252λ and a diameter of 50 mm=0.350λ. The conductive patches 810 in this example each has a length of 19.64 mm=0.137λ and width of 7 mm=0.049λ. Each conductive patch 810 is positioned at a height of 26 mm=0.182λ (as measured from the bottom of the QHA 800 to the lower edge of each patch 810). Each conductive helical trace 802 has a total length of 102.9 mm, which is the sum of Le=84.9 mm=0.5943λ, a launch height of 10 mm and tail length of 8 mm. Each conductive helical trace 802 has a width of 7 mm. Each conductive helical trace 802 has 0.5225 turns not including the launch height and tail length. The conductive helical trace 802 starts from the bottom of the QHA 800 without contacting the reflector, and at a pitch angle of 14.8°.

At this frequency band, the S-parameters for the example QHA 800 were found to be as follows:

| S11 (Return loss at port 1) | S12 (Adjacent ports coupling) | S13 (Opposite ports coupling) |
|---|---|---|
| <−20 dB | <−7 dB | <−14 dB |

Figure 8B:
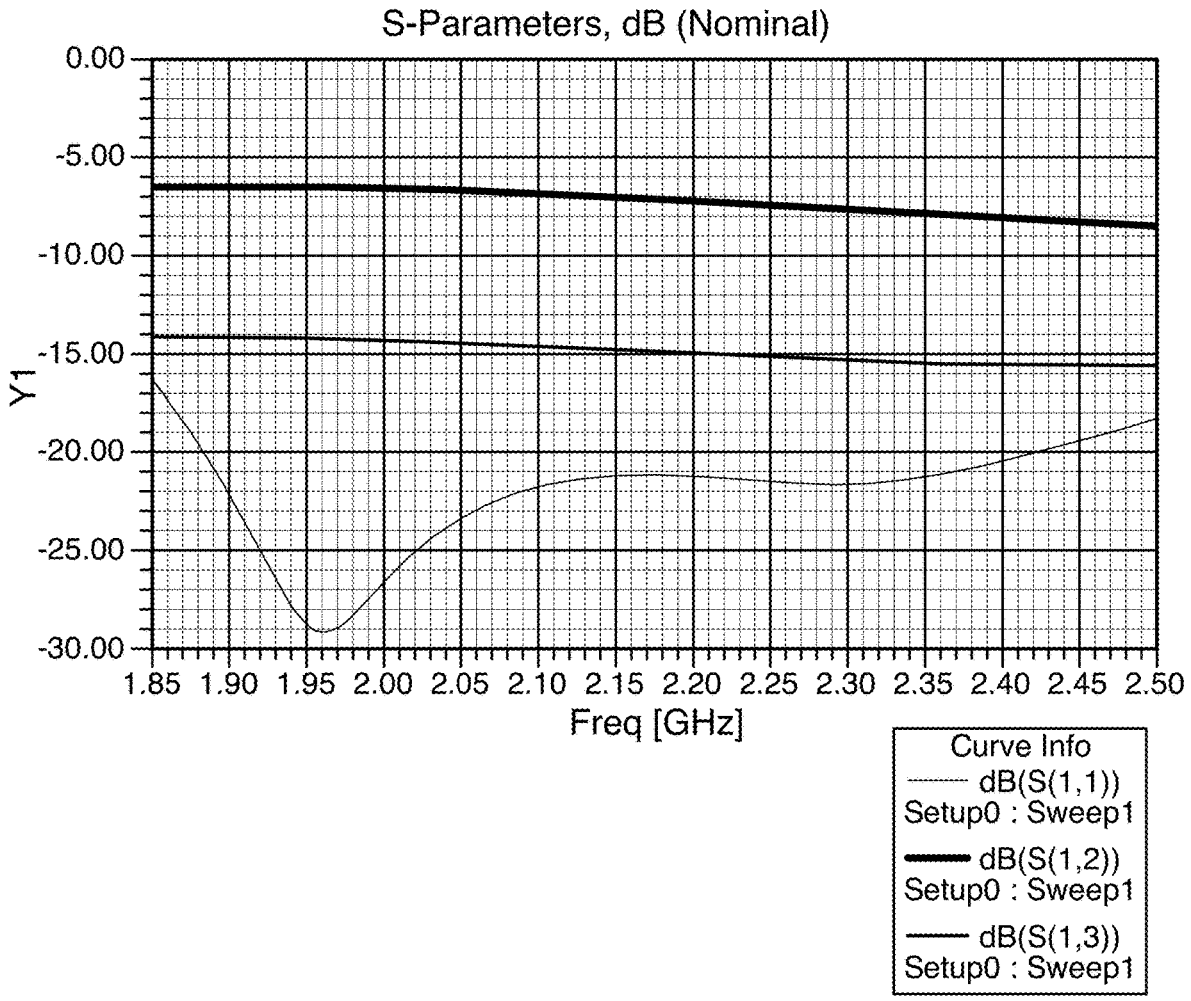
FIGS. 8B-8E are plots showing the radiation pattern and S-parameters of the QHA of FIG. 8A, and a comparative prior art QHA.
Figure 8C:
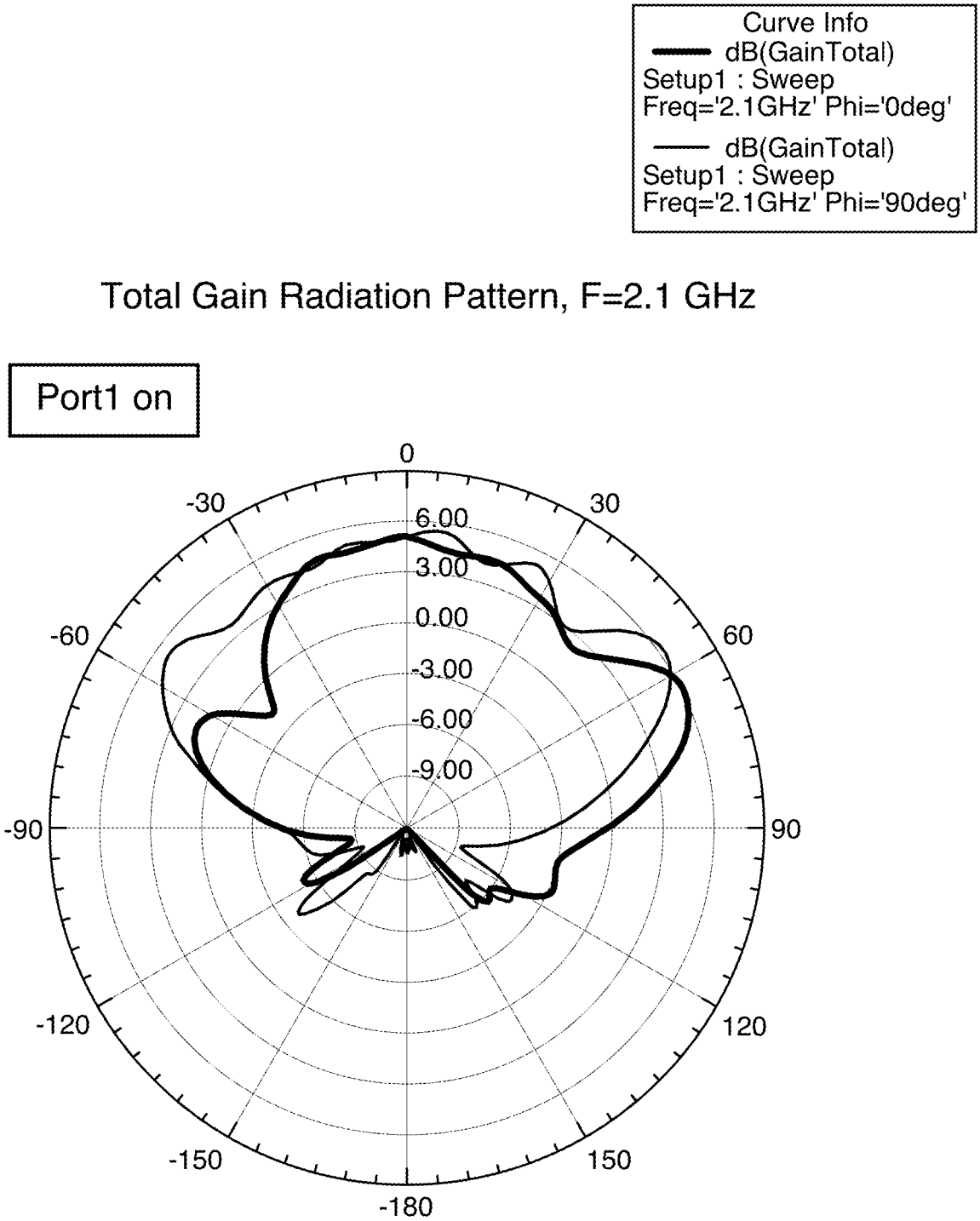
Figure 8D:
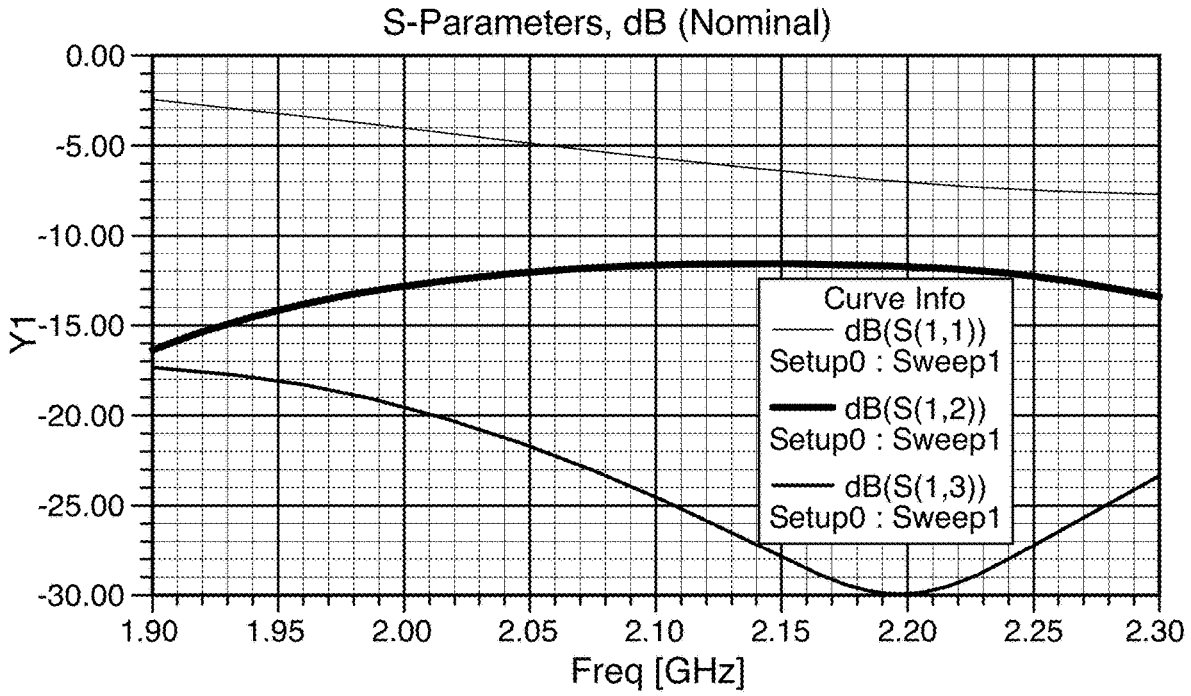
Figure 8E:
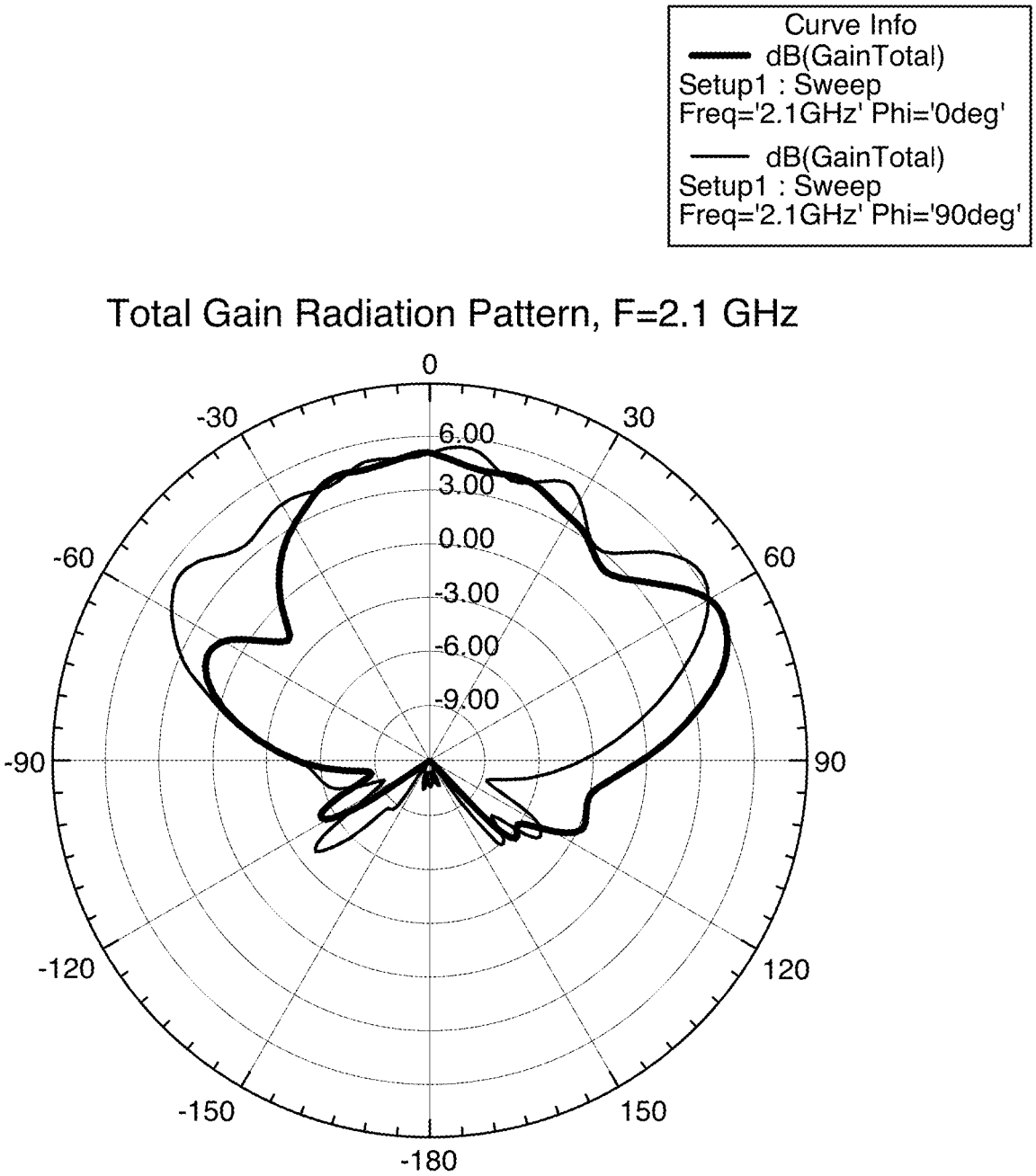

The simulations for the example QHA 800 may be compared to simulations performed for a prior art QHA having identical dimensions and configurations, but without conductive patches. FIG. 8B is a plot showing simulated S-parameters for the example QHA 800. This may be compared to FIG. 8D showing the plot of S-parameters for the comparative prior art QHA. FIG. 8C shows the radiation pattern of the example QHA 800 at operating frequency of 2.1 GHz, when port 1 is excited. For comparison, the radiation pattern of the comparative prior art QHA is shown in FIG. 8E. As illustrated by these simulation results, the example QHA 800 shows improved S-parameters and radiation pattern characteristics, compared to the prior art QHA.

Figure 9A:
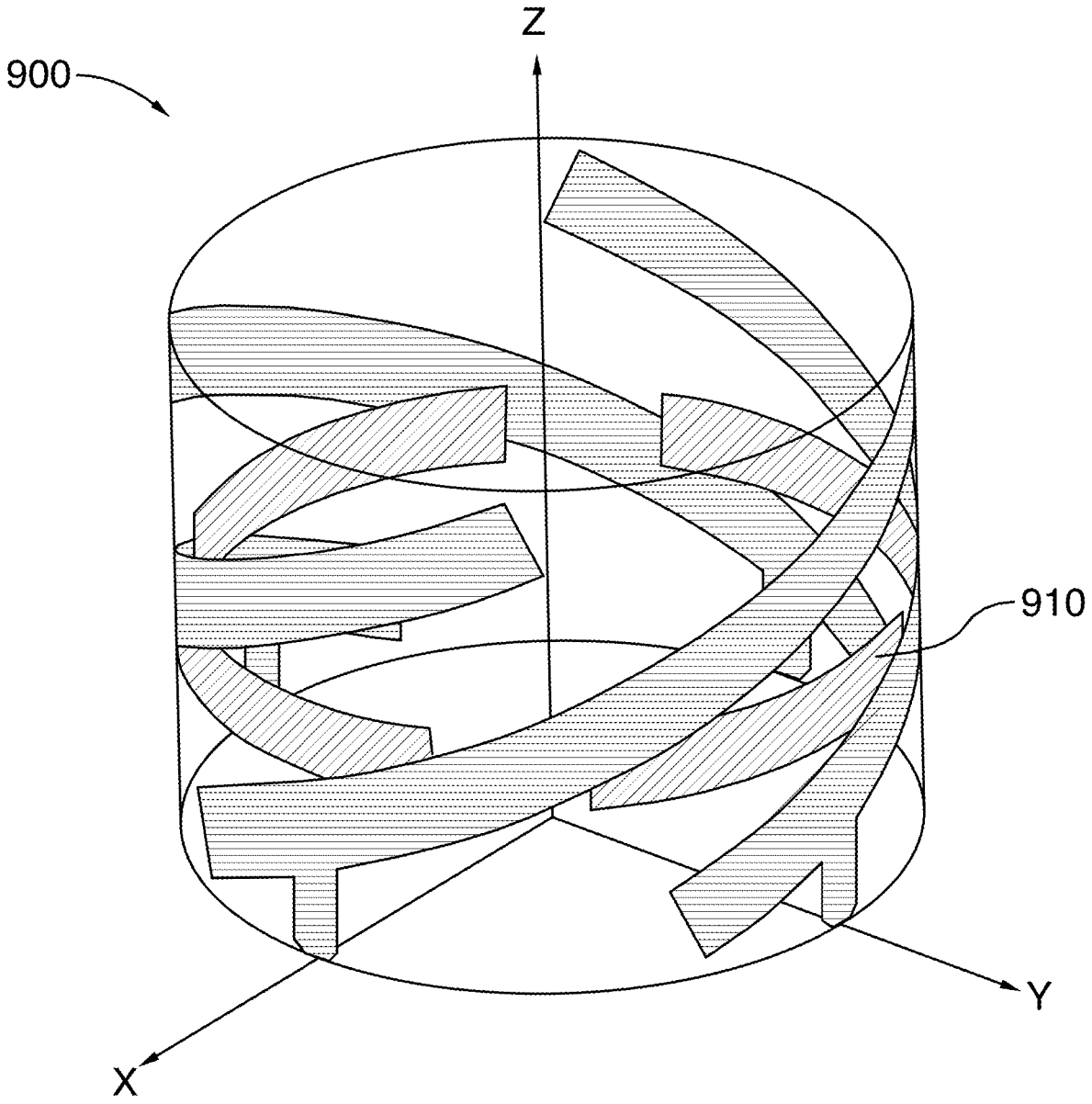
FIG. 9A is a schematic diagram of another example QHA with conductive patches, tuned for a frequency band of 3.4 GHz to 3.6 GHz.

FIG. 9A illustrates an example QHA 900 having conductive patches 910. This example QHA 900 was tuned for a frequency band of 3.4 GHz to 3.6 GHz. At an operating frequency of 3.5 GHz, the example QHA 900 has a height of 38.4 mm=0.448λ and a diameter of 50 mm=0.583λ. Each conductive patch 910 in this example has a length of 28.6 mm=0.334λ and width of 5.5 mm=0.064λ. Each conductive patch 910 is located at a height of 14 mm=0.163λ (as measured from the bottom of the QHA 900 to the lower edge of each patch 910). Each conductive helical trace 902 has a total length of 74.7 mm, which is the sum of Le=60.7 mm=0.4249λ, launch height of 10 mm and tail length of 4 mm. Each conductive helical trace 902 has a width of 6.15 mm. Each conductive helical trace 902 has 0.3529 turns not including the launch height and tail length. The conductive helical trace 902 starts from the bottom of the QHA 900 without contacting the reflector, and at a pitch angle of 24°.

At this operating frequency, the spacing of opposite conductive helical traces is 0.583λ, achieving isolation of less than −15 dB; and the spacing of adjacent conductive helical traces is 0.412λ, achieving isolation of less than −10 dB.

Figure 9B:
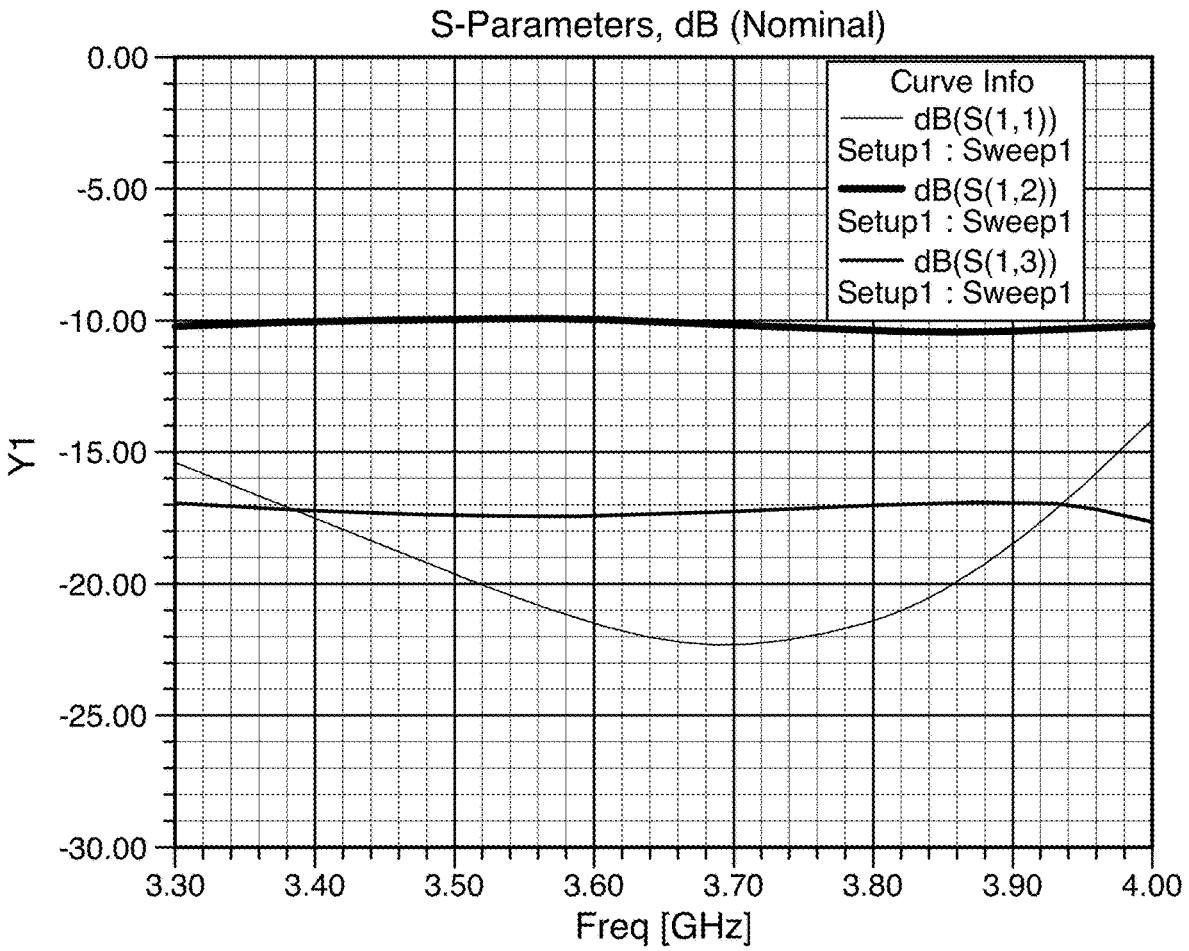
FIGS. 9B-9C are plots showing the radiation pattern and S-parameters of the QHA of FIG. 9A.
Figure 9C:
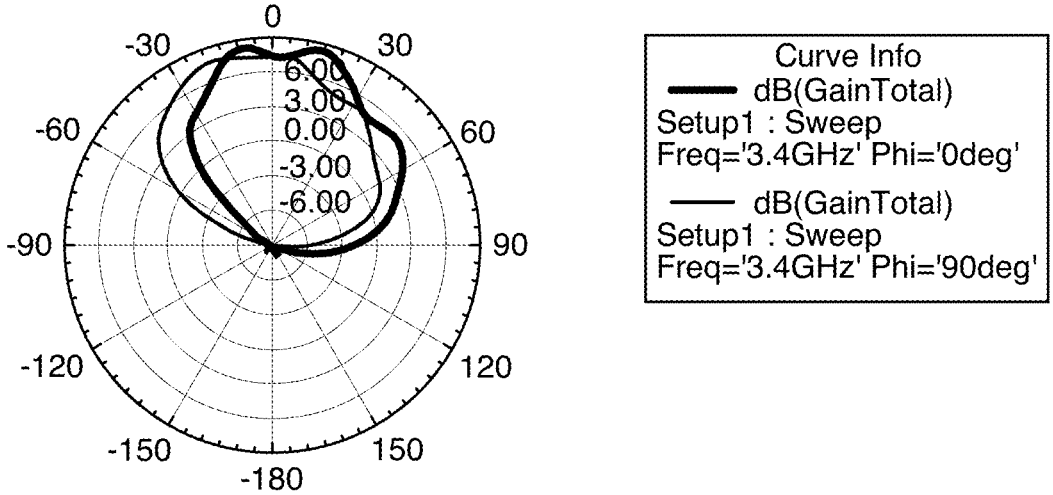
Figure 9C:
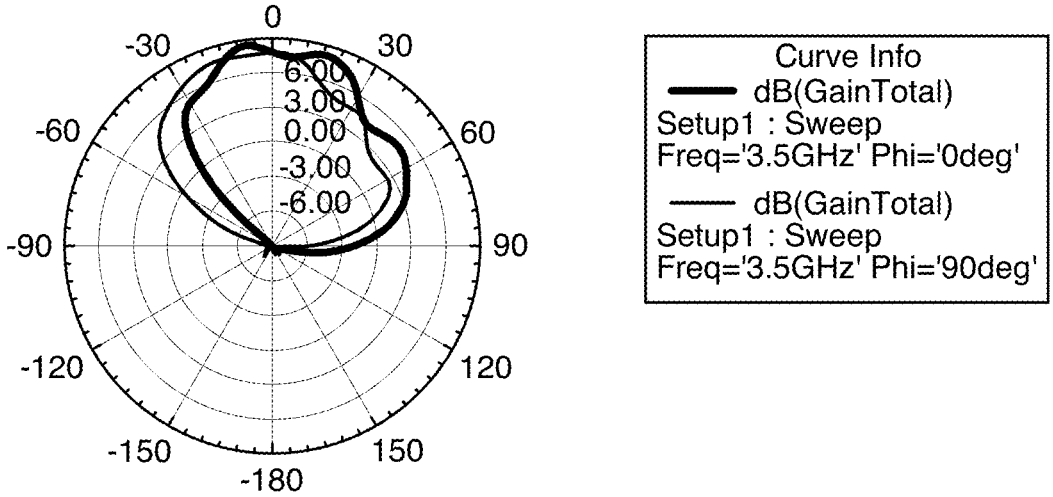
Figure 9C:
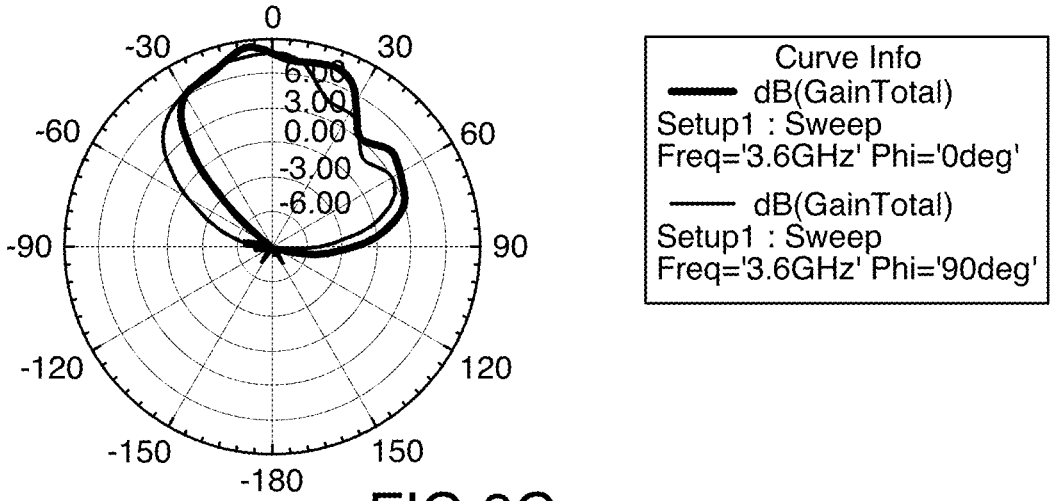

FIG. 9B is a plot showing simulated S-parameters for the example QHA 900. FIG. 9C shows the radiation patterns of the example QHA 800 at operating frequencies of 3.4 GHz, 3.5 GHz and 3.6 GHz when port 1 is excited.

The example QHAs disclosed herein may be used as an individual antenna, or may be used in an antenna array. Because the example disclosed QHAs enable improved radiation patterns and S-parameters, it may be possible to use such four-port QHAs in a closely-spaced antenna array and still achieve acceptably low interference between antennae in the array. The QHAs in an antenna array may have identical design, or may include different designs. An antenna array may incorporate examples of the disclosed QHAs in combination with prior art QHAs.

Figure 10A:
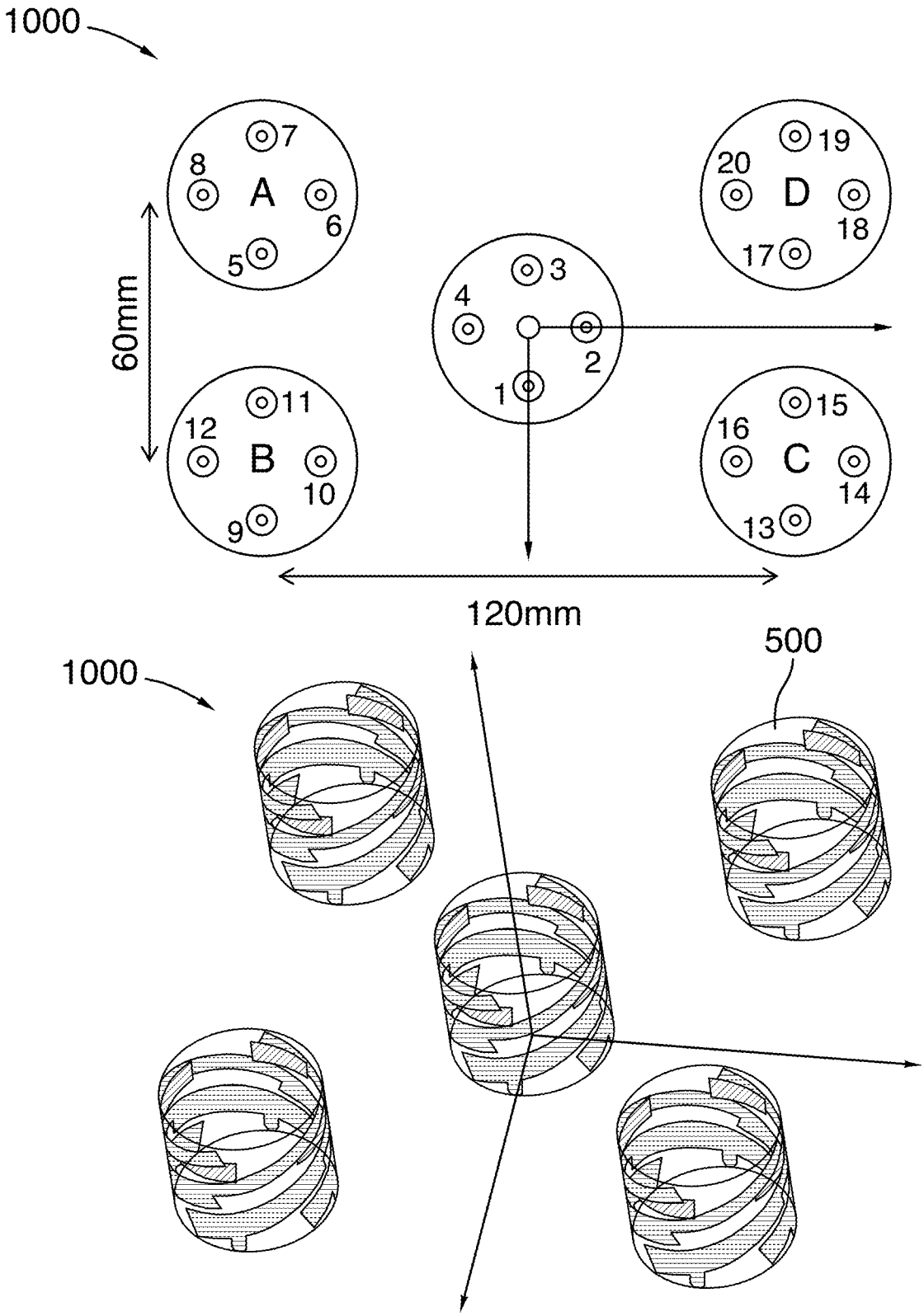
FIG. 10A is a schematic diagram of an antenna array incorporating the QHA of FIG. 5A.
Figure 10B:
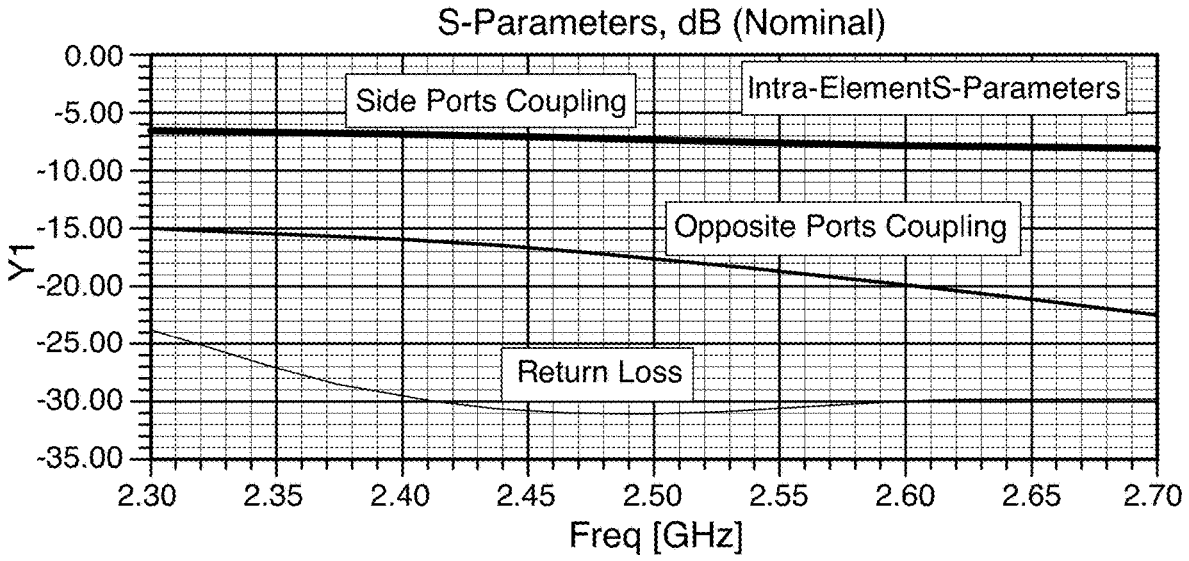
FIGS. 10B-10C are plots showing the radiation pattern and S-parameters of the antenna element with port 1 on, in the array of FIG. 10A.
Figure 10C:
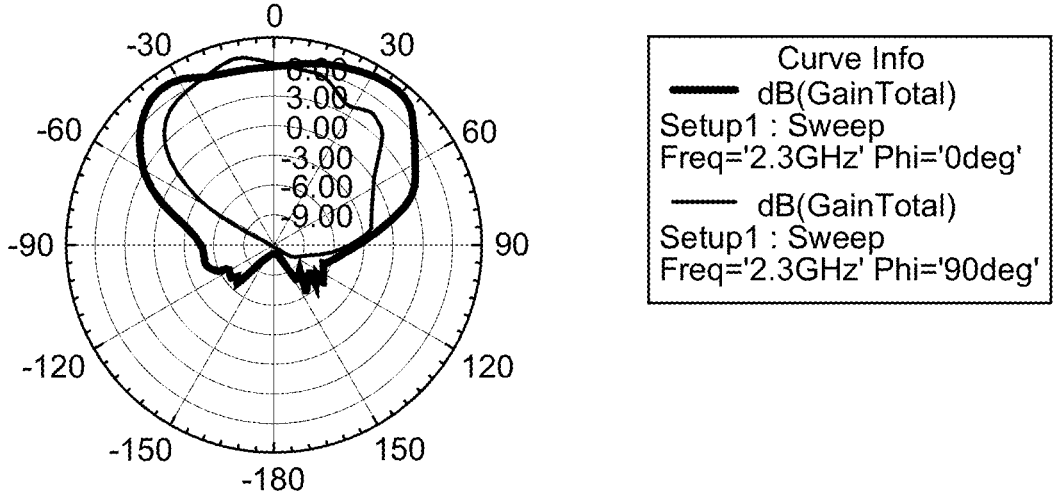
Figure 10C:
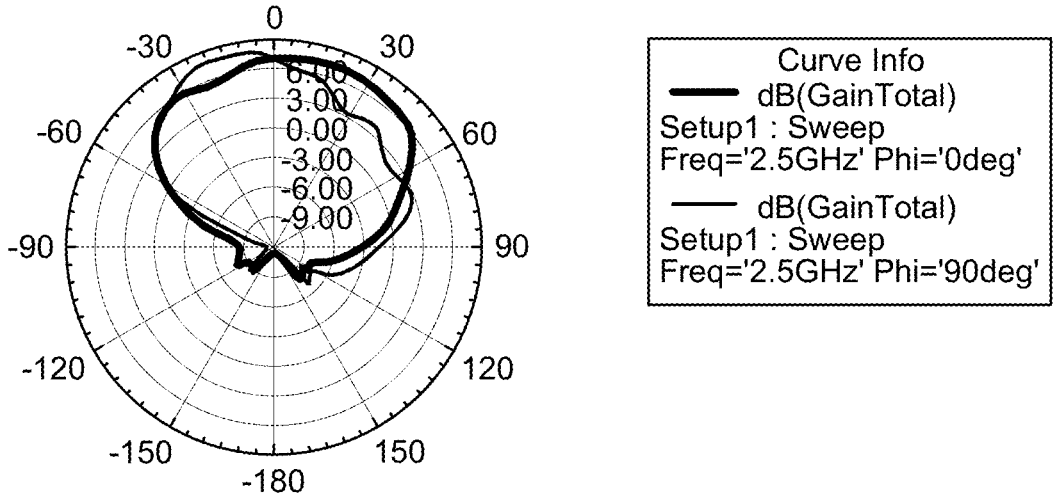
Figure 10C:
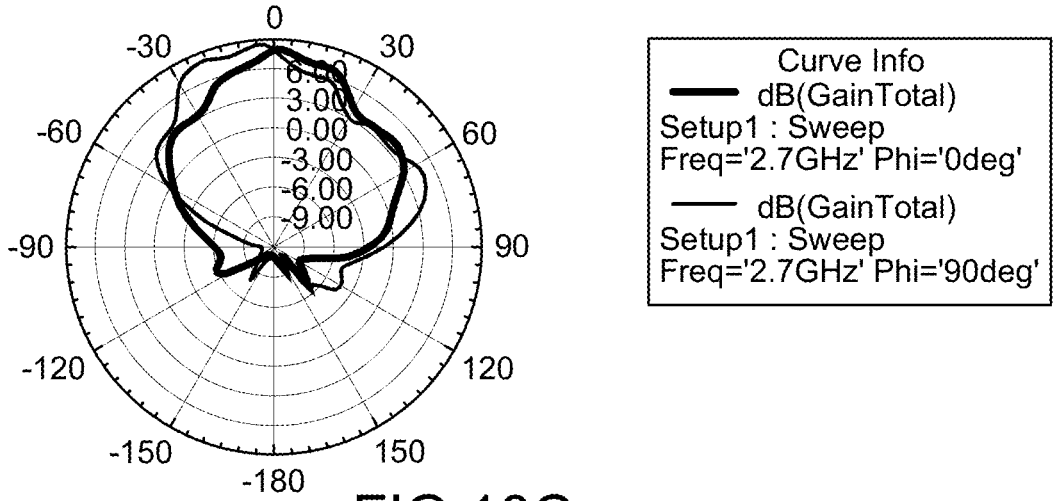

FIG. 10A schematically illustrates an example antenna array 1000 incorporating a plurality of QHAs as disclosed herein. In the example shown, an implementation of a bonded two-layer variation of the single-layer QHA 500 of FIG. 5A is used in the antenna array 1000. Five such QHAs are arranged with four QHAs surrounding a central QHA, as shown in the top plan view. Each QHA is a four-port antenna, providing a total of 20 ports in the antenna array 1000. The example antenna array 1000 may be suitable for a frequency band of 2.3 GHz to 2.7 GHz, including an operating frequency of 2.5 GHz. The array 1000 is a staggered array with 60 mm vertical spacing and 120 mm horizontal spacing. For the operating frequency of 2.5 GHz, 60 mm is equal to 0.5λ. FIG. 10B is a plot showing simulated S-parameters of the QHA in the antenna array 1000. FIG. 10C shows radiation patterns of the QHA in the antenna array 1000 at operating frequencies of 2.3 GHz, 2.5 GHz and 2.7 GHz, when port 1 is excited. Compared to the radiation patterns of an individual QHA, there is only a slight change in the radiation patterns. The change in S-parameters is also barely noticeable. These simulation results demonstrate that the example QHA designs disclosed herein enable four-port QHAs to be used in an antenna array.

Figure 10D:
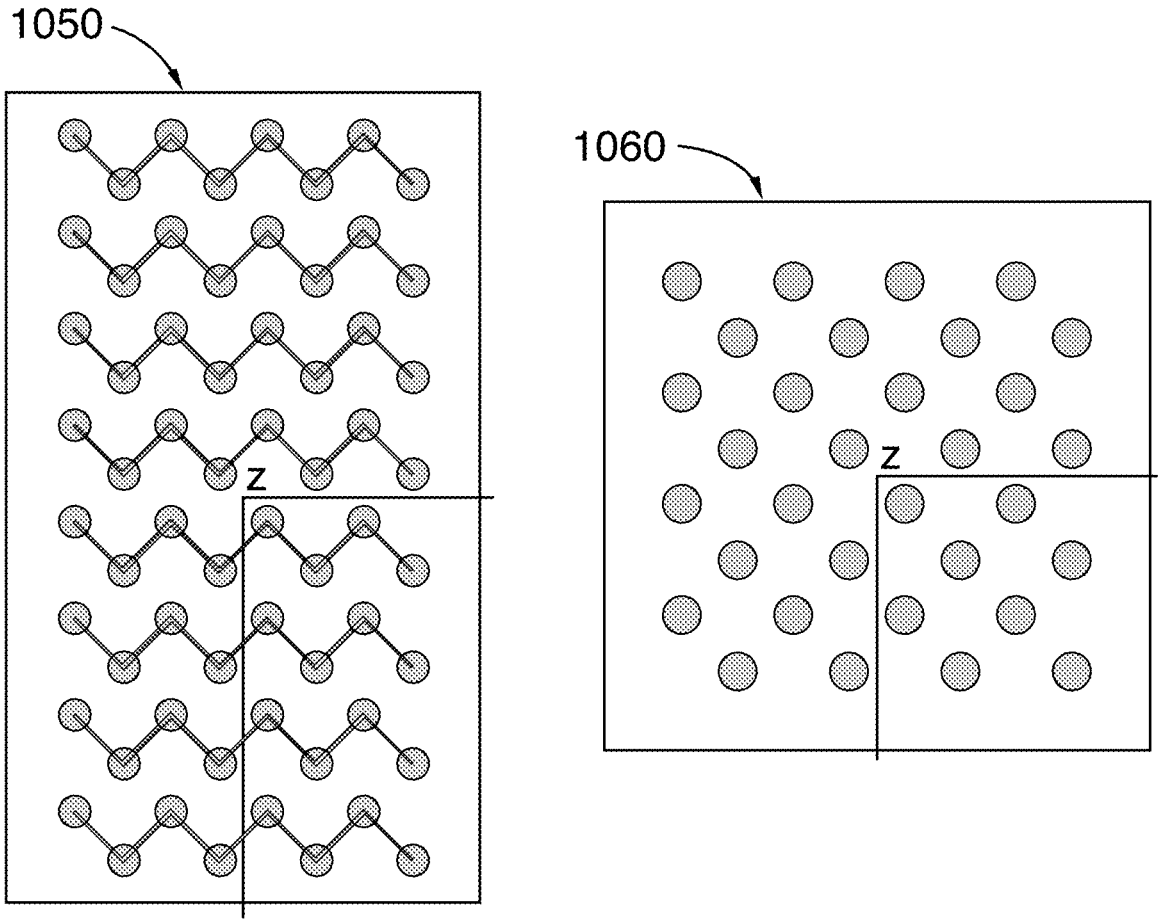
FIG. 10D shows schematic diagrams comparing an antenna array of two-port antennae with an antenna array of four-port antennae.

The use of four-port QHAs, as disclosed herein, in an antenna array may enable a reduction in size of the array, particularly for massive MIMO applications. For example, FIG. 10D illustrates an antenna array 1050 using two-port antennae compared with an antenna array 1060 using four-port antennae, such as example QHAs as disclosed herein. In order to achieve 128 ports, 64 two-port antennae are needed (e.g., arranged in 8 rows×8 columns). In comparison, only 32 four-port QHAs are required to achieve 128 ports in the antenna array 1060. In FIG. 10D, the antennae of each array 1050, 1060 are arranged in a staggered formation, with azimuth spacing at 0.5λ and elevation spacing at 1λ. For an operating frequency of 2.1 GHz, λ=142.8 mm. The array 1050 of two-port antennae requires an area of $21\lambda^2$. In comparison, the array 1060 of four-port QHAs requires an area of $12.25\lambda^2$, achieving an area reduction of about 42%.

Various example QHA configurations, incorporating conductive components, are discussed above. Appropriate tuning (e.g., with the aid of simulations or other antenna design techniques) may be carried out to select appropriate design parameters (e.g., dimensions of conductive helical traces; dimensions, configuration and/or placement of conductive components; and/or overall QHA dimensions) to achieve desired antenna characteristics (e.g., to tune S-parameters and shape radiation patterns). Other possible variations are discussed below. These following variations may be incorporated into some or all of the previously discussed examples, and such variations may be incorporated in combination in order to achieve desired antenna characteristics.

Figure 11:
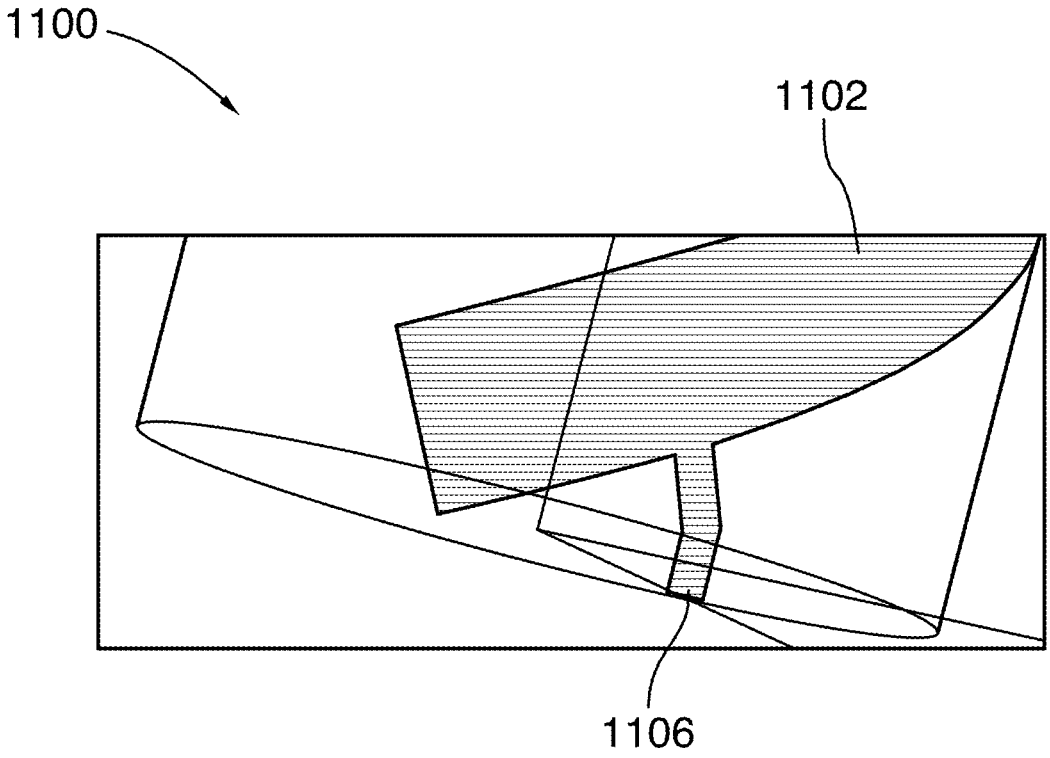
FIG. 11 is a close-up schematic view of an example QHA showing a launch line with a sharp bend.

FIG. 11 is a close-up view of a portion of an example QHA 1100 in which the conductive helical trace 1102 is fed via a launch line 1106 having a sharp bend (that is, having minimal or zero bend radius) that has an angle greater than 90°. The inclusion of a sharp bend in the launch line 1106 may enable the conductive helical trace 1102 to be connected at different connection points along the length of the conductive helical trace 1102, which may provide more design freedom for tuning and impedance matching. The sharp bend in the launch line 1106 was not found to significantly impact the characteristics of the QHA 1100.

Figure 12A:
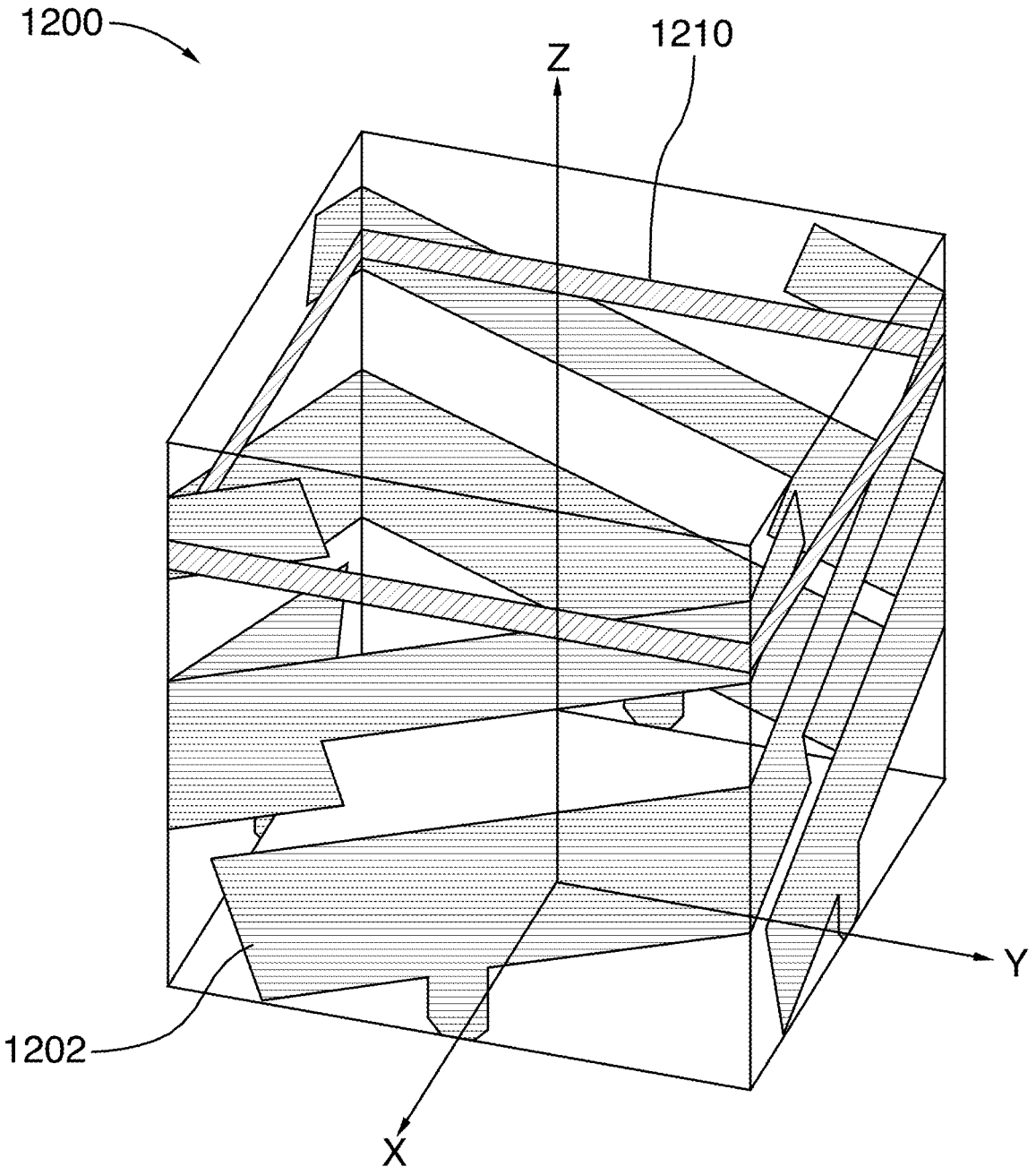
FIG. 12A is a schematic diagram of an example QHA having a non-cylindrical geometry and including a conductive ring.

FIG. 12A illustrates an example QHA 1200 in which the conductive helical traces 1202 are wound about a non-cylindrical geometry, in this case a square-based geometry. The conductive component in this example is a conductive ring 1210, which also has a square geometry. For a frequency band of 2.3 GHz to 2.7 GHz, the QHA 1200 may have a square base of 37.2 mm×37.2 mm, with a height of 39 mm. This QHA 1200 may be based on a cylindrical QHA with a circular base having a diameter of 42 mm. The QHA 1200 may be designed such that the area of the square base is equal to the area of the circular base having a diameter of 42 mm. In this example, the conductive ring 1210 has a width of 2 mm, and is positioned at a height of 30 mm (as measured from the bottom of the QHA 1200 to the lower edge of the ring 1210).

Figure 12B:
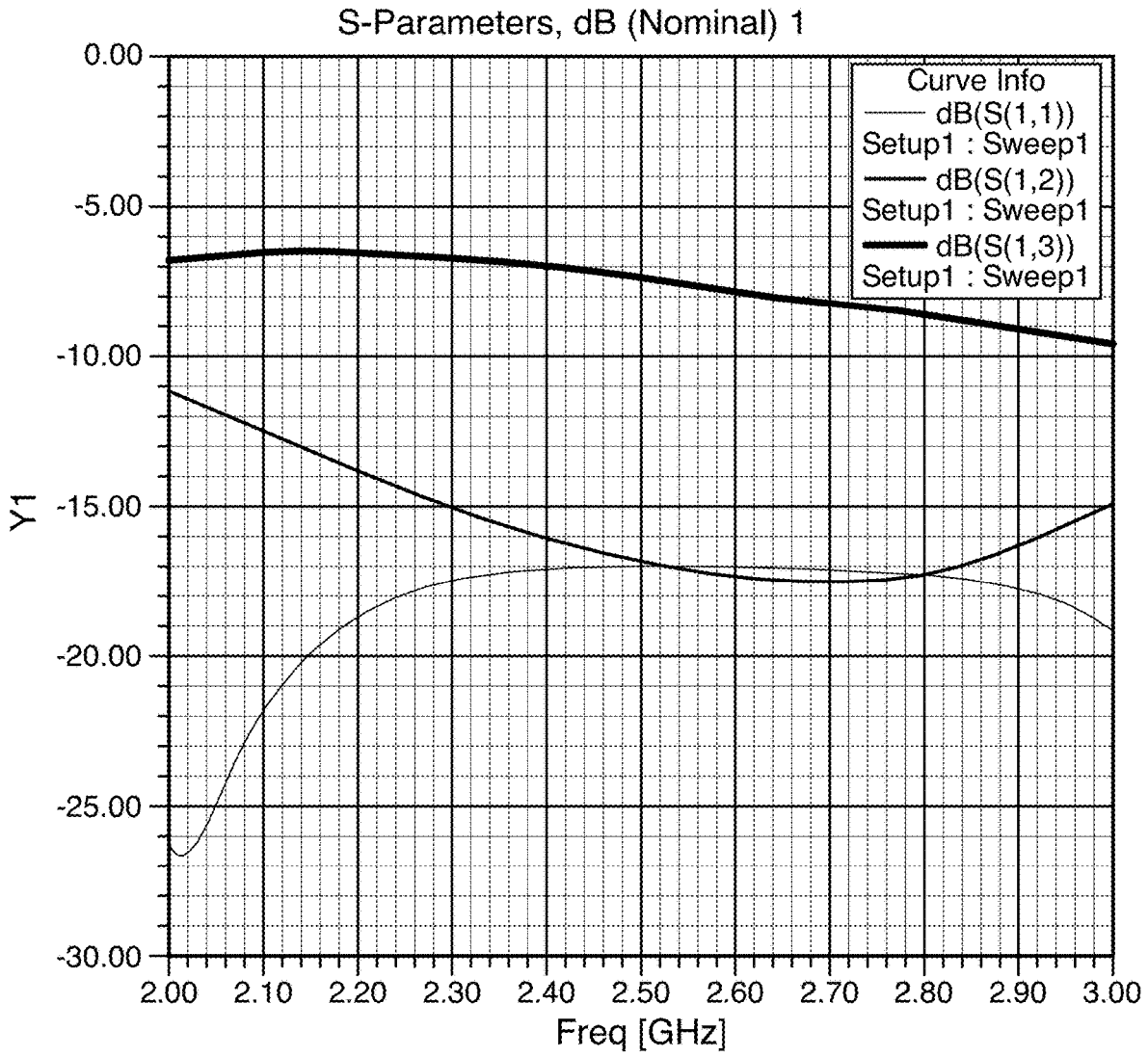
FIGS. 12B-12E are plots showing the radiation pattern and S-parameters of the QHA of FIG. 12A, and a comparative prior art QHA.
Figure 12C:
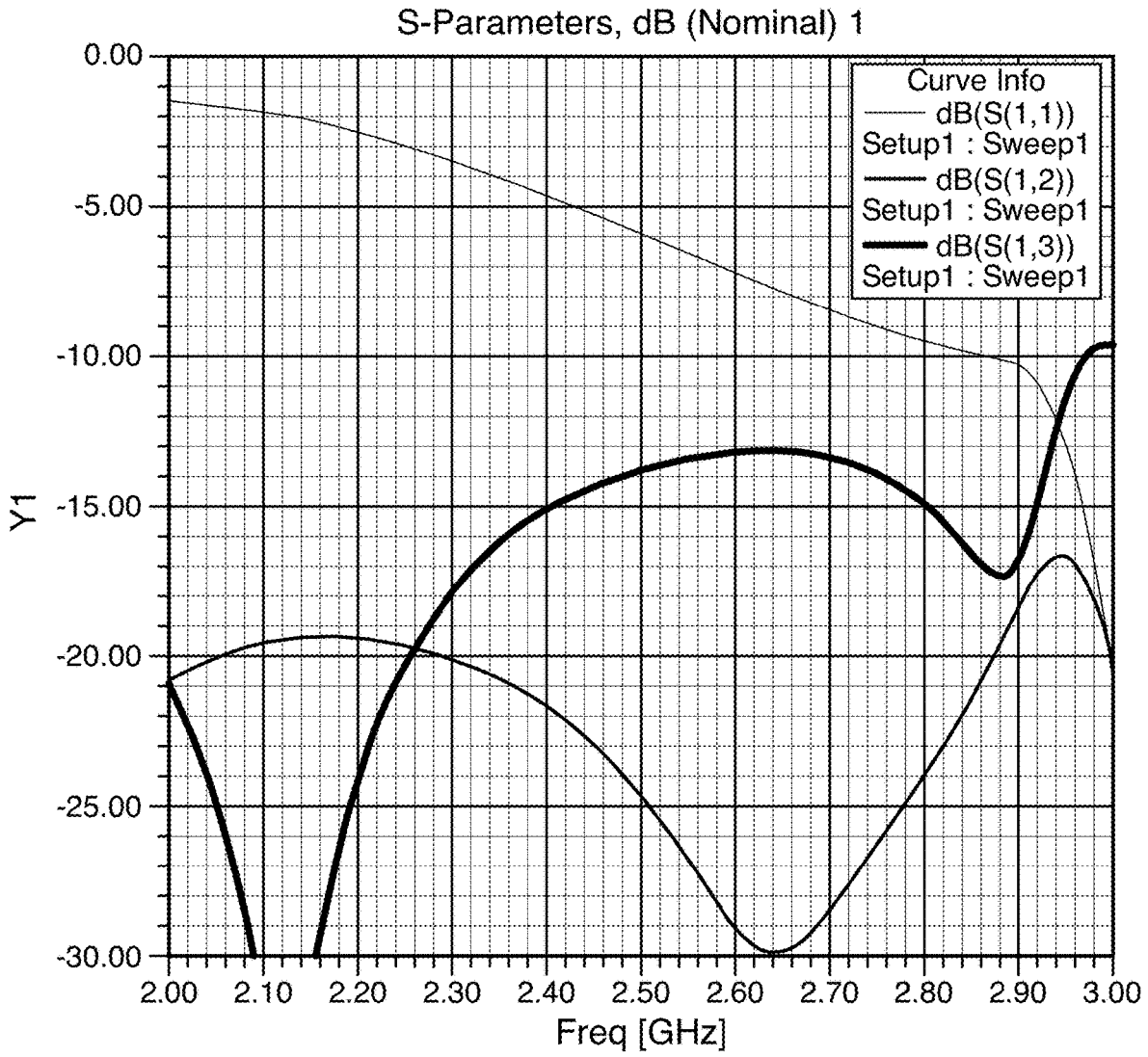
Figure 12D:
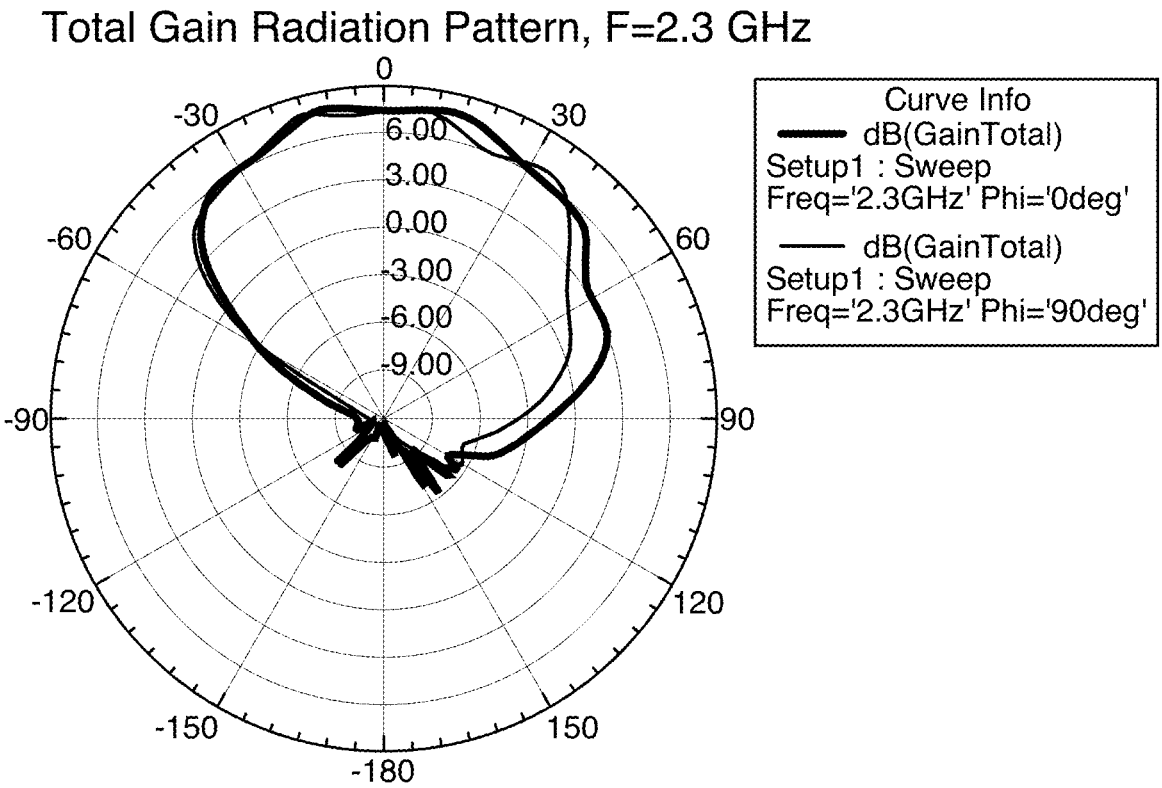
Figure 12D:
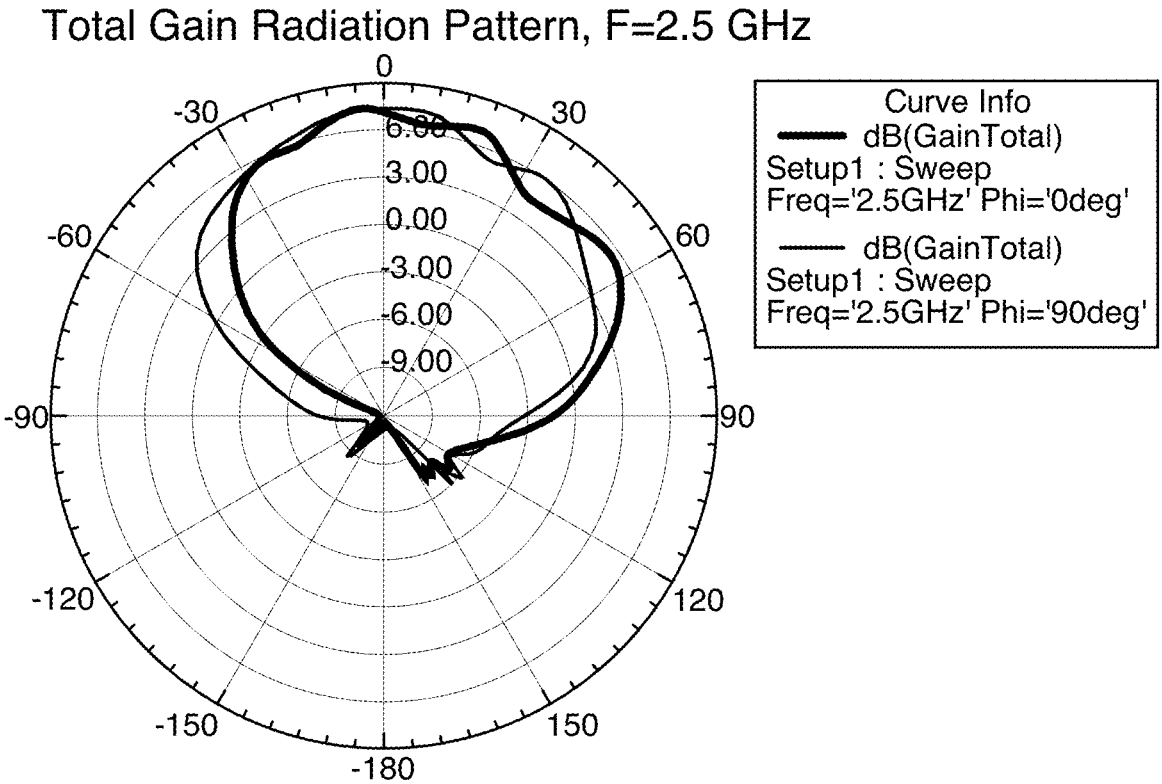
Figure 12E:
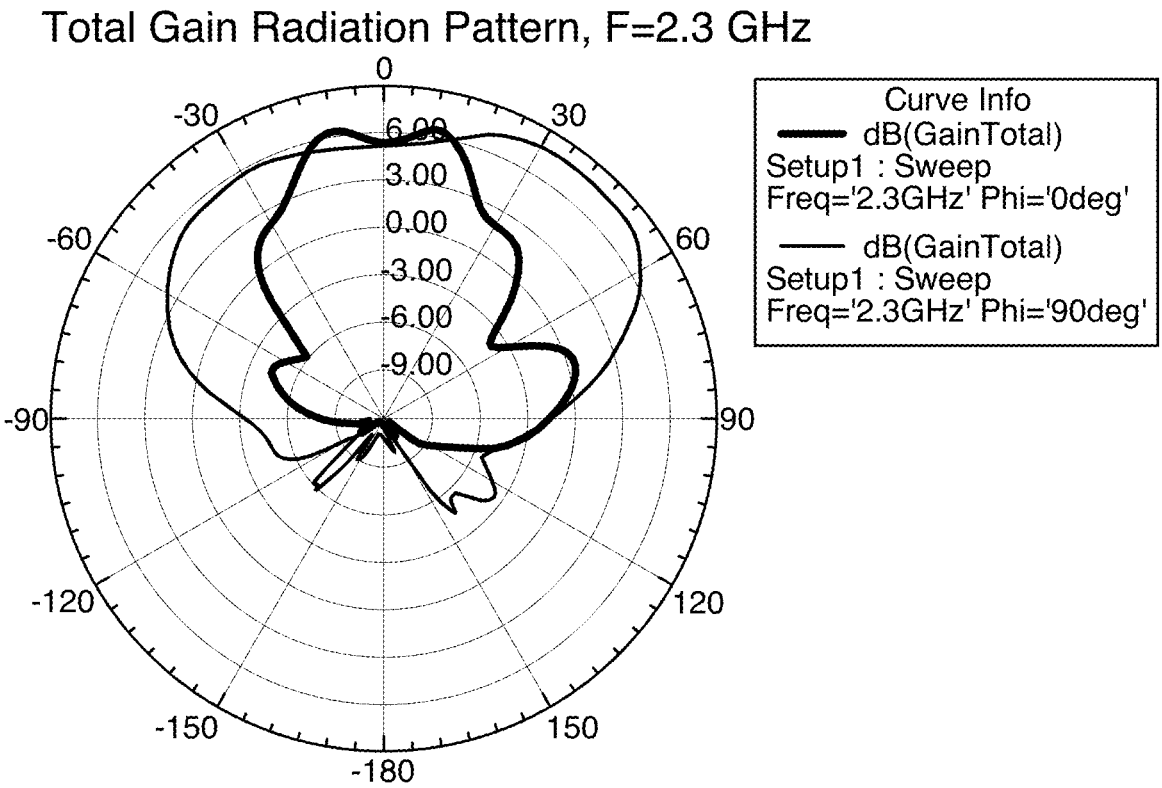
Figure 12E:
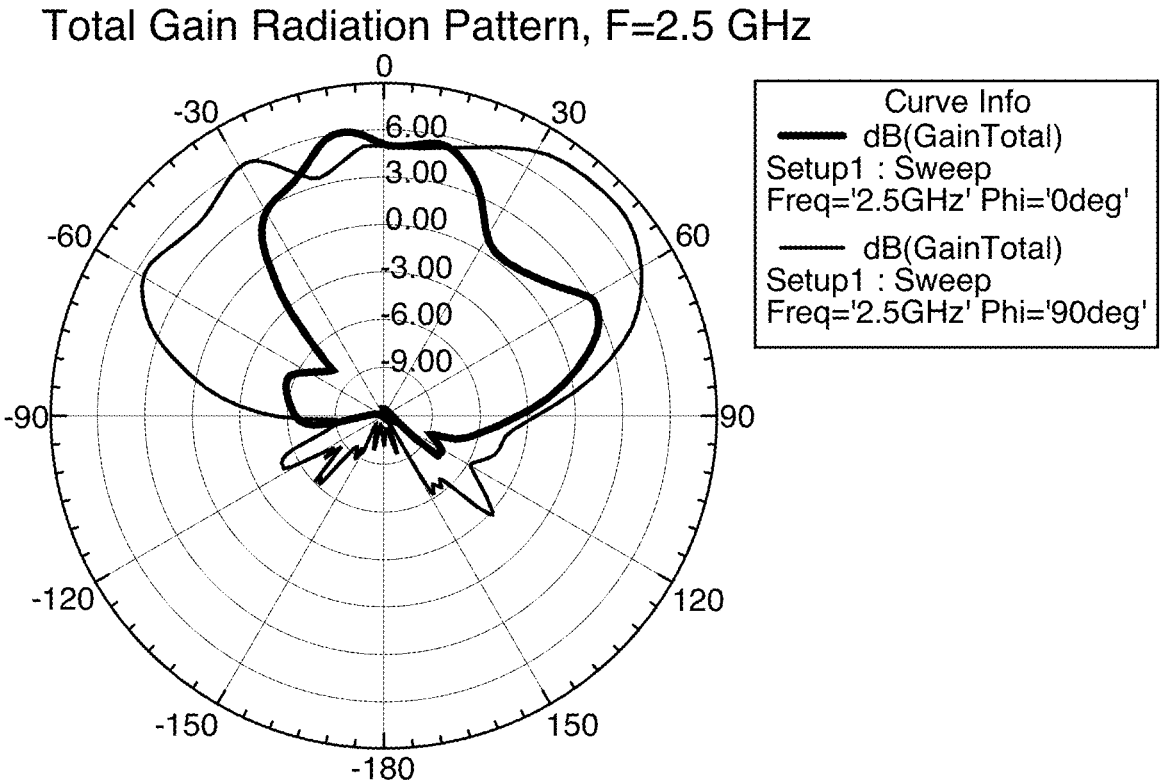

The characteristics of the example QHA 1200 may be compared with the characteristics of a prior art QHA (not shown) having identical dimensions and configuration, but without the conductive ring 1210. FIGS. 12B and 12C show the S-parameters of the example QHA 1200 and comparative prior art QHA, respectively. It can be seen that the example QHA 1200 achieves improved S-parameters compared to the prior art QHA. FIGS. 12D and 12E show the radiation patterns of the example QHA 1200 and comparative prior art QHA, respectively, at operating frequencies of 2.3 GHz and 2.5 GHz. It can be seen that the example QHA 1200 achieves improved radiation patterns compared to the prior art QHA.

Generally, the conductive helical traces may be provided about any suitable geometry including, for example, square, spherical, cylindrical or conical surfaces. Concentric surfaces may be used. Different geometries for the QHA may be achieved by shaping the dielectric material, or other supporting surface, accordingly. It should be understood that a helical antenna and conductive helical traces, in the present disclosure, are not strictly limited to a circular or cylindrical geometry. Windings made about a non-cylindrical geometry may also be referred to as being "helical". Selection of an appropriate geometry for the QHA may be performed as part of antenna tuning and to obtain a desired radiation pattern (e.g., with the assistance of simulations). FIGS. 13-19C, discussed below, show example design variations that can be implemented, together with conductive patches, for the purpose of radiation pattern shaping. Although discussed individually, such variations may be used in combination.

Figure 13:
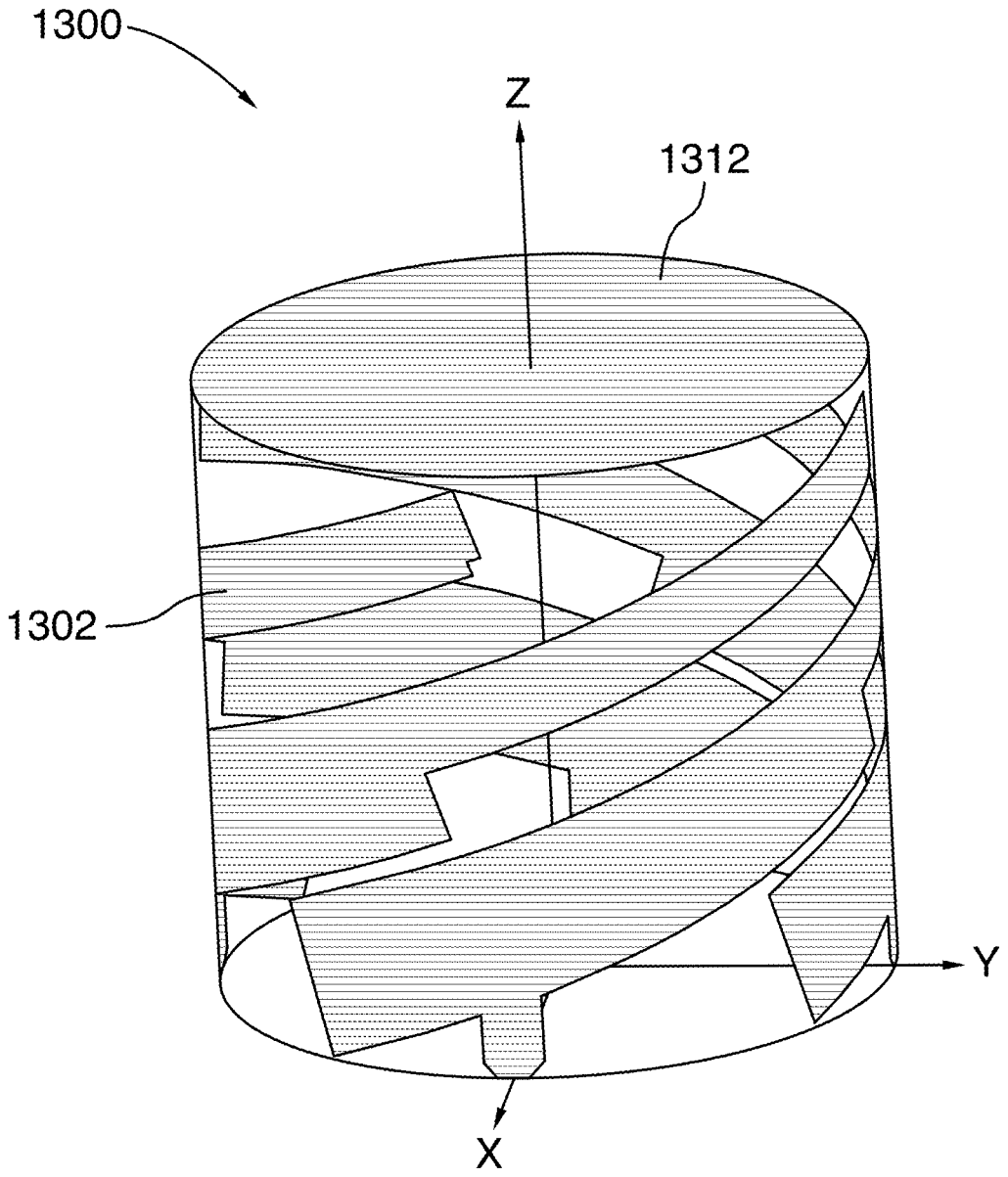
FIG. 13 is a schematic diagram of an example QHA having an upper plate.

FIG. 13 is a schematic diagram of another example QHA 1300 which includes an upper plate 1312. For clarity, the conductive patches are not shown. The upper plate 1312 may be made of the same conductive material as the conductive helical traces 1302, for example. The upper plate 1312 is positioned on a plane perpendicular to the longitudinal axis of the QHA 1300, and is centered on the longitudinal axis of the QHA 1300. The upper plate 1312 is spaced apart and insulated from the conductive helical traces 1302.

Figure 14:
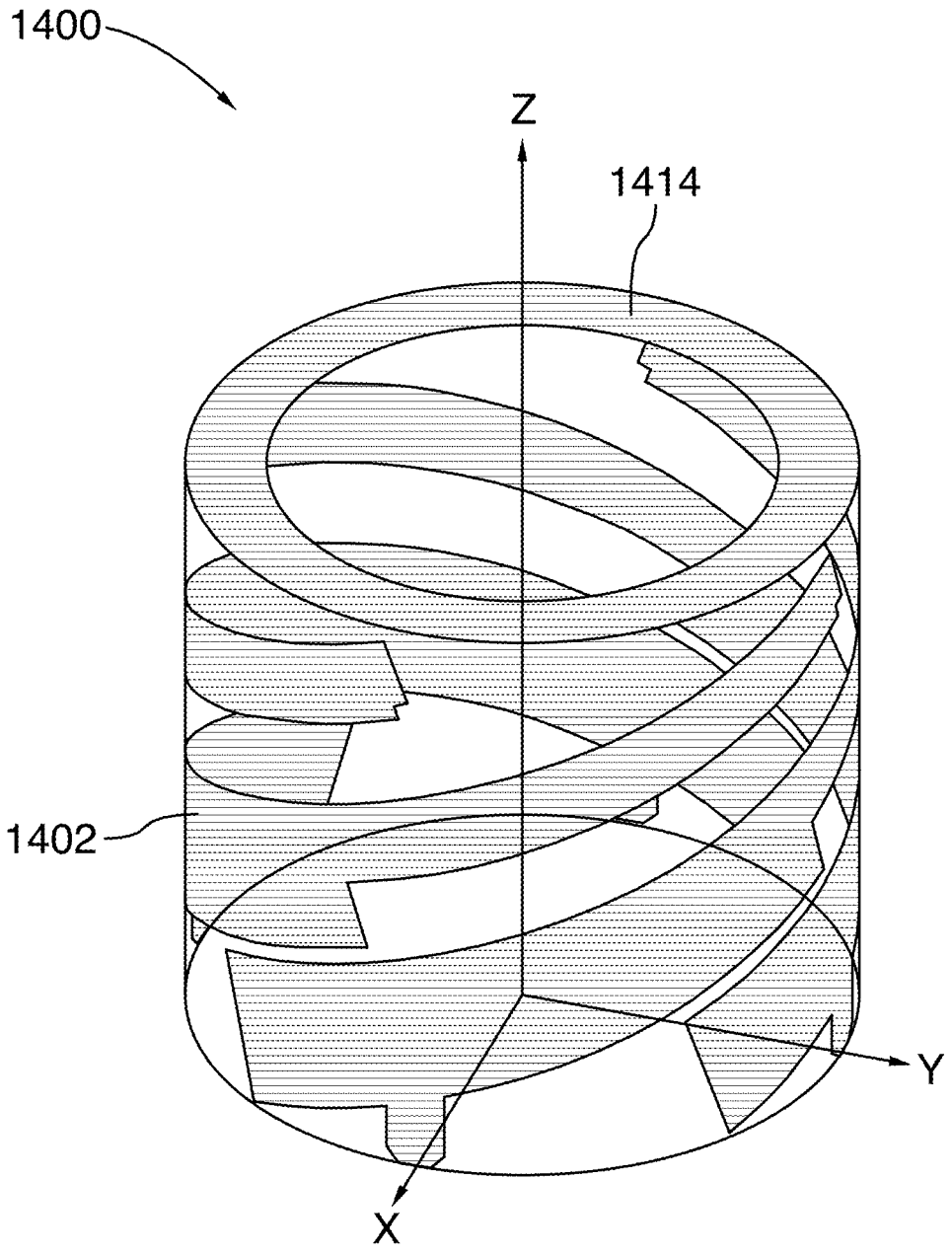
FIG. 14 is a schematic diagram of an example QHA having an upper ring.

FIG. 14 is a schematic diagram of another example QHA 1400 which includes an upper ring 1414. For clarity, the conductive patches are not shown. The upper ring 1414 may be made of the same conductive material as the conductive helical traces 1402, for example. The upper ring 1414 is positioned on a plane perpendicular to the longitudinal axis of the QHA 1400, and the longitudinal axis of the QHA 1400 passes through the center of the upper ring 1414. The upper ring 1414 is spaced apart and insulated from the conductive helical traces 1402.

Figure 15:
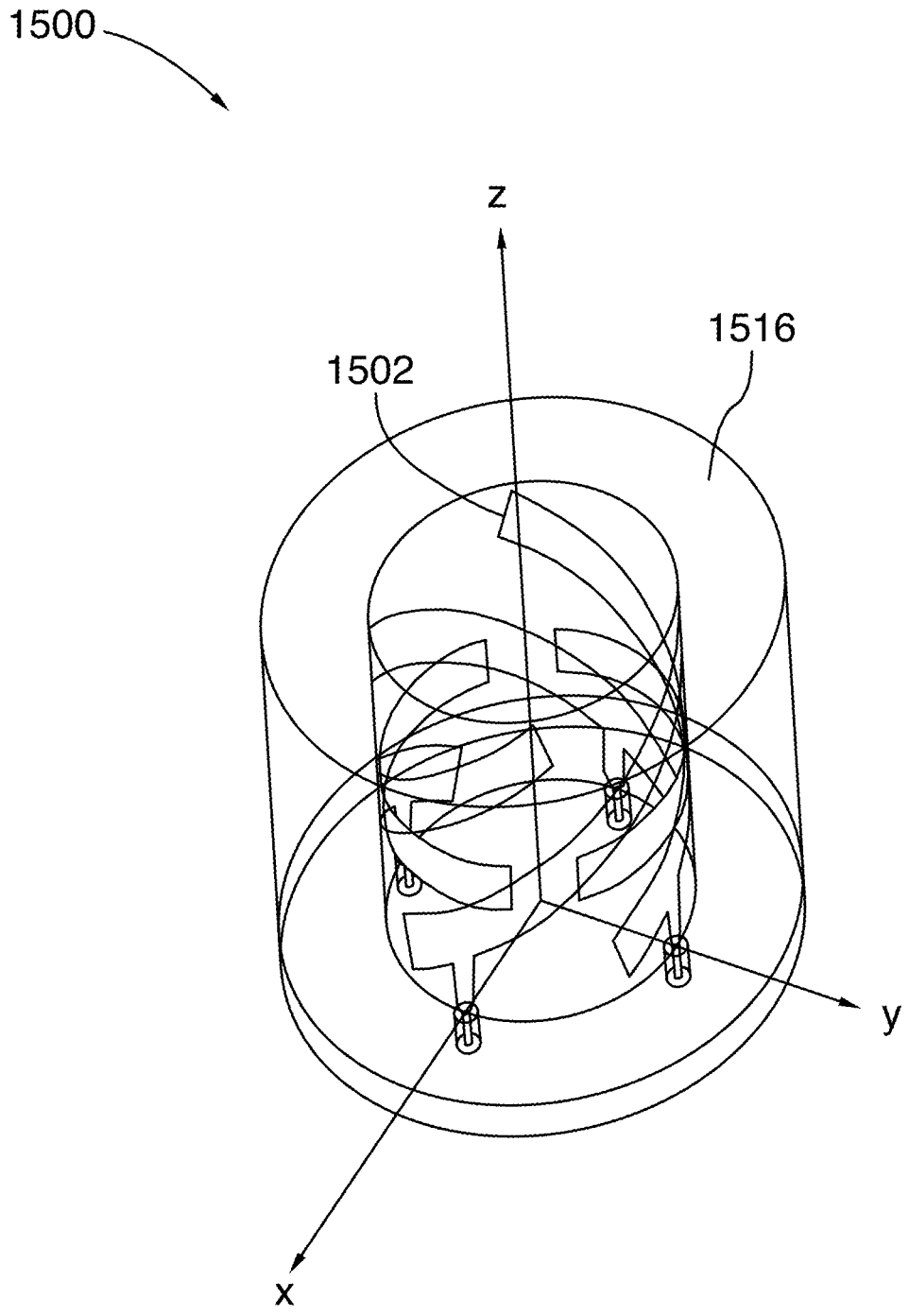
FIG. 15 is a schematic diagram of an example QHA having an outer shell.

FIG. 15 is a schematic diagram of another example QHA 1500 which includes conductive (e.g., metal) outer shell 1516 surrounding the conductive helical traces 1502. The outer shell 1516 is spaced apart from the conductive helical traces 1502. The outer shell 1516 may be a solid surface, or may be formed by strips of material (e.g., similar to a grill or cage).

Figure 16:
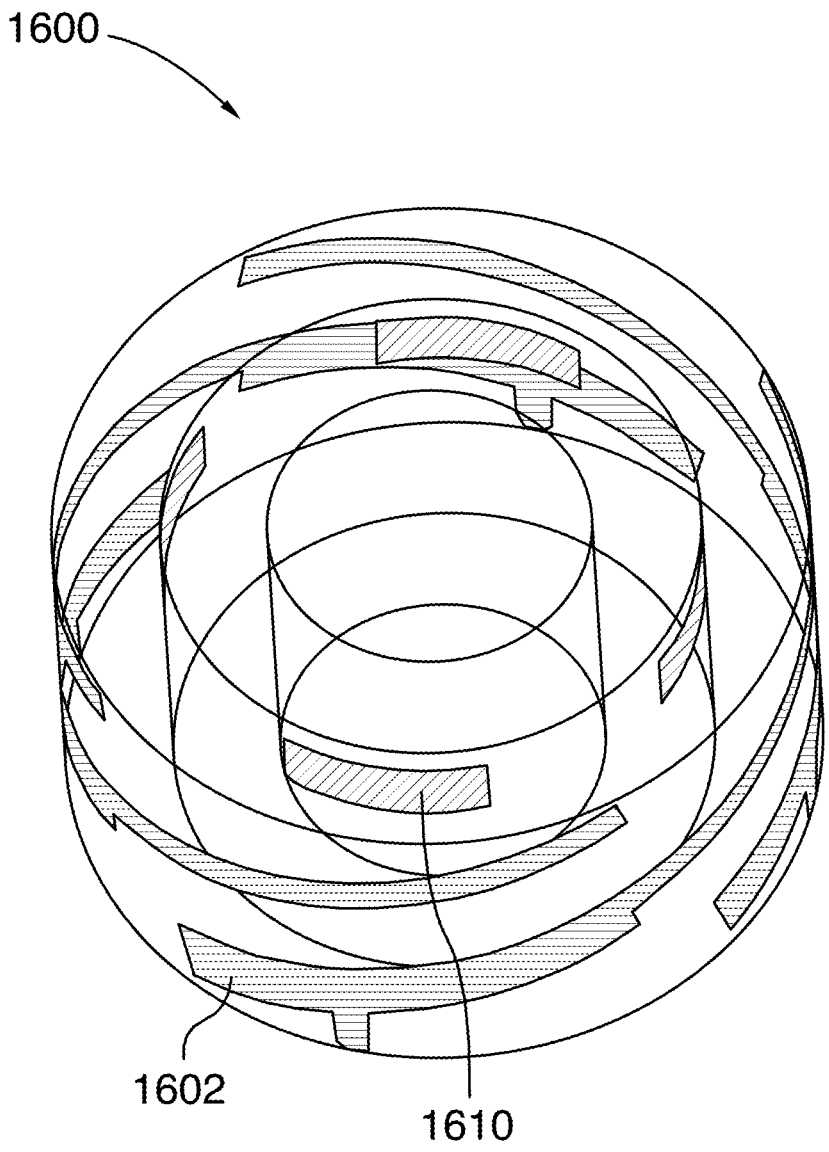
FIG. 16 is a schematic diagram of an example QHA formed using concentric dielectric layers.

FIG. 16 is a schematic diagram of another example QHA 1600 in which the conductive helical traces 1602 and conductive component (in this case, conductive patches 1610) are provided as traces on concentric dielectric cylinders. In this example, the conductive helical traces 1602 and conductive patches 1610 may be separately printed on separate pieces of dielectric material, then the separate dielectric material may be wrapped around each other to obtain the concentric arrangement shown in FIG. 16.

Figure 17:
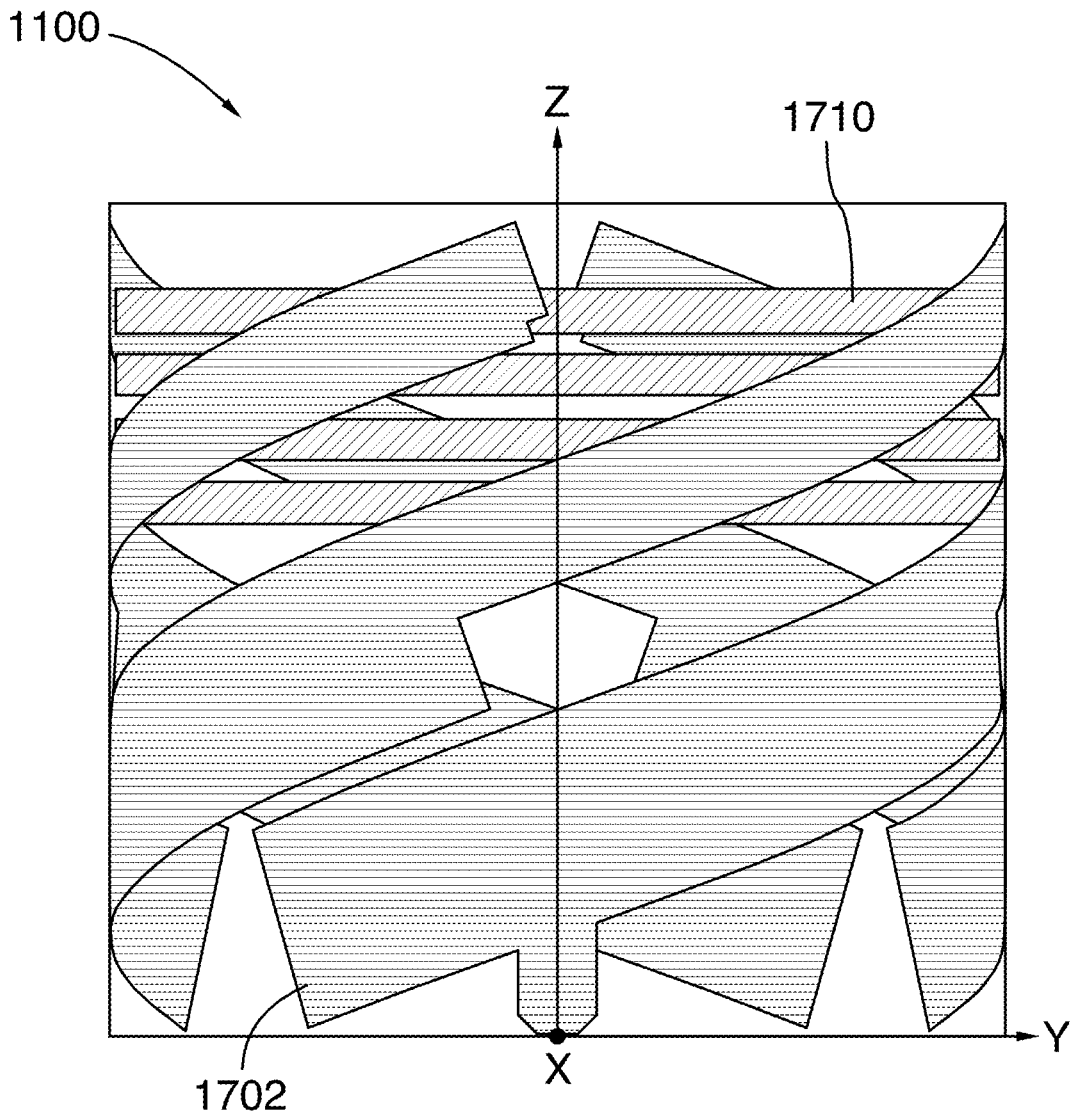
FIG. 17 is a schematic diagram of an example QHA having multiple conductive rings.

In some examples, a single conductive helical trace may be superimposed by more than one conductive component. For example, FIG. 17 illustrates an example QHA 1700 in which there is a plurality of conductive rings 1710, in this case four conductive rings 1710. Each conductive helical trace 1702 is thus superimposed by four different conductive rings 1710 at different locations along the conductive helical trace 1702. In this example, each of the four conductive rings 1710 has identical dimensions, but different longitudinal positions along the QHA 1700. In other examples, the conductive rings 1710 may have different dimensions (e.g., different widths) and/or configurations.

Figure 18A:
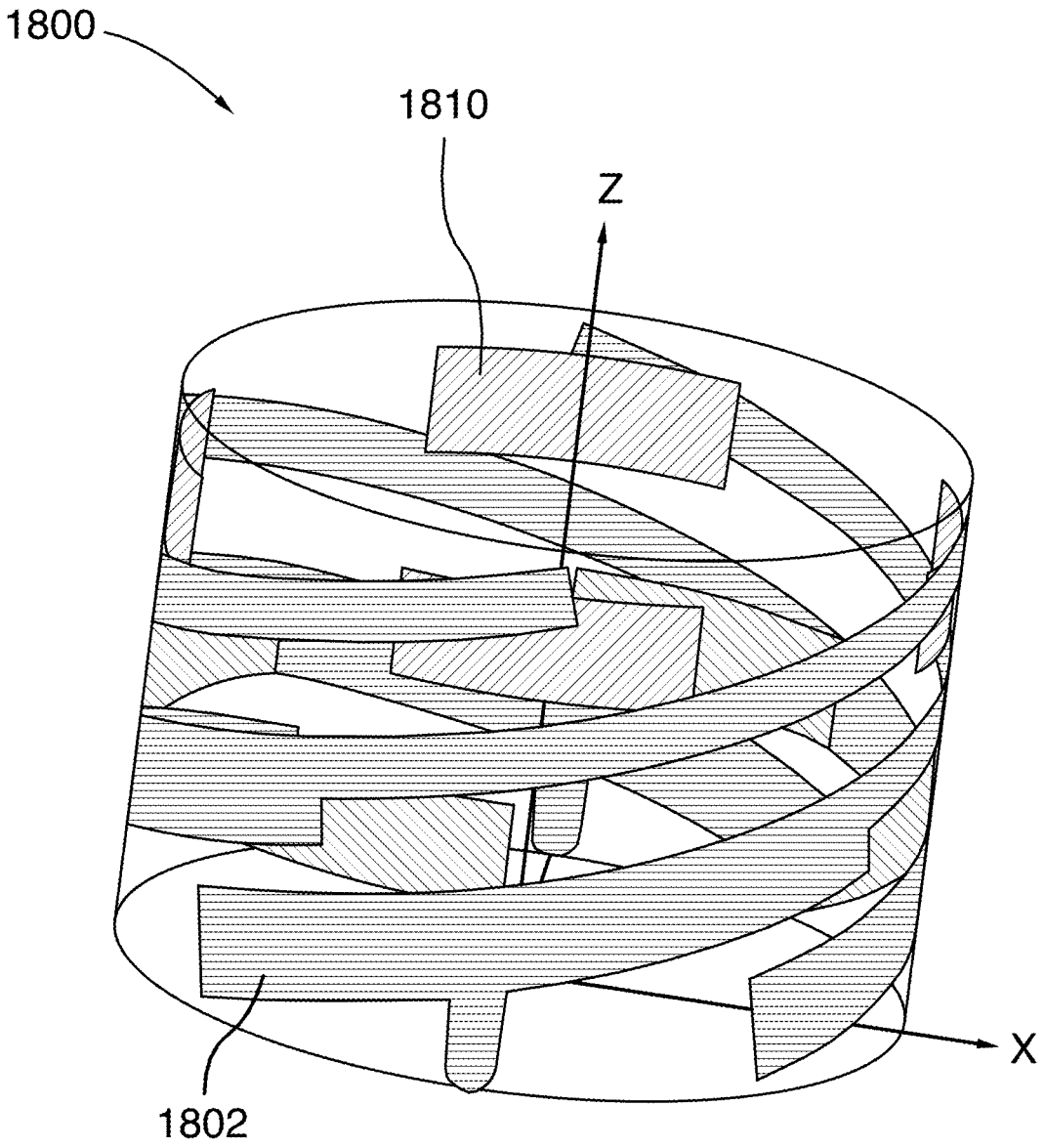
FIG. 18A is a schematic diagram of an example QHA having two sets of conductive patches.
Figure 18B:
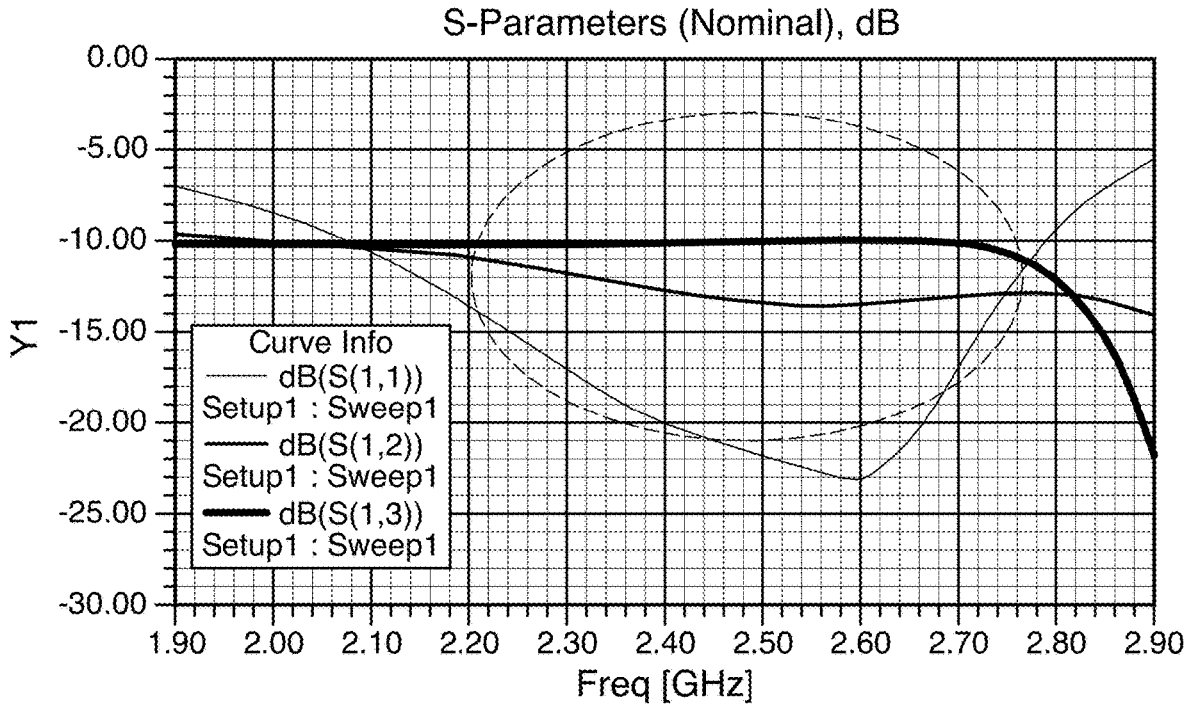
FIGS. 18B-18C are plots showing the radiation pattern and S-parameters of the QHA of FIG. 18A.
Figure 18C:
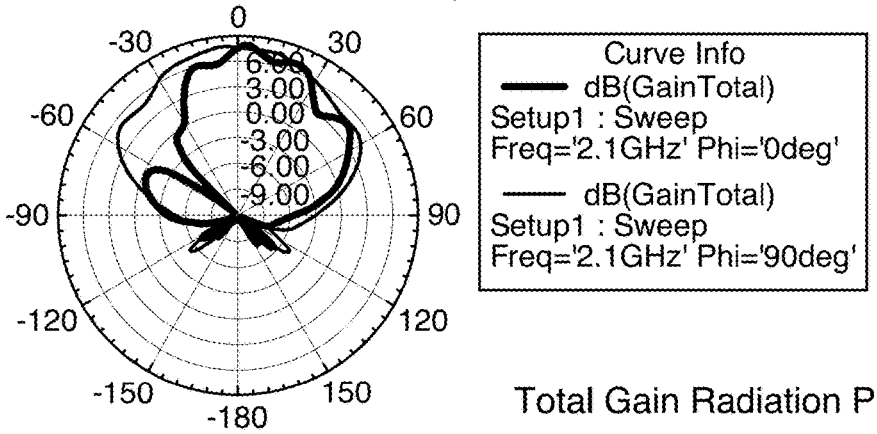
Figure 18C:
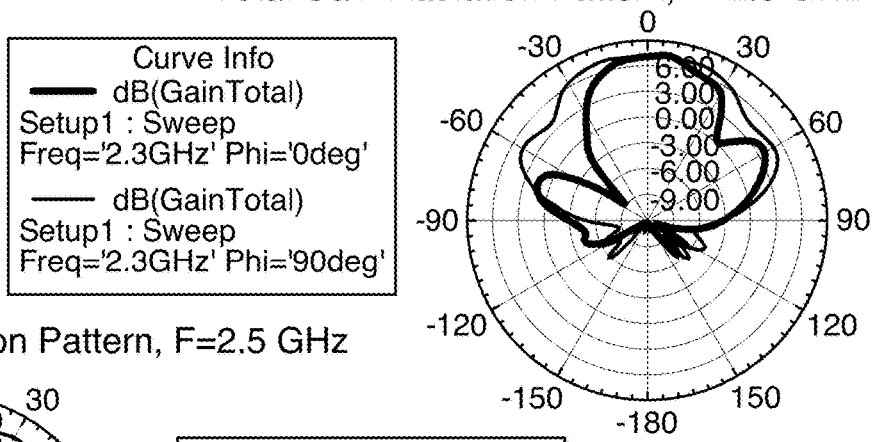
Figure 18C:
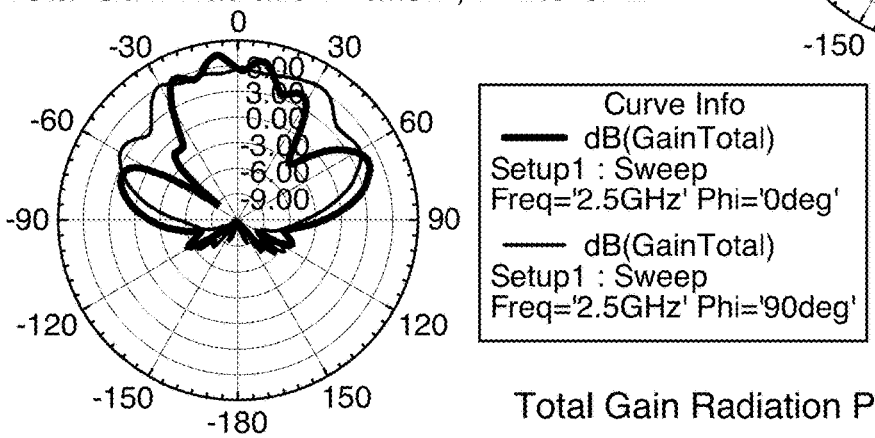
Figure 18C:
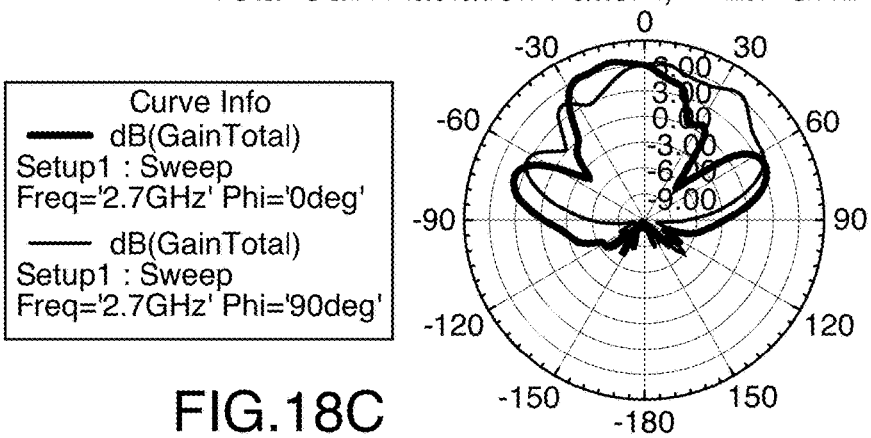

FIG. 18A illustrates an example QHA 1800 in which the number of conductive patches 1810 is double the number of conductive helical traces 1802, such that each conductive helical trace 1802 is superimposed by two different conductive patches 1810 at different locations along its length. In the example shown, each of the conductive patches 1810 has identical dimensions. There are two sets of conductive patches 1810 at two different longitudinal positions along the QHA 1800, and with an angular offset between the two sets. In other examples, the conductive patches 1810 may have different dimensions (e.g., two sets of two different widths) and/or configurations. FIG. 18B is a plot of the S-parameters for the example QHA 1800. FIG. 18C shows the radiation patterns of the example QHA 1800 at operating frequencies of 2.1 GHz, 2.3 GHz, 2.5 GHz and 2.7 GHz. FIGS. 18B and 18C may be compared to the corresponding plots shown in FIGS. 8B and 8C for the QHA 800, which has identical dimensions but only one set of conductive patches 810. As can be seen, the use of two sets of conductive patches 1810 may improve coupling to less than −10 dB (indicated by dotted line in FIG. 18B), i.e. providing improvement in port isolation.

Figure 19A:
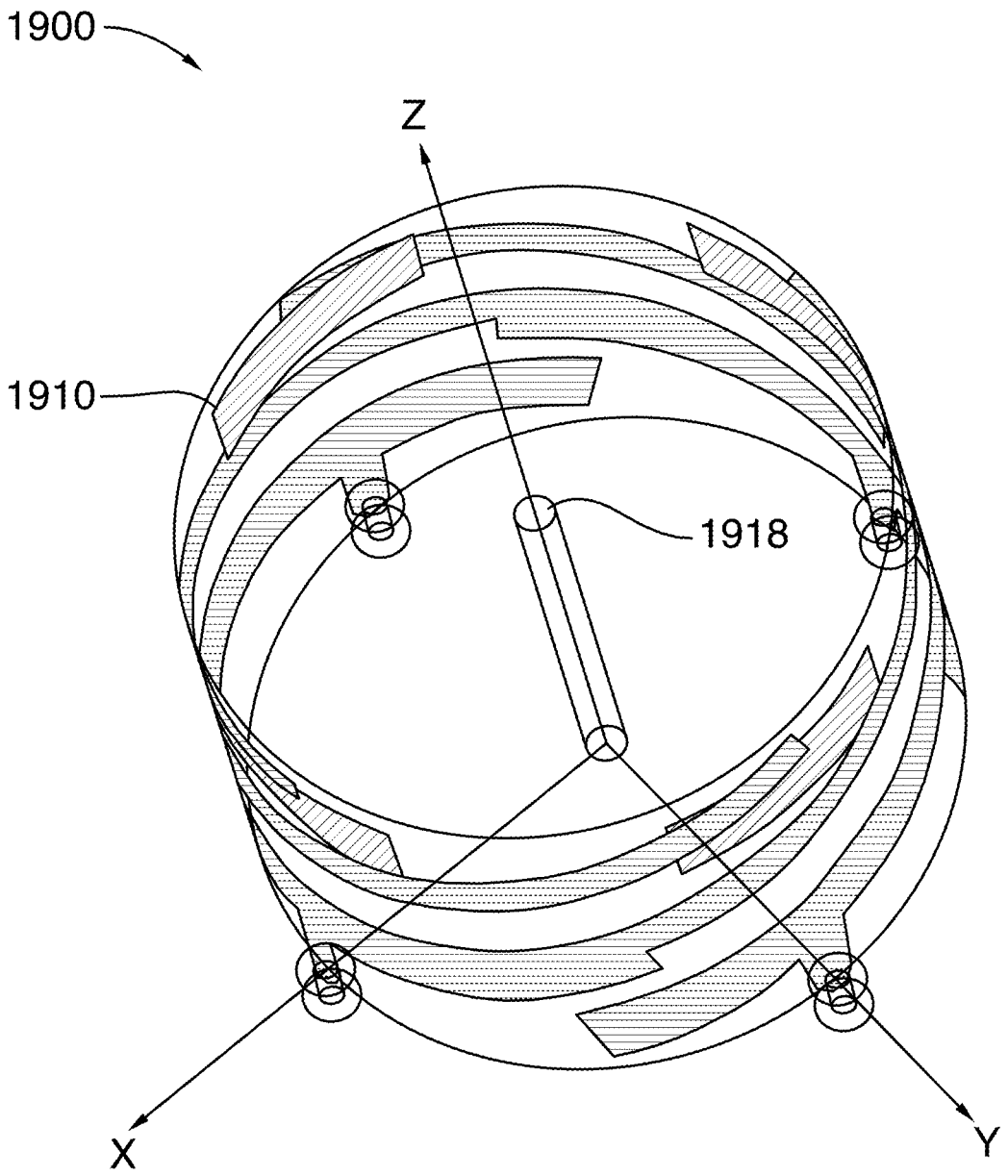
FIG. 19A is a schematic diagram of an example QHA having a central rod.
Figure 19B:
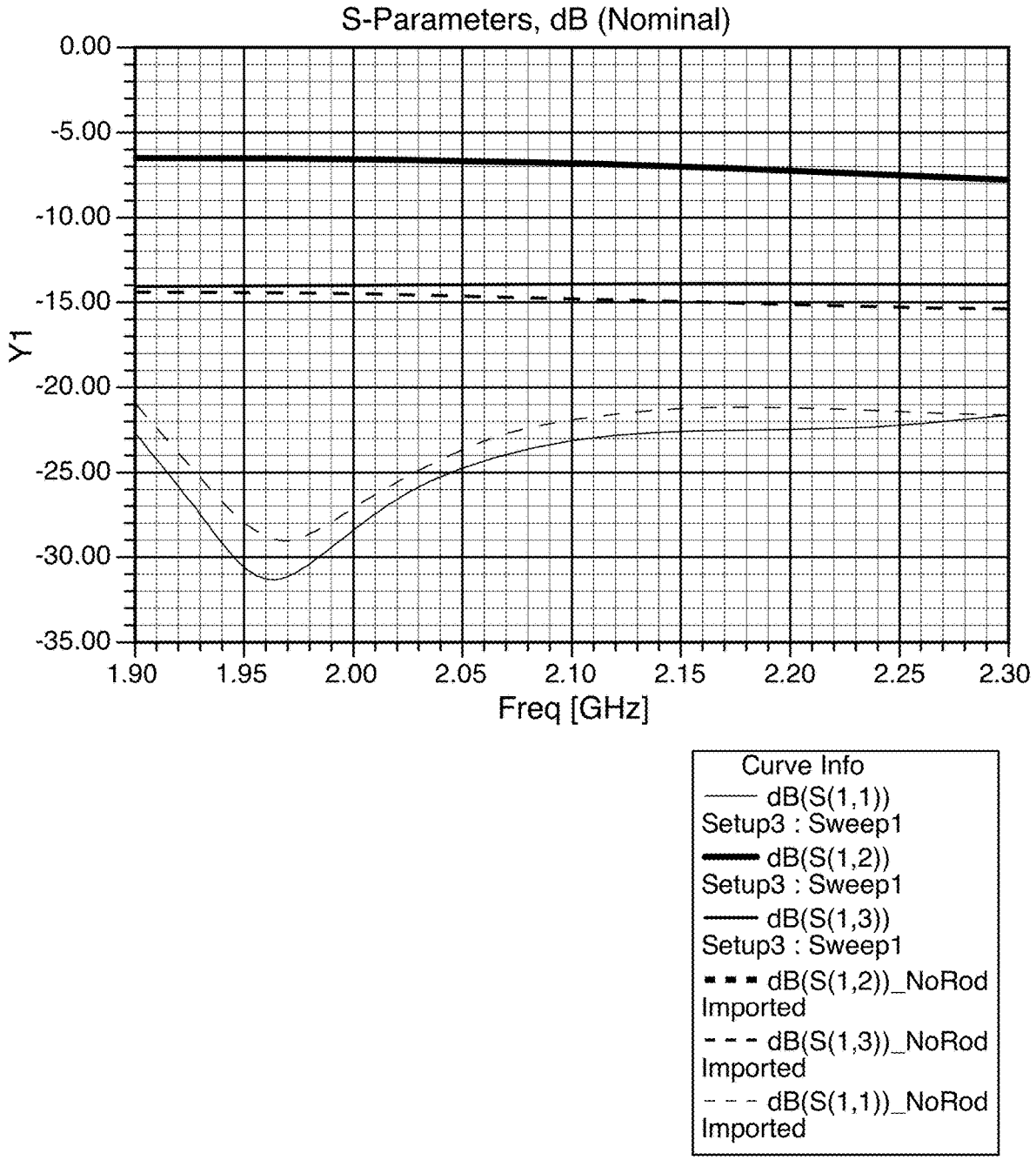
FIGS. 19B-19C are plots showing the radiation pattern and S-parameters of the QHA of FIG. 19A, compared to a QHA without a central rod.
Figure 19C:
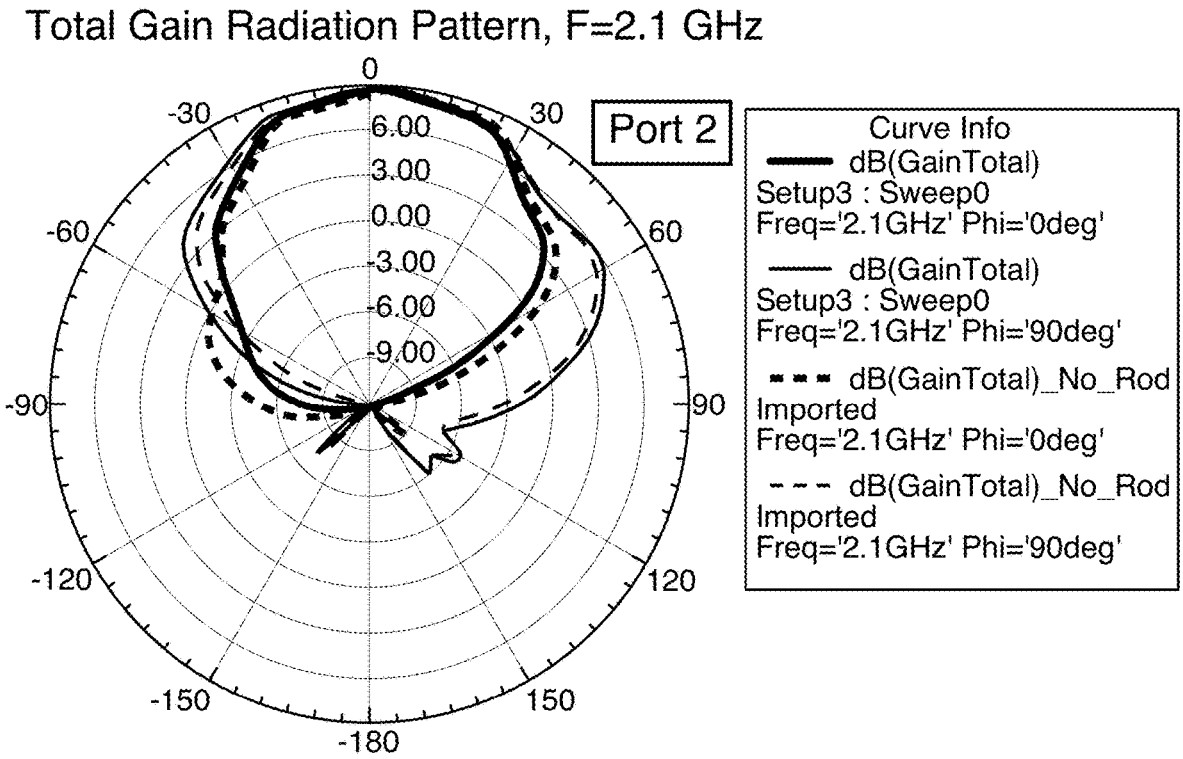
Figure 19C:
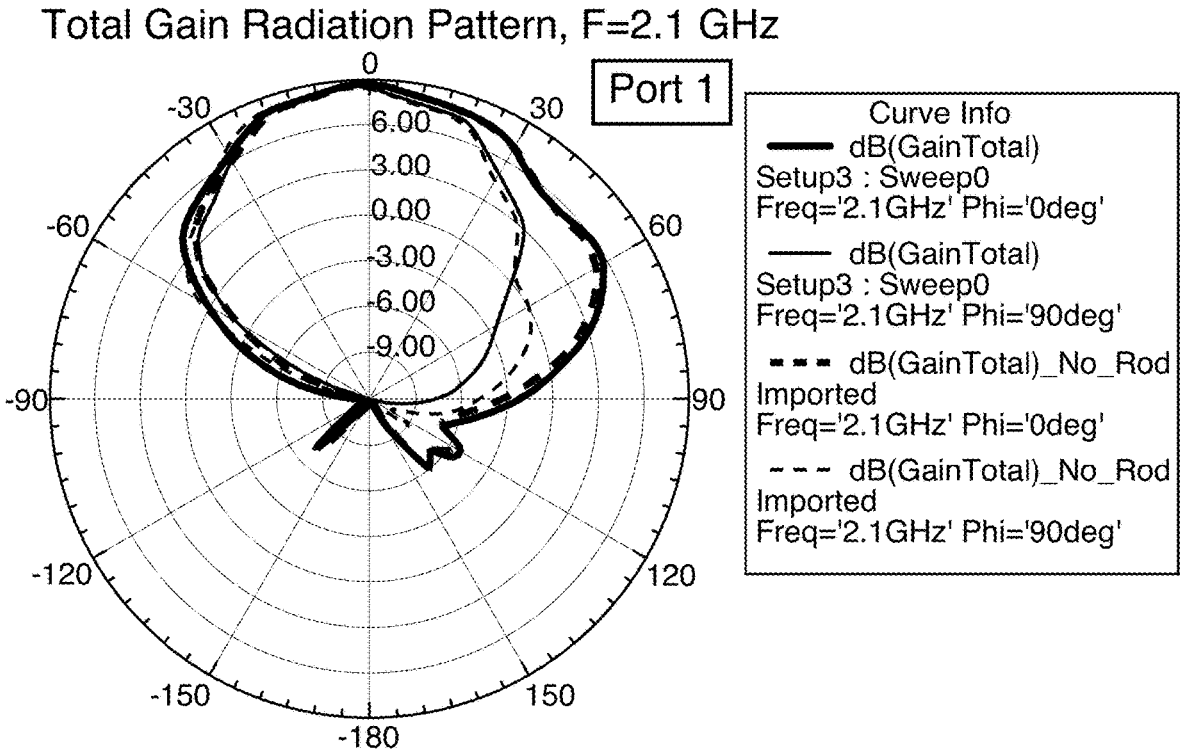

FIG. 19A illustrates an example QHA 1900 including a central conductive rod 1918 along the longitudinal axis of the QHA 1900, in addition to conductive patches 1910. In this example, the conductive rod 1918 has a height of 36 mm=0.252λ and a diameter of 3 mm=0.021λ, for an operating frequency of 2.1 GHz. FIG. 19B shows the S-parameters of the example QHA 1900, compared to those of a comparative QHA (not shown) having identical dimensions and conductive patches 1910 but no central rod 1918. FIG. 19C shows the radiation pattern of the example QHA 1900, compared to the comparative QHA without rod as shown in FIG. 8C for an operating frequency of 2.1 GHz for port 1 on. As can be seen, the addition of the central rod 1918 may reduce the radiation side lobes, while the S-parameters may be slightly affected.

Figure 20:
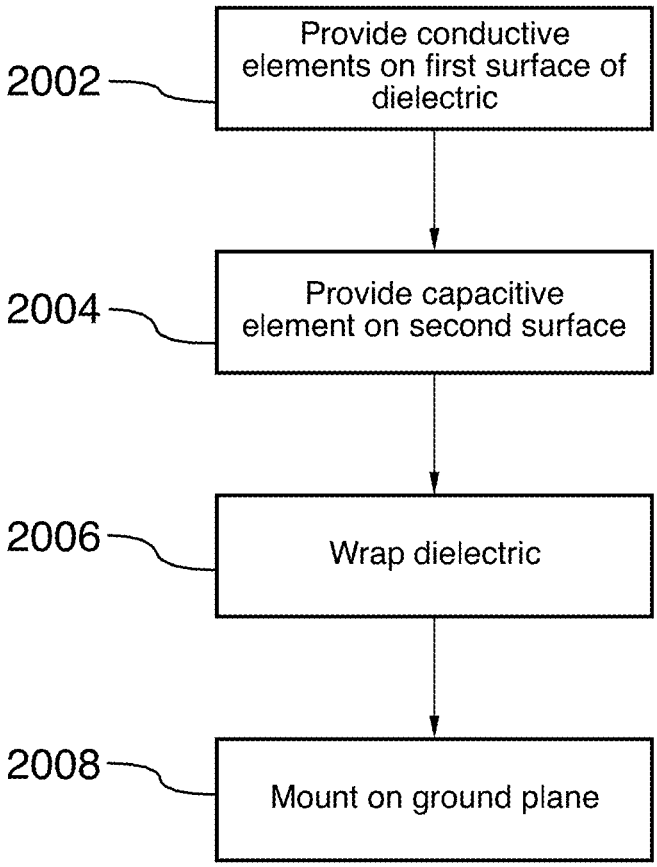
FIG. 20 is a flowchart illustrating an example method for manufacturing an example of the disclosed QHAs.

FIG. 20 is a flowchart illustrating an example method 2000 for manufacturing an example of the disclosed QHAs. The method 2000 may be suitable for examples in which the conductive helical traces of the QHA are provided as traces on a flexible dielectric material.

At 2002, the conductive helical traces are provided on a first surface of a flexible dielectric material. In examples discussed above, the dielectric material may be double Pyralux AP layers having dielectric constant of 3.4 and thickness of 0.127 mm. The conductive helical traces may be etched onto one surface of the dielectric material, using suitable etching techniques. The conductive helical traces may be etched together with the launch lines.

At 2004, one or more conductive components (e.g., one or more conductive patches and/or conductive rings) are provided on a second surface of the same or different dielectric material. The one or more conductive components are provided such that they are insulated from the conductive helical traces and superimposed on the conductive helical traces, as discussed above. For example, the conductive helical traces and conductive component(s) may be provided on opposing surfaces of the same dielectric material (e.g., by etching or other suitable technique). In some examples, the conductive component(s) may be provided on an inner layer of a dual-layer dielectric, such that the one or more conductive components are sandwiched between dielectric layers, and the conductive helical traces may be provided on an outer exposed layer of the dual-layer dielectric material. In some examples, the conductive component(s) may be provided on a dielectric material separate from the conductive helical traces, and the two dielectric materials may be laminated together or wrapped about each other (at 2006 below).

At 2006, the dielectric material is wrapped such that the conductive helical traces form helical windings about a common longitudinal antenna axis, to form the QHA. The dielectric material may be sufficiently self-supporting, or may be wrapped about another supporting material or structure. The ends of the dielectric material may be joined together to form a tubular structure, using any suitable adhesive for example. The dielectric material may be shaped to different geometries, such as a cylinder or a square-based tube, to tune the QHA. Where the conductive helical traces and conductive component(s) are provided on different dielectric material, the different dielectric material may be wrapped about each other, for example to form two concentric tubes.

At 2008, the dielectric material is mounted on a ground plate. This may involve connecting the launch lines to ports defined in the ground plate. In cases where an antenna array is being manufacture, multiple antennae may be mounted to a common ground plate. The use of a ground plate and the size of the ground plate may be selected based on the application.

In the examples described above, certain example dimensions and configurations are provided, however, these are for the purpose of illustration only and are not intended to be limiting. Generally, the selection of conductive component (s) to incorporate into the QHA, as well as the location, dimensions and orientation of the conductive component(s) may be selected (e.g., using appropriate antenna tuning techniques) to provide the desired impedance match, radiation pattern and/or isolation in a desired frequency band and/or operating frequency. Other aspects of the QHA, such as dimensions and configuration of the conductive helical traces, may be similarly selected to achieve desired antenna characteristics.

The various example QHAs described herein may be used for transmitting or receiving, as appropriate. Each QHA may be used as an individual antenna, in duality, trinity, quadruple or quintet; or in a MIMO antenna array for example. Generally, the example QHAs may be used for any application in which a four-port antenna is suitable, including in base stations or elsewhere in the backhaul of a telecommunications network.

The example QHAs disclosed herein may be suitable for use in a 5G wireless network, for example for use in an Internet of Things (IoT) application. The inclusion of conductive component(s) in the QHA may enable a reduction in size of individual QHAs as well as antenna arrays, which may enable incorporation of antennas in various products. For example, examples of the disclosed QHA may be incorporated into traffic antennae, in-road and manhole lid-mounted antennae, desktop antennae, street light pole antennae, as well as other mobile and stationary computing devices and infrastructure equipment, both indoors and outdoors. The example disclosed QHAs may be designed to operate in frequencies for WiFi, Bluetooth, cellular, industrial scientific and medical (ISM), broadband and/or spread spectrum communications. The ability to widely incorporate the example QHAs into various products may enable an increase in communication capacity, and may enable their use as signal boosters.

Although the present disclosure describes methods and processes with steps in a certain order, one or more steps of the methods and processes may be omitted or altered as appropriate. One or more steps may take place in an order other than that in which they are described, as appropriate.

Although the present disclosure is described, at least in part, in terms of methods, a person of ordinary skill in the art will understand that the present disclosure is also directed to the various components for performing at least some of the aspects and features of the described methods, be it by way of hardware components, software or any combination of the two. Accordingly, the technical solution of the present disclosure may be embodied in the form of a software product. A suitable software product may be stored in a pre-recorded storage device or other similar non-volatile or non-transitory computer readable medium, including DVDs, CD-ROMs, USB flash disk, a removable hard disk, or other storage media, for example. The software product includes instructions tangibly stored thereon that enable a processing device (e.g., a personal computer, a server, or a network device) to execute examples of the methods disclosed herein.

The present disclosure may be embodied in other specific forms without departing from the subject matter of the claims. The described example embodiments are to be considered in all respects as being only illustrative and not restrictive. Selected features from one or more of the above-described embodiments may be combined to create alternative embodiments not explicitly described, features suitable for such combinations being understood within the scope of this disclosure.

All values and sub-ranges within disclosed ranges are also disclosed. Also, although the systems, devices and processes disclosed and shown herein may comprise a specific number of elements/components, the systems, devices and assemblies could be modified to include additional or fewer of such elements/components. For example, although any of the elements/components disclosed may be referenced as being singular, the embodiments disclosed herein could be modified to include a plurality of such elements/components. The subject matter described herein intends to cover and embrace all suitable changes in technology.

The invention claimed is:

1. A quad port helical antenna (QPHA) comprising:

a plurality of conductive helical traces wound about a common longitudinal antenna axis of the antenna for transmitting or receiving a signal at a frequency band;

each of the conductive helical traces being independently fed by being connected to a respective independent port of the antenna via a respective independent launch line; and at least one conductive component insulated from the conductive helical traces, separate from the launch lines, and at least partially superimposed over at least one of the conductive helical traces;

wherein the at least one conductive component comprises a plurality of conductive patches, each patch having a length that is less than a full rotation about the longitudinal antenna axis.

2. The QPHA of claim 1, wherein the conductive helical traces are provided as traces on a first surface of a supporting dielectric material.

3. The QPHA of claim 2, wherein the at least one conductive component is provided on a second surface, opposite to the first surface, of the supporting dielectric material.

4. The QPHA of claim 2, wherein the supporting dielectric material is a dual-layer dielectric material, and the at least one conductive component is provided between two layers of the supporting dielectric material.

5. The QPHA of claim 2, wherein the at least one conductive component is provided as a trace on another dielectric material.

6. The QPHA of claim 1, wherein the conductive helical traces are wound about a non-cylindrical geometry.

7. The QPHA of claim 1, wherein the at least one conductive component further comprises a conductive ring.

8. The QPHA of claim 1, further comprising a central conductive rod along the longitudinal antenna axis.

9. The QPHA of claim 1, wherein the antenna is mounted on a ground plane.

10. The QPHA of claim 1, wherein each of the launch lines has a sharp bend.

11. The QPHA of claim 1, further comprising an upper conductive plate positioned perpendicular to the antenna axis, the antenna axis passing through a center of the plate, and the plate being spaced away from the conductive helical traces.

12. The QPHA of claim 1, further comprising an upper conductive ring positioned on a plane perpendicular to the antenna axis, the antenna axis passing through a center of the ring, and the ring being spaced away from the conductive helical traces.

13. An antenna array comprising:

a plurality of quad port helical antennae, each quad port helical antenna comprising:

a plurality of conductive helical traces wound about a common longitudinal antenna axis, the conductive helical traces being configured for transmitting or receiving a signal at a frequency band;

each of the conductive helical traces being independently fed by being connected to a respective independent port of the antenna via a respective independent launch line; and at least one conductive component insulated from the conductive helical traces, separate from the launch lines, and at least partially superimposed over at least one of the conductive helical traces;

wherein the at least one conductive component comprises a plurality of conductive patches, each patch having a length that is less than a full rotation about the longitudinal antenna axis.

14. The antenna array of claim 13, wherein the at least one conductive component further comprises a conductive ring.

15. The antenna array of claim 13, wherein the conductive helical traces are provided as traces on a first surface of a supporting dielectric material, and the at least one conductive component is provided on a second surface, opposite to the first surface, of the supporting dielectric material.

16. The antenna array of claim 13, wherein the conductive helical traces are provided as traces on a first surface of a dual-layer supporting dielectric material, and the at least one conductive component is provided between two layers of the supporting dielectric material.

17. A method for manufacturing a quad port helical antenna, the method comprising:

providing a plurality of conductive helical traces as traces on a first surface of a flexible dielectric material, each conductive helical trace being configured to be independently fed by a respective independent launch line for connecting to a respective independent port of the antenna, the conductive helical traces being configured for transmitting or receiving a signal at a frequency band;

providing at least one conductive component on a different second surface of the flexible dielectric material, the at least one conductive component being positioned to be insulated from the conductive helical traces, separate from the launch lines, and at least partially superimposed over at least one of the conductive helical traces; and wrapping the flexible dielectric material such that the conductive helical traces form helical windings about a common longitudinal antenna axis;

wherein the at least one conductive component comprises a plurality of conductive patches, each patch having a length that is less than a full rotation about the longitudinal antenna axis.

18. The method of claim 17, further comprising mounting the wrapped dielectric material on a ground plane and connecting the launch lines to respective ports provided in the ground plane.

* * * * *